US008614633B1

(12) United States Patent
Lear et al.

(10) Patent No.: US 8,614,633 B1
(45) Date of Patent: Dec. 24, 2013

(54) INTEGRATED SMART HAZARD ASSESSMENT AND RESPONSE PLANNING (SHARP) SYSTEM AND METHOD FOR A VESSEL

(75) Inventors: Michael T. Lear, Baltimore, MD (US); Charles C. Nwadi, Baltimore, MD (US); Jessica M. Lockhart, Laurel, MD (US); John J. Curry, III, Baltimore, MD (US); Pamela Gilliam, Waldorf, MD (US); Nicholas D. Longo, Liverpool, NY (US); Michael A. Matyasik, Cicero, NY (US); Timothy M. Bearer, Liverpool, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 1771 days.

(21) Appl. No.: 11/970,147

(22) Filed: Jan. 7, 2008

Related U.S. Application Data

(60) Provisional application No. 60/879,262, filed on Jan. 8, 2007.

(51) Int. Cl.
*G08B 23/00* (2006.01)

(52) U.S. Cl.
USPC ..... 340/984; 114/382; 318/588; 701/21; 701/124

(58) Field of Classification Search
USPC ..... 340/984; 706/10; 709/209, 251, 247; 701/124, 21; 114/124, 201 R, 382; 318/588; 700/282
See application file for complete search history.

(56) References Cited

U.S. PATENT DOCUMENTS

| | | | | |
|---|---|---|---|---|
| 4,197,914 | A | 4/1980 | Grey | |
| 4,549,267 | A | 10/1985 | Drabouski | |
| 4,872,118 | A | 10/1989 | Naidenov et al. | |
| 4,918,628 | A | 4/1990 | Griffin et al. | |
| 5,349,644 | A | 9/1994 | Massey et al. | |
| 6,039,124 | A | 3/2000 | Bowman et al. | |
| 6,170,425 | B1 | 1/2001 | Blount | |
| 6,725,130 | B1 | 4/2004 | Rogers et al. | |
| 6,741,174 | B2 | 5/2004 | Rhoades et al. | |
| 6,789,493 | B2 | 9/2004 | Langh | |
| 6,816,088 | B1 | 11/2004 | Knoska et al. | |
| 6,823,810 | B2 | 11/2004 | Carlson et al. | |
| 7,099,755 | B2 | 8/2006 | Mueller et al. | |
| 8,073,974 | B2 * | 12/2011 | Rapp et al. | 709/247 |

OTHER PUBLICATIONS

Peter B. Zahn, et al., Shipboard Damaged Stability Assessment: The Flooding Casualty Control Software, Naval Engineers Journal, May 1993, pp. 152-166.

(Continued)

*Primary Examiner* — Brent Swarthout
(74) *Attorney, Agent, or Firm* — Clement A. Berard, Esq.; Dann, Dorfman, Herrell & Skillman, PC

(57) ABSTRACT

A hazard assessment and strategy formulation system and method for a vessel may comprise a hazard assessment element receiving alarms and/or data for assessing the type and severity of a hazard, a plurality of models for modeling different hazards, and a strategy formulation element for formulating a strategy of tasks for responding to the type and severity of hazard represented by the hazard assessment, wherein the strategy formulation element and one or ones of the plurality of models are in communication. Tasks may be communicated for implementation, for display or for implementation and display.

27 Claims, 25 Drawing Sheets

(56) References Cited

OTHER PUBLICATIONS

Capt. Richard A. Bihr, USN (Ret.), Automated Contingency Planning in Support of Shipboard Damage Control, Naval Engineers Journal, Sep. 1987, pp. 34-41.
Stanley Herman & Christopher T. Loeser, Damage Control—The Last Line of Shipboard Defense, Naval Engineers Journal, Jan. 1992, pp. 63-79.
David Geer, Advanced Damage Control System, Naval Engineers Journal, May 1988, pp. 143-153.
Jim Gagorik & Jeff Schafer, Ex-USS Shadwell Demonstration Test Plan for the Reduced Ship's crew by Virtual Presence (RSVP) Advanced Technology Demonstration (ATD) Program, Apr. 2001, 18 pages.
United States General Accounting Office, Report to Congressional Requesters, Military Personnel, Navy Actions Needed to Optimize Ship Crew Size and Reduce Total Ownership Costs, GAO-03-520, Jun. 2003, 59 pages.
Program Executive Office Ships, DDG 1000, Navy Designates Next-Generation Zumwalt Destroyer, Apr. 7, 2006, 9 pgs.
GlobalSecurity.org, DDG-1000 Zumwalt/DD(X) Multi-Mission Surface Combatant Future Surface Combatant, printed Jul. 20, 2006, 3 pages.
General Dynamics, Company Overview DDG 51 Arleigh Burke Class Program, printed Jul. 20, 2006, 3 pages.
The American Society of Naval Engineers, Building Ships Around Sailors—Building the Force Around Ships, Engineering the Total Ship Symposium 2004, Mar. 17-18, 2004, 6 pages.
Donald Dalessandro, Navy Transitions Key Survivable Technologies through the DD(X) Autonomic Fire Suppression System Engineering Development Model Tests, Wavelengths online, Mar. 9, 2005, 2 pgs.
The American Society of Naval Engineers—Delaware Valley Section, Engineer of the Year Mr. Donald D. Dalessandro, printed Jul. 20, 2006, 2 pgs.
DamageControl.tv, 2003 Damage Control/Firefighting,CBRD Working Group Central, Sep. 10-11, 2003, 2pgs.
Military Factory, DDS Destroyer, printed Jul. 20, 2006, 4 pgs.
Vadim Bulitko, Automated Instructor Assistant for Ship Damage Control, University of Alberta, Feb. 2005, 9pgs.
Janet Jaensch, Development of Power System Management Tool to Support Automated Damage Control for Shipboard Power Systems, printed Aug. 21, 2006, 2 pgs.
Navy Technology Center for Safety & Survivability, Damage Control Systems, printed Aug. 21, 2006, 3 pages.
Fairmount Automation, Engineering Services: Automated Damage Control System Development, printed Aug. 21, 2006, 5 pages.
L-3 MAPPS, Marine, Battle Damage Control System, printed Aug. 21, 2006, 2 pages.
Naval Research Laboratory, DC-ARM Marks the Wave of Future Damage Control, Mar. 25, 2002, 4 pages.

* cited by examiner

INTEGRATED SMART HAZARD ASSESSMENT AND RESPONSE PLANNING (SHARP) SYSTEM AND METHOD FOR A VESSEL

This Application claims the benefit of U.S. Provisional Patent Application No. 60/879,262 filed Jan. 8, 2007, which is hereby incorporated herein by reference in its entirety.

This invention was made with Government support under Contract No. N00024-05-C-5346 awarded by the Department of the Navy. The Government has certain rights in the invention.

The present invention relates to a hazard assessment and response system and method, in particular, to a damage hazard assessment and response system and method for a vessel.

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

Ships and other vessels are subject to various conditions and hazards such as weather, rough seas, fire, collision, mechanical failure, hazardous substances, intentional acts, attack, and the like that might damage or impair the vessel or a portion thereof, and/or that might even put the vessel and personnel on board at risk. Such conditions and hazards require rapid, accurate and effective responsive actions to prevent serious injury to personnel, damage to vessel systems, loss of the vessel's mission, or loss of the vessel. Traditionally, the damage control response for vessels has been a manpower intensive effort that requires large teams that might include, e.g., investigators, phone talkers (communicators), repair parties, leaders and supervisors, engineers, electricians, hose teams, boundary men, and the like. In many cases, the size of the vessel's crew had to be increased substantially in order to provide the number of personnel needed for the damage control organization.

One approach to responding to hazard conditions and damage control situations has been to provide technical systems that perform some of the functions traditionally provided by damage control personnel. For example, one technical approach for responding to a fire condition has been to provide a system having sensors that detect the presence of fire and/or smoke, and that report such conditions to the crew for crew response. Other more sophisticated fire detection systems may, in addition to detecting fire and/or smoke, control valves that release water or a non-combustible gas or other fire suppressant into the area (e.g., a compartment or hold) in which fire and/or smoke has been detected. Examples of such systems are described in U.S. Pat. No. 6,039,124 entitled "Electrical Detector Actuated Magazine Sprinkle (ADAMS) System," U.S. Pat. No. 6,170,425 entitled "Boat Hull Construction and Method of Making The Same," and in U.S. Pat. No. 6,741,174 entitled "Environment and Hazard Condition Monitoring System."

Another example of such technical system for alerting the crew to damage conditions includes temperature and smoke sensors, shock sensors, e.g., in the keel and certain terminal units, flooding sensors, and manual inputs. An example of such system is described in U.S. Pat. No. 5,349,644 entitled "Distributed Intelligence Engineering Casualty and Damage Control Management System Using an AC Power Line Carrier-Current LAN".

Another example of such technical system alerts the crew to flooding and vessel stability conditions includes a computerized compartment model of the vessel. The computerized system includes a stability assessment module which performs calculations for determination of post-damage conditions and stability parameters for the vessel, and a corrective strategy module which compares post-damage stability with pre-damage stability whereby either operator developed corrective strategy or system developed corrective strategy can be established for correcting the questionable stability of the vessel. The system responds to flooding sensors and can actuate valves and pumps for de-watering and flooding compartments. Examples of such systems are described in U.S. Pat. No. 4,549,267 entitled "Moment Stability System for Large Vessels" and in U.S. Pat. No. 4,872,118 entitled "System for Automated Monitoring of Trim and Stability of a Vessel."

While ones of these different types of technical systems may have been used or proposed to be used on the same vessel to provide technical assistance regarding plural hazard conditions, such known uses fail to consider that the various hazard conditions and the responses thereto may interact, and may interact in a way that is detrimental to the overall condition of the vessel. For example, a fire suppression system may release water into a compartment that is in a location where flooding may present a greater hazard to the stability of the vessel than does the fire in that compartment. In a further example, one system may cut off the flow of water in a pipe to stem a leak in the vessel's plumbing when the water is urgently needed to fight a fire.

Accordingly, there is a need for a damage control system that can monitor various hazard conditions, that can assess the vessel's condition in view of the various hazard conditions monitored, and that can respond to the various hazard conditions in a strategically appropriate manner considering the particular hazard conditions then present. In addition, it would be desirable if such damage control system were to operate in a selectable mode selected by a human operator, i.e. to respond automatically without human intervention, or to respond automatically if a human operator does not intervene, or to recommend responses to the human operator.

A hazard assessment and strategy formulation system and method for a vessel may comprise a hazard assessment element receiving alarms and/or data for assessing the type and severity of a hazard, a plurality of models for modeling and a strategy formulation element for formulating a strategy of tasks for responding to the type and severity of hazard represented by the hazard assessment, wherein the strategy formulation element and one or ones of the plurality of models are in communication. Tasks may be communicated for implementation, for display or for implementation and display.

BRIEF DESCRIPTION OF THE DRAWING

The detailed description of the preferred embodiment(s) will be more easily and better understood when read in conjunction with the FIGURES of the Drawing which include:

FIG. 8 includes FIGS. 8A-8D wherein

Figure 1:
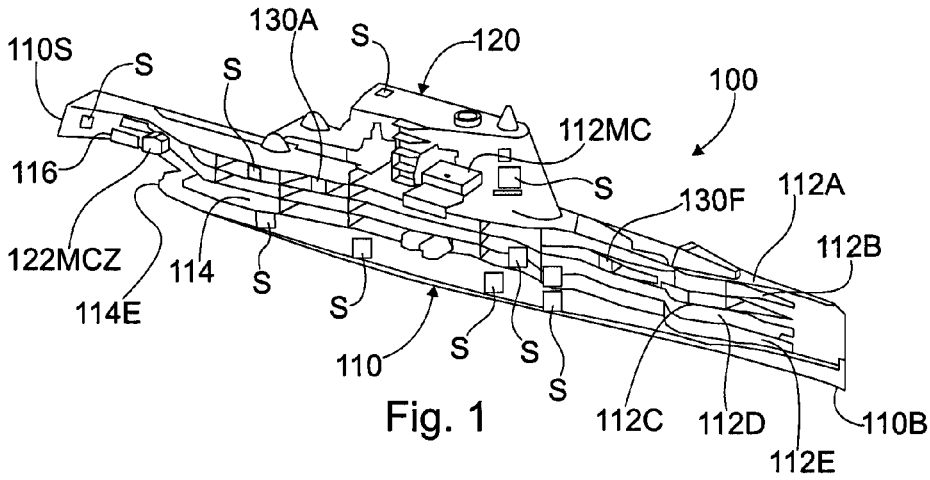
FIG. 1 is a schematic diagram of an example vessel illustrating various damage control features thereof.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. It is noted that, according to common practice, the various features of the drawing are not to scale, and the dimensions of the various features are arbitrarily expanded or reduced for clarity, and any value stated in any Figure is given by way of example only.

DESCRIPTION OF THE PREFERRED EMBODIMENT(S)

The present integrated vessel damage control arrangement receives hazard and condition inputs, e.g., from a variety of sensors and other data sources which are at various locations on the vessel. These data and/or alarms are processed, e.g., are fused and correlated, to provide an assessment of the total or combined damage or hazard situation for the vessel (the "situational assessment") which is then processed to provide a strategy ("strategy formulation") for responding to the total or combined damage control or hazard control situation, which may be presented to the human operator(s) as a visual representation of the hazard and/or damage situation (Integrated Casualty Plot" or "ICP"). For convenience, a list of selected terms and acronyms is set forth in Appendix A below.

The foregoing is performed on an integrated basis using, e.g., data fusion and/or other techniques, so that interdependent conditions and interactions among possible responses are considered together to produce an integrated damage and condition assessment (ICP) and to formulate an integrated damage control and hazard control response (a response "strategy') that increases the probability of providing an optimum or near optimum response to the actual damage or hazard condition. Hazard, damage and casualty data is provided by various sensors, by computer databases, and by manual inputs from crew. Information in the computer databases may be maintained and updated automatically (e.g., by various sensors and by information from other vessel systems) and/or by manual inputs. The present damage assessment and control arrangement desirably seeks to provide timely, appropriate, effective and safe response strategies that can be executed automatically or with crew (manual) involvement, to mitigate and/or minimize the effect of hazards and damage on the ability of vessel 100 to survive and carry out its mission. Further, it is desired that this be accomplished while permitting reduction of the number of assigned damage control crew.

An example embodiment of the present arrangement considers data inputs from sensors, operator inputs, crew inputs, on-site situation reports, vessel configuration data, and the like in relation to a plurality of different damage and hazard conditions including, for example:

1. Fire—Fire may be detected by heat sensors, flame sensors, combustion sensors, and/or video imagers or other cameras that may be located in various compartments, passageways, holds, and other locations on the vessel, as well as by reports thereof by human crew members.
2. Smoke—Smoke may be detected by particulate sensors, smoke sensors, smoke density sensors, optical sensors, and/or video imagers or other cameras that may be located in various compartments, passageways, holds, and other locations on the vessel, as well as by reports thereof by human crew members.
3. Flooding—Flooding may be detected by water sensors, pressure sensors, and/or video imagers or other cameras, that may be located in various compartments, passageways, holds, and other locations on the vessel, as well as by reports thereof by human crew members and by other techniques, such as by optical image identification.
4. Hull Stress—Hull stress relates to the structural integrity of the vessel's hull including the girders and plates thereof, and hull related data may be provided by fiber optic sensors, strain gauges, video imagers and/or other cameras that may be located in various compartments, passageways, holds, and other locations on the vessel, as well as by reports thereof by human crew members.
5. Stability—Stability relates to the ability of the vessel to sail, maneuver, and perform its mission given its actual condition including damage, wet and dry loading, and the effects of various weather and sea conditions. Vessel configuration and loadings, both wet and dry, may be manually input, as may sea and weather conditions. Radar and/or other sensors may be employed to provide wave and other sea state information and navigation gyroscopes may be employed to provide static and dynamic vessel stability data, such as list, trim, pitch, roll, yaw and the like. Sensors may be employed to provide draft information. Flooding and hull stress data may be provided from the Flooding and Hull Stress sources.

6. Industrial and hazardous gases—Chemical gases, flammable gases, solvents and fumes, including carbon monoxide (CO), from shops, vessel equipment and vessel operations may also present hazards, and may be detected by gas sensors and other sensors located in shops, work areas, equipment areas and other locations on the vessel.
7. Chemical contamination—Chemical contamination relates to the presence of chemical substances and agents whether airborne or on a surface, most commonly from an external source, and chemical contamination data may be provided by chemical agent detection sensors that may be located in various external locations of the vessel, as well as in compartments, passageways, holds, and other locations thereof, as well as by reports thereof by human crew members.
8. Biological Contamination—Biological contamination relates to the presence of biological substances and agents whether airborne or on a surface, most commonly from an external source, and biological contamination data may be provided by biological agent detection sensors that may be located in various external locations of the vessel, as well as in compartments, passageways, holds, and other locations thereof, as well as by reports thereof by human crew members.
9. Radiological Contamination—Radiological contamination relates to the presence of radioactive substances and agents whether airborne or on a surface, most commonly from an external source, and radiation contamination data may be provided by radiation counters and/or other radiological agent detection sensors that may be located in various external locations of the vessel, as well as in compartments, passageways, holds, and other locations thereof, as well as by reports thereof by human crew members.

Chemical, biological and radiological (radiation) contamination and agents are commonly referred to as "CBR" contamination and "CBR" agents.

The present arrangement preferably provides such damage control response in a selected one of plural operator-selectable operating modes providing different levels of automation, including:

1. Autonomous Mode—In the autonomous mode, the integrated damage control system determines the nature and extent of a damage and/or casualty and/or hazard event, provides an assessment thereof, identifies the most effective corrective action to employ, and implements (executes) the corrective action without intervention of a human operator.
2. Operator Override Mode—In the operator override mode, the integrated damage control system determines the nature and extent of a damage and/or casualty and/or hazard event, provides an assessment thereof, identifies the most effective corrective action to employ, and presents the proposed corrective action to a human operator for override or authorization. If the operator does not override or authorize the presented corrective action within a predetermined time, then the integrated damage control system implements (executes) the proposed corrective action without intervention by a human operator. The predetermined time may be relatively shorter for hazards/damage that have a higher severity classification and may be relatively longer for hazards/damage that have a lower severity classification.
3. Operator Support Mode—In the operator support mode, the integrated damage control system determines the nature and extent of a damage and/or casualty and/or hazard event, provides an assessment thereof, identifies the most effective corrective action to employ, and presents the assessment and proposed corrective action to a human operator for override or authorization. The operator must authorize the presented proposed corrective action in order for the system or crew to implement (execute) the corrective action.

It is noted that in each of the preceding operating modes, the corrective action may comprise one or more specific actions to be taken (tasks to be done), and further, in the operator override mode and in the operator support mode, the operator may override or authorize any one or more of the specific actions presented by the integrated damage control system, and, optionally and additionally, the operator may develop and authorize other actions. The operating mode may also be referred to as an automation mode.

Each operator may select an automation mode for each system (e.g., fire suppression, sprinkling, ventilation, flooding, de-watering) and for each compartment or coverage area of the vessel, independently of the automation mode selection for any other system and for any other compartment or coverage area (to the extent the vessel's equipment and systems provide for such level of control), and independently of the selections of any other operator. Alternatively, the operator may select the same automation mode or may select a set of default automation modes (which are selectable for a given vessel) for all systems and/or all compartments and coverage areas. Thus, each operator has complete freedom to tailor the selected automation modes for specific conditions, areas, and preferences, as may be necessary, appropriate and/or desirable at any given time or in any given circumstance.

Further, and irrespective of the operating mode, the operator is presented with, e.g., by a computer generated display, a comprehensive integrated report of the hazard and/or damage assessment and the strategy formulated to respond thereto. Such data and reports are typically also communicated among and between various vessel systems, e.g., by electronic message or other automated communication, to facilitate automated response actions and operator authorized actions.

An example embodiment of the present arrangement develops one or more strategies for addressing assessed conditions and provides responses to the assessed conditions for implementation under the selected automation mode, including, for example:

1. Fire—Responses to fire may include the release of fire suppressing gas, water mist or spray, fire suppressant spray, sealing of compartments and/or areas, and the like, as well as responses by human crew members.
2. Smoke—Responses to smoke may include activating exhaust fans and systems, ventilating compartments and/or areas, sealing compartments and/or areas, and the like, activating smoke ejection systems, as well as responses by human crew members, such as installing smoke curtains, installing portable fans, and the like.
3. Flooding—Responses to flooding may include activating pumps, opening and/or closing valves, de-watering operations, sealing compartments and/or areas, and the like, as well as responses by human crew members.

4. Hull Stress—Responses to hull stress issues may include providing operational and navigational limits to the crew, activating pumps, opening and/or closing valves, moving, removing and/or redistributing wet and dry loads, sealing compartments and/or areas, and the like, as well as responses by human crew members, such as repair teams, e.g., to shore damaged hull sections, cut holes in bulkheads, set up portable pumps, and the like.
5. Stability—Responses to stability issues may include providing operational and navigational limits to the crew, activating pumps, opening and/or closing valves, moving, removing and/or redistributing wet and dry loads, sealing compartments and/or areas, and the like, as well as responses by human crew members.
6. Industrial and hazardous gases—Responses to industrial and hazardous gases may be include activating exhaust fans and systems, activating pumps, opening and/or closing valves, ventilating, sealing compartments and/or areas, and the like, as well as responses by human crew members.
7. Chemical, Biological and Radiological contamination—Responses to CBR issues may include closing external vents and intakes, maneuvering, activating exhaust fans and systems, opening and/or closing valves, ventilating, sealing compartments and/or areas, and the like, as well as responses by human crew members.

FIG. 1 is a cut-away schematic diagram of an example vessel 100 illustrating various features thereof including damage control features. Vessel 100 comprises a hull 110 having a plurality of decks 112A, 112B, 112C, 112D, 112E, and so forth, and having a superstructure 120 extending upward from hull 110. Hull 110 typically has a bow 110B shaped to part the water as vessel 100 moves forward, such as a wave piercing bow, and has a stern 110S near which are provided a propulsion space 114, an external propulsion device 114E and a directional control device 116. External propulsion device 114E may comprise, e.g., one or more screws, and directional control device 114 may comprise, e.g., one or more rudders, it being understood that the functions of propulsion device 114E and directional control device 116 maybe combined, e.g., as in a "Z drive" comprising one or more screws mounted horizontally at the lower end of a rotatable vertical drive shaft. A propulsion space 114, e.g., an engine room," is typically located in the lower aft portion of hull 110.

A vessel mission center 122MC is typically provided in superstructure 120, and a secondary or back up mission center 122MC-2 may be provided in a less exposed location, e.g., in the aft section of hull 110, for monitoring and controlling all of the operations associated with the mission of vessel 100. Mission center 122MC is preferably proximate to the operating center of vessel 100, typically referred to as the "bridge," but provides more than the navigation, steering and sailing functions normally associated with the "bridge."

Hull 110 is typically divided into various compartments (also sometimes referred to as spaces), many of which are on one of the plural decks 110A-110E, although a compartment may extend vertically through more than one deck, e.g., in the case of an elevator shaft, stairway, magazine or a missile storage and/or launch tube. Most compartments are individually sealable so as to be water tight, particularly those that are at or below the waterline.

Damage and hazard sensors S may be located anywhere on vessel 100, such as in any of the compartments of hull 110 and superstructure 120, and/or on any external or internal surface of vessel 100. Typically, sensors are provided at least in compartments and areas where a hazard might be expected. Thus, fire and/or smoke sensors/detectors S and explosive gas sensors S may be provided in compartments where combustibles may be expected to be stored or used, such as in and near fuel storage tanks, engine rooms, shops, galleys, magazines, weapon storage spaces, and the like. Flooding sensors/detectors S may be provided in compartments close to the external surfaces of the hull, in compartments and spaces through which piping runs, and the like. CO and other hazardous gas sensors S may be provided in various machinery spaces where there is a potential for CO or other gas emission and in manned spaces. CBR sensors S may be provided on external surfaces of hull 110 and superstructure 120, on interior surfaces, as well as in air and water intakes, on masts and/or poles, and the like.

Damage control responses maybe effected from one or more damage control stations 130, such as forward repair station 130F and aft repair station 130A, and damage control teams, e.g., repair teams, may be stationed at one or more locations throughout hull 110 and superstructure 120. One advantage that may be obtained with the damage assessment and control arrangement described herein is that because sensors distributed throughout the vessel sense and report specific hazards and conditions, a hazard and/or damage assessment may be made without having to send human damage control personnel so assess and report hazards and/or damage conditions, thereby reducing the staffing necessary to provide damage assessment and control and reducing the exposure of human personnel to hazardous conditions. In addition, because the damage assessment and control arrangement described herein also has the capability to initiate responses to hazards and damage conditions, fewer personnel are needed to staff a damage control organization for the vessel.

Figure 2:
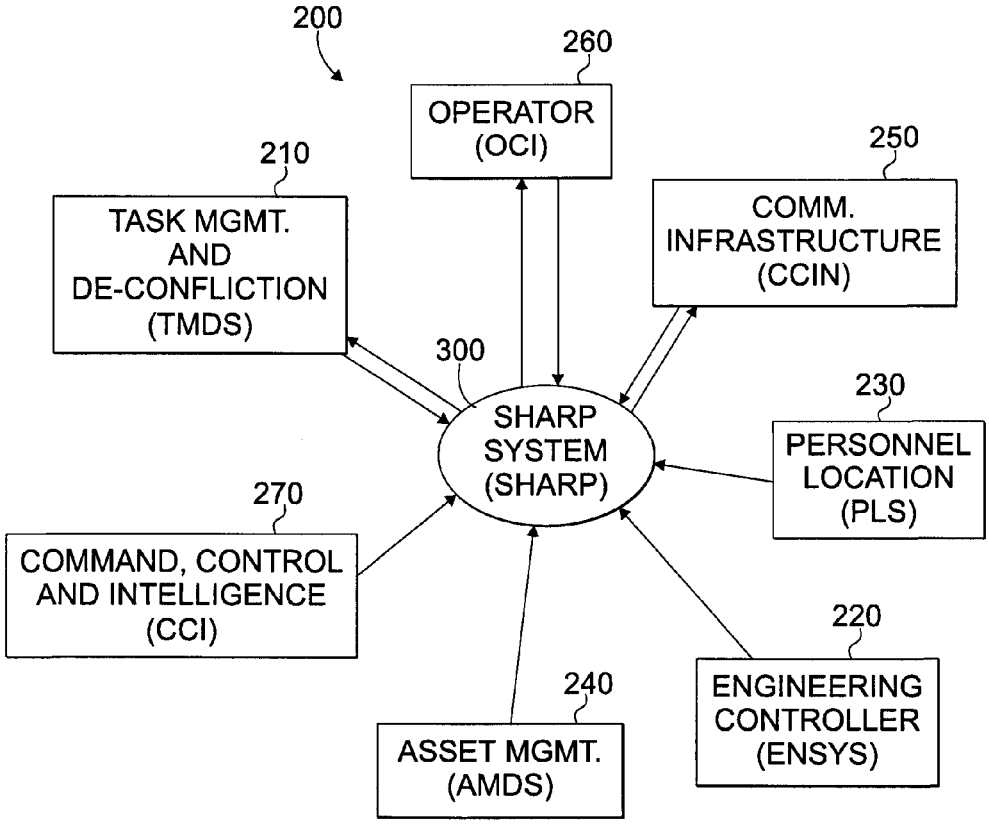
FIG. 2 is a schematic block diagram of an example embodiment of a vessel system including a damage control system.

FIG. 2 is a schematic block diagram of an example embodiment of a vessel system 200 including a smart hazard assessment and response planning (SHARP) system 300 according to the present arrangement. SHARP system 300 receives hazard and damage sensor and detector data from other vessel systems, processes those data to assess the hazard and/or damage situation, provides an assessment of the situation to the human operator (e.g., via a computer resource and/or display system), formulates strategies for responding to the sensed hazard and/or damage, and implements and/or presents the formulated strategies to a human operator, as will be described in detail below. SHARP system 300 performs the foregoing with various levels of automation and operator involvement in accordance with the described operator selectable modes, and also reports its assessments and strategies to other systems and to the human crew, for execution.

SHARP system 300 provides situational awareness to the crew, e.g., regarding hazards, damage and casualties, and provides effective, timely and appropriate response actions to respond to hazard and/or damage conditions, e.g., damage control, with levels (modes) of automation that are selectable at any time by the crew/operator. Different levels of automation are selectable independently for various functions of SHARP system 300, so that an operator may allow certain types of hazards to be assessed and responded to by SHARP system 300 automatically, while supervising or controlling response to other types of hazard. Preferably, SHARP system 300 is operating whenever vessel 100 is sailing or preparing to sail, e.g., whenever vessel 100 is in motion or is transitioning to or from an "at sea" operating state, as well as at pier side.

An advantage of SHARP system 300 is that as a result of its automation capability to assess hazards and/or damage conditions and to formulate a strategy to respond to hazard and/or damage conditions, vessel 100 may be operated with a reduced level of damage control personnel while maintaining a capability to handle survivable hazard and damage effects and continue the vessel's mission, at least until personnel become available to make permanent and final repairs. The operator, e.g., a damage control officer or chief, is presented with an integrated comprehensive casualty picture (ICP) (e.g., via a display system such as OCI 260) without having to consider all of the detailed hazard, damage and casualty data upon which the ICP is based, thereby reducing operator information overload and the need for the operator to analyze the data and develop a damage control response strategy.

Desirably, the ICP presents the hazard/damage assessment and response strategy in a manner that facilitates understanding, whether SHARP system 300 is operated in the autonomous mode or in the operator override or operator support modes which involve the operator. However, if the operator requests, detailed hazard, damage and casualty data may be displayed.

Example vessel system 200 includes a task management and de-conflicting system (TMDS) 210, an engineering system controller (ENSYS) 220, a personnel locator and management system (PLMS) 230, an asset management and distribution system (AMDS) 240, a computing and communication infrastructure (CCIN) 250, an operator-computer interface (OCI) 260, a command, control and intelligence element 270, and a smart hazard assessment and response planning (SHARP system) 300 according to the arrangement described herein. Each of the foregoing elements are interconnected and in communication with each other via a vessel computing environment (CCIN) 250, e.g., a LAN or other network, to provide an operational vessel system 200. Various ones thereof may be referred to as elements, components, systems and the like which may be nomenclature representative of a level or hierarchy or organization in system 200 that does not necessarily indicate greater or lesser functionality.

Example vessel system 200 includes a task management and de-conflicting system (TMDS) 210 that provides the monitoring, controlling and integrating capabilities for controlling the vessel, e.g., for the engineering system controller (ENSYS) of vessel 100, 200. TMDS 210 receives tasks from various systems of vessel 100, 200, such as command, control and intelligence (CCI) element 270, OCI 260 and integrated bridge (INB) component, and creates specific directives to carry out the tasks. TMDS 210 prioritizes the specific directives, detects and removes conflicts, e.g., "de-conflicts," between and among tasking directives creates task and resource allocation schedules and manages their execution for operating vessel system 200. TMDS 210 communicates to SHARP system 300 the vessel control system (SCS) status, damage control (DC) task status, sea state data including wave height, modal period and wave direction, and external CBR alerts and information, as may be provided by the CCI element. SHARP system 300 generates and communicates to TMDS 210 SHARP system status information, damage control tasks to be implemented, recommended maneuver restrictions, damage summary reports and stability assessment reports. Recommended maneuver restrictions may be based on current damage conditions, and preferably take into account vessel stability, flooding, sea state, wind and other conditions. Sea state data including wave height, modal period and wave direction may be provided by one or more sensors, such as a dual band radar or other radar, either directly or via another system.

Example vessel system 200 includes an engineering system controller (ENSYS) 220 that includes the physical engineering systems necessary for vessel operation, such as propulsion, direction control, power generation and distribution, ventilation, heating and air conditioning, and the like. Among those systems are the hull, mechanical and electrical (HM&E) equipment of vessel 100, 200. The sensors and detectors for hazards and damage conditions may be provided by ENSYS controller 220 in example vessel 100, 200, for sending hazard sensor alerts and alarms, and stability related sensor data to the SHARP system 300. ENSYS controller 220 monitors signal data from various sensors, e.g., for operability and functionality, and executes system tasks to be implemented by apparatus and equipment that is considered part of ENSYS controller 220. ENSYS controller 220 communicates to SHARP system 300 hull, mechanical and electrical (HM&E) sensor data, hazard sensor data, door and hatch status (e.g., open/closed) data, and other data related to the hull, mechanical and electrical parts of vessel 100. Preferably, on modern automated vessels, ENSYS controller 220 monitors and controls HM&E equipment in operational situations with a minimum of human intervention.

Example vessel system 200 includes s personnel locator and management system (PLMS) 230 that maintains crew location, health, leave and qualification information that it communicates to SHARP system 300, ENSYS controller 220, and other elements, if needed. PLMS (or PLS) 230 typically maintains such information for each crew member in a database on CCIN 250, and such information may be provided by manual entry, other vessel systems, and/or tracking devices. Optionally, vessel system 200 may include a personnel locator service or system (PLS) that tracks the location and movement of each crew member using transponders (e.g., using key stations, swipe cards, RFID devices, and/or another tracking device) worn by the crew members that are interrogated by transponders located in various compartments, passage ways and other spaces of vessel 100. Crew location and availability data is communicated to SHARP system 300 for use in assessing the effect of particular damage and hazard conditions on crew and/or for monitoring, directing and controlling the damage control crew in providing human responses to various damage and/or hazard conditions.

Example vessel system 200 includes an asset management and distribution service (AMDS) 240 that maintains and provides information regarding the nominal configuration and condition of vessel 100, 200. For example, such information relating to the vessel's assets typically includes dry load information (i.e. the estimated quantities, weights and locations of cargo, supplies, non-liquid consumables, apparatus, equipment, and the like), and may also include wet load information (i.e. the weights and locations of fuel, ballast, potable water, grey water, other liquid and tankage items, and the like). Locations of dry loads are defined in three dimensions relative to reference points of vessel 100, e.g., by specifying a compartment or space whose location is itself defined related data stored in and available from CCIN 250 (see below), or by frame member and deck and/or distance port or starboard from the vessel's centerline, or by similarly defining the location.

Example vessel system 200 also includes a computing and communication infrastructure (CCIN) 250 that provides the software (e.g., operating systems, databases, applications software) and hardware infrastructure (e.g., processors, storage devices, communications) to support essential and nonessential vessel 100, 200 functions and applications, including data communications between and among the various systems and elements 210-260, 300 of vessel 100, 200, such as via a LAN, Ethernet or other network. CCIN 250 typically stores information and data in various databases that it maintains and manages, and such data is received from and communicated to various systems and elements of vessel 100, 200, including SHARP system 300.

For example, a database of vessel configuration data that defines the configuration and arrangement of the physical plant of the vessel, including the hull and superstructure, and the locations (in three dimensions) of each compartment and space thereof relative to defined reference points of the vessel, e.g., the keel, bow, stern, center of gravity, and the like, is maintained, e.g., in CCIN 250 and/or in another database, memory and/or storage device. CCIN 250 may also maintain data relating to and/or provided by various sensors, hull stress data, SCS status and configuration data, vessel stability data, personnel location and health data, damage control crew and equipment location and status data, crew entry and swipe logs, intrusion logs, bell/deck logs, data logs, engineering logs, operational logs and the like, e.g., typically in respective databases. CCIN 250 monitors and logs the start up, shut down and status of other systems and elements of vessel system 200, and the equipment comprising CCIN 250 is typically distributed over vessel 100 for efficiency, redundancy and reducing susceptibility to loss of function due to damage in a localized area.

CCIN 250 communicates to SHARP system 300 tactical navigation data, time information, ENSYS controller 220 start, terminate and health monitoring information for various vessel systems and software, and static vessel configuration data, and SHARP system 300 communicates to CCIN 250 a SHARP system hazard log, crew casualty data, the SHARP system automation mode, and SHARP system parameters and data to be displayed, e.g., to damage control, command and other personnel.

Information databases of CCIN 250 may include, e.g., data collected from sensors, hull stress data, stability data, control system configuration data, personnel location and health/availability data, DC crew and equipment, location and status data, crew entry and swipe logs, intrusion log, bell log, data and engineering (e.g., HM&S) logs, vessel operational parameters, and the like, plus configuration, start-up and shutdown data for various systems including SHARP system 300.

Example vessel system 200 also includes a operator-computer interface infrastructure (OCI) 260 that provides the operator interfaces for communicating with an operator, e.g., displays, audible announcements, printed information, and the like, for providing information to an operator and, e.g., touch screens, keyboards, switches and buttons, microphones, and the like, for receiving information from an operator, for SHARP system 300 as well as for other systems 210-260 of vessel system 200. OCI 260 communicates to SHARP system 300 manually input data, e.g., casualty data, load inventory data, operator requests (e.g., by the DC operator), operator commands to set the automation mode of SHARP system 300, and CBR alert data. Damage control equipment inventory may be provided by CCIN 250 and/or may be provided via OCI 260. SHARP system 300 communicates to OCI 260 for display or other communication to a human operator hazard assessment data and crew casualty assessment data.

Example vessel system 200 system 200 also may also include a command, control and intelligence element (CCI) 270 that provides data and information relating to impending and actual hazards associated with chemical, biological and/or radiological hazards. Typically such data and information might be provided by sensors located on external surfaces or structures of vessel 100 that sense actual chemical, biological and/or radiological hazards, by sensors of vessel 100 that sense actual chemical, biological and/or radiological hazards while they are still remote from vessel 100, or might originate with information provided by other vessels in the vicinity of vessel 100 either by communication of information to SHARP system 300 or to crew of vessel 100 for manual input.

For SHARP system 300, e.g., when in the operator override mode or in the operator support mode, or when an operator input is required, OCI 260 provides status and other information such as system status, task notifications, task options for review and selection, confirmation of crew task completions, fault and alarm notifications, e.g., for equipment failures, hazards, damage events, tasking conflicts, for operator inputs needed to perform or complete a task. OCI 260 also receives and communicates to SHARP system 300 via CCIN 250 operator inputs, e.g., to manually input hazard, damage and/or casualty information, to authorize or override a task recommendation, to change the automation mode of SHARP system 300. OCI 260 provides to the DC operator for review those DC tasks that require configuration and/or allocation of resources (such as providing electrical power for pumps and ventilators, opening and closing valves and dampers, providing fresh and/or sea water), reconfiguration and/or reallocation of such resources, and confirmation and/or override of resource utilization decisions.

For example, OCI 260 may display information provided by SHARP system 300 which may include an integrated casualty plot (ICP), safe routing recommendations for the crew, a crew casualty assessment summary, and the like. Further, OCI 260 may receive manual inputs from the crew/operator for selecting automation modes, operator requests, operator overrides, and may also receive manual inputs relating to confirmation of crew casualty data, fire, flooding and hull girder casualty (e.g., damage data to supplement sensor indications and manual confirmations), door/hatch closure (when closure sensor data is unavailable or sensors are not functioning), tank levels (e.g., when tank level sensors are not functioning), dry load data (e.g., for dry loads not tracked in the AMDS database), sea state data estimates (e.g., when sea sensing radar is unavailable or is not operating), and the like. Optionally, information comprising a summary of the execution of casualty response tasks may also be provided. Optionally, crew location data may be provided via PLMS 230 or manual input, e.g., when PLS does not provide such data.

Optionally, and preferably, sensors that are provided for operation of various vessel systems, e.g., sensors that are part of HM&E, may in addition be utilized as sensors of conditions that define a hazard and/or damage for damage assessment and control purposes. Similarly, controls and software that are necessary and provided for vessel operation, e.g., hardware such as valves and pumps, and control software therefor, may also be employed for effecting damage control responses. In addition, the data processing and display resources of CCIN 250 and OCI 260 are provided for vessel operation, and are also utilized for running the damage assessment and control software of SHARP system 300 and for displaying and/or implementing responses and other outputs therefrom and for receiving inputs therefor. Thus, operation and functionality of SHARP system 300 is intertwined with operation of other vessel elements, such as TMDS 210 and ENSYS controller 220.

Figure 3:
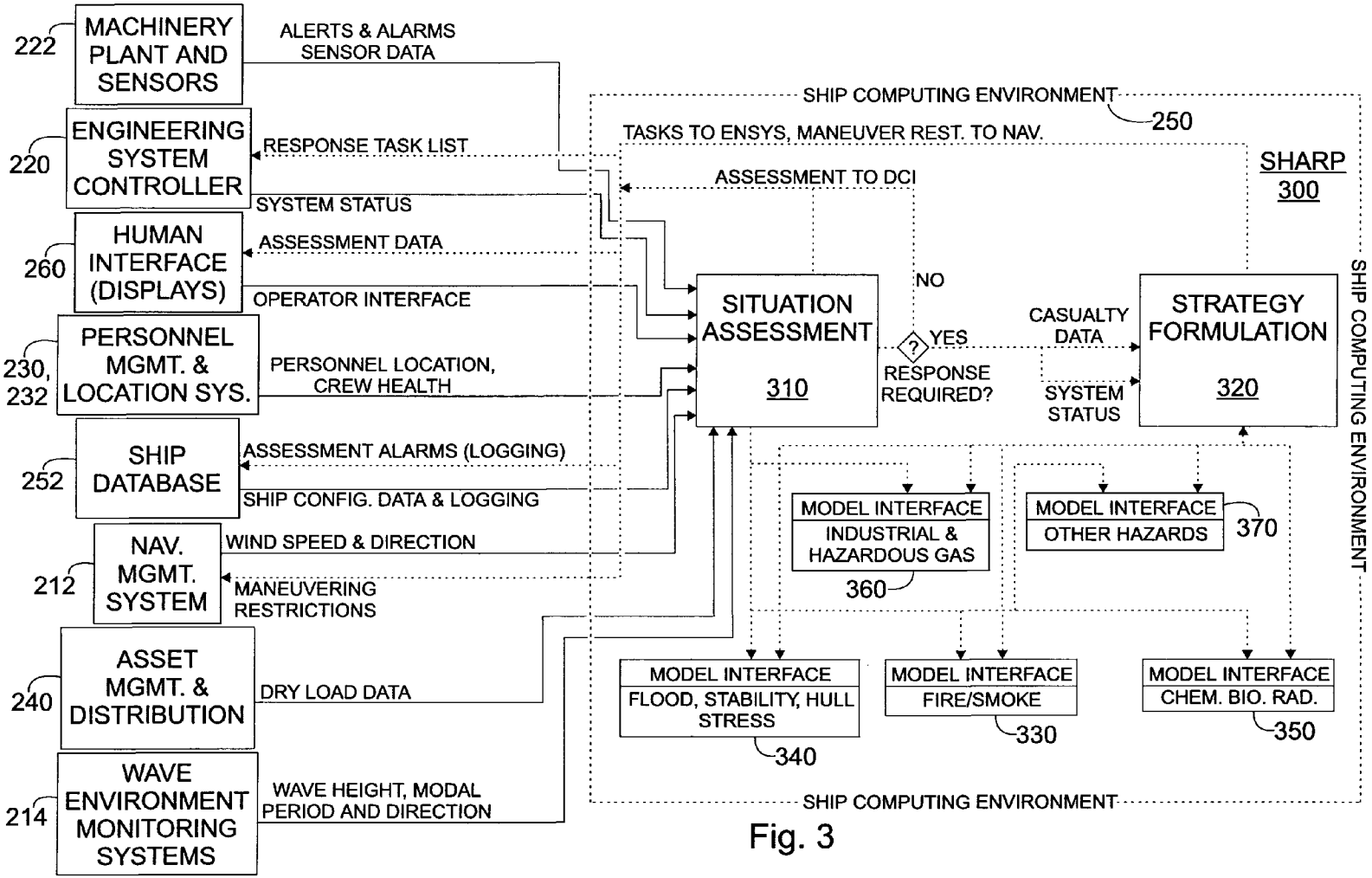
FIG. 3 is a schematic block diagram of an example embodiment of a damage control arrangement useful in the examples of FIGS. 1 and 2.

FIG. 3 is a schematic block diagram of an example embodiment of a damage control arrangement 300 useful in the examples of FIGS. 1 and 2. Damage control arrangement 300, sometimes referred to as a damage decision and assessment arrangement 300 or as smart hazard assessment and response planning (SHARP) software 300, comprises two primary elements or modules, namely a situation assessment module (MSAT) 310 and a strategy formulation module (MSGF) 320. SHARP system 300 also comprises one or more "models" for evaluating how different hazards and damage conditions affect the vessel 100. Preferably, each of models 330-370 is an independently operable software model that interfaces with MSAT 310 and MSGF 320 via a respective model interface that can easily be adapted so as to render any of models 330-370 to be easily replaceable, e.g., by upgraded, revised, improved and/or completely different models, without necessitating any modification, or at most an insignificant modification, to MSAT 310 and/or MSGF 320, thereby making SHARP system 300 easily adaptable to new and different modeling approaches as might be applicable to different types and kinds of vessels. SHARP system 300 including MSAT 310, MSGF 320 and models 330-370 all operate in the vessel computing environment, e.g., that provided by CCIN 250.

For example: Fire and smoke ensemble 330 provides a model that evaluates the near time and future time combined effects of fire, smoke and temperature conditions. Flood, stability and hull stress ensemble 340 provides a model that evaluates the near time and future time combined effects of flooding, hull damage and other structural damage on the stability and sea worthiness of vessel 100. MSGF 320 and ensemble 340 considers wind, wave and sea state conditions and advises the operating crew of operating, maneuvering and stability limitations and/or recommendations that should be followed to reduce the probability of capsize, broaching or surf-riding by the hull 110. CBR ensemble 350 provides a model that evaluates the near time and future time combined effects of chemical, biological and radiological contamination and agents on vessel 100, industrial and hazardous gas ensemble 360 provides a model that evaluates the near time and future time combined effects of industrial and hazardous gas conditions, and ensemble 370 provides a model that evaluates the near time and future time combined effects of other conditions. Models 330-370 are thus evaluative in that they evaluate the present condition and are predictive in that they estimate condition at a future time.

Alternatively, and optionally, each of models 330-370 may be a scenario-based model, a physics-based model, a real-time model, a decision-tree model, a doctrine-based model, a rules-based model, a cellular automation model, or any other type of model as may be appropriate to model a particular hazard.

It is noted that any combination of models 330-370 may be employed on a given vessel. For example, a passenger vessel would be unlikely to need CBR ensemble 350 whereas a naval vessel might be likely to have same, or a cargo or working vessel might be more likely to utilize an industrial and hazardous gas ensemble 360 than would a passenger vessel. The present arrangement advantageously allows for appropriate hazard/damage modeling software to be utilized easily and conveniently in a wide variety of different types and kinds of vessels, without necessitating a specialized damage assessment and decision arrangement for each different instance. Models 330-360 communicate with MSAT 310 and MSGF 320 via a SHARP system 300 model interface that adapts data transmission from SHARP system 300 to models 330-370 into data forms and formats that are compatible with models 330-370 and that adapts data transmissions from models 330-370 to SHARP system 300 into data forms and formats that are compatible with SHARP system 300.

Situation assessment module MSAT 310 receives alerts, alarms and sensor data from the machinery, plant and sensors that are part of ENSYS controller 220, receives vessel system status from ENSYS controller 220, receives inputs, data and crew commands from the operator-computer interface (e.g., displays) of OCI 260, receives personnel location from the personnel locator system 232 of PLMS 230 and personnel availability and health information from PLMS 230, receives vessel configuration data and logged changes thereto from the vessel database 252 of CCIN 250, receives wind speed and direction data and vessel speed and heading data from the navigation service of TMDS 210, receives vessel dry load data from AMDS 240, and receives wave height, modal period and direction data from the wave environment monitoring system of TMDS 210.

Various hazard sensors and/or detectors included in ENSYS controller 220, and the hazard alarms and data that they may provide to MSAT 310, may include, e.g., combination heat and smoke sensors (smoke alarm, high temperature alarm, combination heat/smoke alarm, alarm location, current temperature), smoke aspiration sensors (smoke alarm, alarm location), IR optical flame detectors (flame alarm, alarm location), explosive gas sensors (explosive gas high concentration alarm, explosive gas concentration, alarm location), heat detector (high temperature alarm, current temperature, alarm location), thermocouple (high temperature alarm, current temperature, alarm location), high temperature sensors (high temperature alarm, current temperature, alarm location), flooding sensors (flood alarm, flood level, alarm location), collective protection system (CPS) pressure sensors (low pressure alarm, current pressure, alarm location), point detection CBR sensors, stand-off detection CBR sensors, interior detection CBR sensors, and the like. Non-hazardous sensors and/or detectors included in ENSYS controller 220, and the data they may provide to MSAT 310, may include, e.g., tank level indicators (liquid level, tank location), door/hatch closure sensors (open/closed indication, door dogged/un-dogged indication, door/hatch designation), and the like. In addition, one or more vessel draft sensors may be provided, and where plural vessel draft sensors are provided, list, trim, roll and/or pitch may optionally be determined therefrom, either as a primary or a back-up source of such data.

System status information provided to MSAT 310 may include, e.g., status designations such as available or unavailable, operational or non-operational, and active or inactive, for each covered system, sensor, equipment, compartment, tank, space, passage and/or coverage area for each system. Systems monitored may include, e.g., high pressure water mist, medium pressure water mist, PDA cooling, aqueous film forming foam (AFFF), sprinkling, counter measure wash down (CMWD), telerobotic fire nozzles, flight deck or other deck sprinkling, magazine sprinkling, inert gas fire suppression, space de-watering, ballast and de-ballast, fuel fill and transfer, grey water fill and transfer, collective protection system, space de-smoking, space ventilation, smoke ejection, water-tight hatch status, gas-tight hatch status, and the like. A collective protection system provides, e.g., positive pressurization of certain compartments and spaces so that smoke and gasses do not enter such compartments and spaces, and such system may share fans and ventilators with a smoke ejection system or other de-smoking system. MSAT 310 may also receive from TMDS 210 portable damage control equipment inventory data, alerts of rejection of SHARP system 300 recommended tasks due to conflict with other tasks and/or manual override, and execution status of recommended tasks. Automated space de-smoking may be provided by an automated smoke ejection system.

MSAT 310 processes the foregoing received data to assess the alert, alarm and sensor data, to assess the stability condition of the vessel, to determine the status, extent and classification of casualties of the vessel's crew, to provide an integrated situational assessment based upon all of the alarms, alerts, sensor data and other data available at a given time, and to report (provide) notifications to the crew and engineering plant of ENSYS controller 220 of the nature and extent and classification of the hazard and/or damage situation then existing. Such notification typically includes the results of the hazard/damage situation assessment, and is displayed by OCI 260, e.g., to the crew. Optionally, notification may indicate to the crew whether or not a response by the crew is required.

If the situation assessed by MSAT 310 requires a response, then system status information, casualty data and the assessment of the hazard/damage situation is communicated to the strategy formulation module MSGF 320 for formulation of a damage control response strategy. In either case, the assessment of the hazard/damage situation is reported to the crew when it is produced, and a notification that a hazard/damage assessment is being undertaken is reported to the crew upon receipt by MSAT 310 of an alarm, an alert, sensor data or other data indicating that a hazard may exist or that damage may have occurred.

The situation assessment data produced by MSAT 310, including casualty data, is communicated to strategy formulation module MSGF 320 which processes such data to generate a specific response or responses to be undertaken to respond to the hazard and/or damage. Specifically, MSGF 320 identifies an integrated set of tasks, including both manual tasks and automated response tasks, to be executed to respond to the hazard or damage condition, identifies t a priority and timing for each task, and notifies the crew (for monitoring and for manual responses) and the engineering plant (for automated responses) of ENSYS controller 220 thereof. These communications typically include a task list of manual and HM&E tasks that is communicated to the engineering system controller of ENSYS controller 220 along with task permission requests (where necessary) sent to ENSYS controller 220 and maneuvering restrictions sent to navigation system 212.

Specifically, the response task list is communicated to TMDS 210 for de-confliction and, after de-confliction, to the systems and personnel responsible for executing the tasks. For example, task information may be communicated to engineering system controller 220, assessment data is communicated to operator-computer interface (displays) 260, assessment alarms are sent to the vessel database 252 of CCIN 250 for being logged in a database thereof, and maneuvering restrictions are communicated to navigation service 212 for use by vessel operating personnel.

In formulating a damage control response strategy, MSGF 320 communicates interactively with appropriate ones of vessel models 330-370 which process the data communicated by MSGF 320 as described below. Models 330-370 typically comprise a database relating hazard and/or damage conditions to responses, physics-based and/or other models, and/or a combination thereof, that receive data representing a present situation and/or condition and predict forward in time how, how fast, when and to where such situation and/or condition will or will not spread or otherwise develop and/or change, and/or lead to other hazards and/or conditions. For example, a hull structural failure not only affects the stress on other hull components which can affect vessel stability and maneuvering ability, but also can introduce present and possibly additional flooding which can further affect vessel stability and maneuvering ability. Further, a fire condition can also affect vessel stability and maneuvering ability, e.g., through heat-induced reduction of the structural strength of the hull and/or from flooding resulting from fire fighting responses.

SHARP system 300 provides prioritized automated and manual task recommendations to TMDS 210 for de-confliction and execution, e.g., in the form of an integrated task action list for fire, flooding, stability and hull stress. Automated task lists are sent for automated execution and manual tasks are sent for crew execution, e.g., via display by OCI 260, subject to the selectable automation mode in effect at the time. Some tasks that are capable of automatic execution may, e.g., as a matter of doctrine or procedure, be sent for crew authorization via display OCI 260 prior to execution.

Examples of tasks that may be sent to TMDS 210 include activating and deactivating water mist suppression systems, activating and deactivating de-watering systems, deactivating PDA cooling systems, activating and deactivating ballast control systems for each tank, isolating compartments (electrical, fluid and HVAC systems), providing positive/negative ventilation, transferring fuel within the fuel fill and transfer system, transferring water within the fresh water fill and transfer system, transferring water within the grey water fill and transfer system, transferring oily waste within the oily waste system, activating and deactivating telerobotic fire nozzles, activating and deactivating flight deck and other deck sprinkling systems, activating and deactivating magazine sprinkling, activating and deactivating inert gas fire suppression, activating and deactivating collective protection system, activating and deactivating space de-smoking, transferring dry stores, opening and closing doors and hatches, manually set fire boundaries at a specified deck and frame location, sending a hose team to a specified location, manually de-watering a specified compartment, and specifying a compartment or space for overhaul. SHARP system 300 may also report other status information such as draft, list and stability data, alerts when stability thresholds are exceeded, a hazard summary report and SHARP system 300 health and/or status.

Figure 4A:
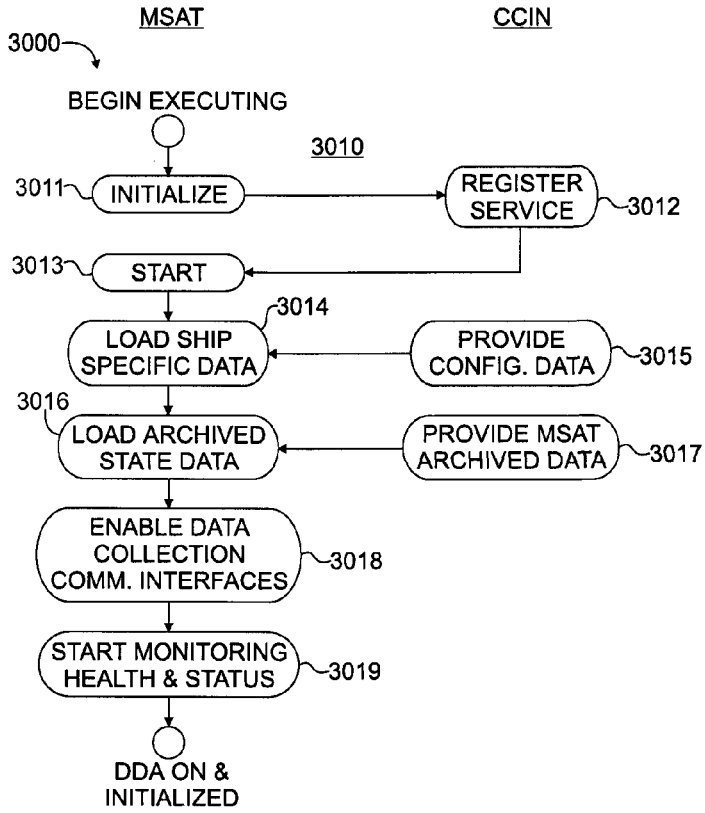
FIG. 4 relates to a start up process for the example damage control arrangement of FIGS. 1-3 and comprises FIGS. 4A through 4C illustrating example start up processes for different elements thereof.
Figure 4B:
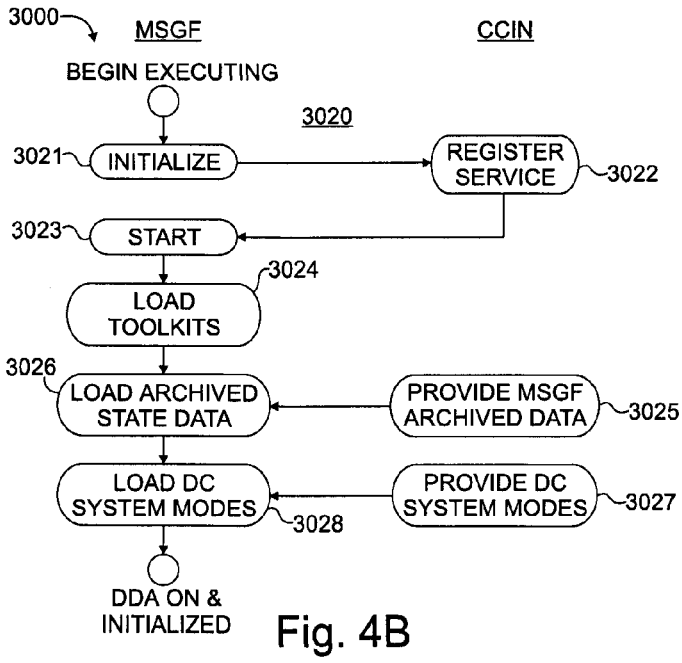
Figure 4C:
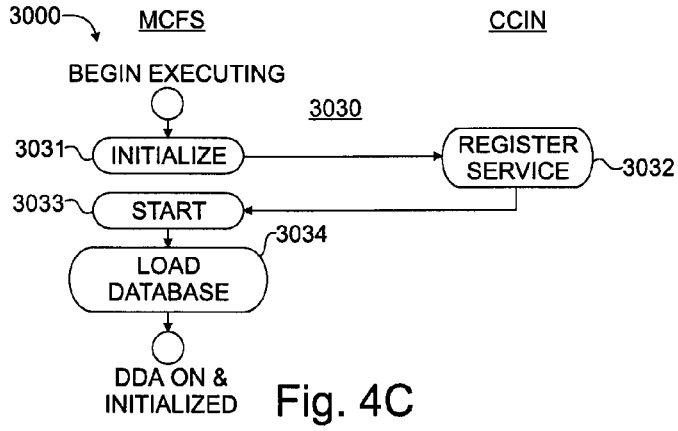

FIG. 4 relates to a start up process 3000 for the example damage control arrangement 300 of FIGS. 1-3 and comprises FIGS. 4A through 4C illustrating example start up processes 3010, 3020, 3030 for different elements thereof. In FIG. 4A, for example, start up process 3010 for MSAT 310 commences with a begin executing command and comprises initialization 3011 and registering 3012 MSAT 310 with CCIN 250 so that SHARP system 300 is registered with the vessel's computing and communication infrastructure 250 with which and through which it operates, so that its life cycle can be controlled thereby in starting and notifying CCIN 250 of the health and/or status of SHARP system 300. Optionally, start up process 3000 may include checking the health, e.g., the operability, of various generic devices, such as sensors, pumps, valves and the like, upon which SHARP system 300 depends for proper operation.

Start up process 3010 next starts 3013 its execution which loads 3014 vessel specific data provided 3015 from the vessel's configuration database maintained in the vessel's CCIN 250, e.g., the identifications and locations of the vessel's compartments and spaces. Archived state data may be provided 3017 and loaded 3016 from the MSAT 310 archived data stored in the vessel's CCIN 250 databases from prior operation of SHARP system 300 as well as from manual data inputs and from other vessel's data inputs. Archived vessel data may include, for example, archived hazard damage, compartment locations and classifications, and the like. Once the archived data is loaded 3016, data collection via communication interfaces is enabled 3018 so that sensor and other data may be received by SHARP system 300 and may be monitored 3019 to ascertain the health and/or status of the various vessel elements, systems, compartments and spaces.

In FIG. 4B, for example, start up process 3020 for MSGF 320 commences with a begin executing command and comprises initialization 3021 and registering 3022 MSGF 320 with CCIN 250 so that SHARP system 300 is registered with the vessel's computing and communication infrastructure 250 with which and through which it operates. Start up process 3020 next starts 3023 its execution which loads 3024 standard toolkits that are maintained in the vessel's CCIN 250, e.g., the various tools that MSGF 320 utilizes in formulating damage control strategies appropriate to responding to situation assessments provided by MSAT 310. Archived MSGF 320 state data may be loaded 3026 from the MSAT 310 archived data stored 3025 in the vessel's CCIN 250 databases from prior operation of SHARP system 300 as well as from manual data inputs and from other vessel's data inputs. Archived MSGF 320 data may include, for example, archived hazard and damage strategies previously formulated and the conditions that such strategies responded to, and the like. Once the archived MSGF 320 data is loaded 3026, SHARP system 300 system modes are loaded 3028 from the SHARP system 300 modes stored in the CCIN 250 databases including the available SHARP system 300 automation modes as well as the latest selected SHARP system 300 automation mode.

Preferably, among the archived data that is loaded upon start up or operator log on may also include a configuration file for each operator that contains the selected automation mode, display, and other preferences associated with that operator's identification, so that when an operator assumes control (e.g., logs on), the operator's preferred automation mode and display settings are automatically restored. SHARP system 300 may also have a defined standard or default configuration stored in the archived data so that a default or standard configuration results if no operator identification is defined upon start up and/or log on. For example, the autonomous mode is typically, and preferably, designated as the default mode absent an operator specified mode.

In FIG. 4C, for example, start up process 3030 for an example one of models 330-370 is illustrated, e.g., any of models 330-370. Start up 3030 of the example one of models 330-370 commences with a begin executing command and comprises initialization 3031 and registering 3032 the model with CCIN 250 so that SHARP system 300 is registered with the vessel's computing and communication infrastructure 250 with which and through which it operates. Start up process 3030 next starts 3033 its execution which loads 3034 its database which could include any one of various approaches to the modeling task. For example, loading 3034 could include loading a data base of schemas (e.g., pre-run scenarios) relating to the hazard and/or condition modeled and a data mining engine that responds to received hazard and/or damage data to find and select appropriate scenarios from the database that will assist SHARP system 300 and the operator, depending upon the selected automation mode, to prioritize and effectively allocate available resources to proposed responses for controlling the hazard and/or damage.

By way of further example, loading 3034 could include loading various algorithmic and/or analytical schemes, e.g., a physics-based analysis process or a scenario matching process or a decision tree type of process or a real-time process or another type of process, for processing the received hazard and/or damage data to find and select appropriate scenarios and/or responses to assist SHARP system 300 and the operator, depending upon the selected automation mode, to prioritize and effectively allocate available resources to proposed responses (strategies) for controlling the hazard and/or damage.

At the completion of start up processes 3000, 3010, 3020, 3030, SHARP system 300 is in an ON or operational condition, and is initialized, so as to be ready to receive and process whatever data relating to hazards and/or damage may be provided to it. Start up processes 3000, 3010, 3020, 3030 are run at the initial turn on of SHARP system 300 as well as immediately following any interruption in whole or in part to its operation, as might occur should there be a failure or interruption in the electrical power system that powers CCIN 250 on which SHARP system 300 runs, or in the communication network provided by CCIN 250, or any other circumstance that interferes with the proper operation of SHARP system 300. Because the various databases maintained by CCIN 250 are updated regularly during operation of SHARP system 300, e.g., at each data report, situation assessment and mode change, as well as at the termination of its operation, SHARP system 300 will return upon restart to the same state as immediately before its operation was terminated and/or interrupted, and have available the same data as it had immediately before the termination and/or interruption of its operation, e.g., in other words, SHARP system 300 resumes where it left off.

It is noted that start up processes 3010, 3020, 3030 of process 3000 may be run one after the other (serially) or at the same time (in parallel), as may be desired.

Figure 5A:
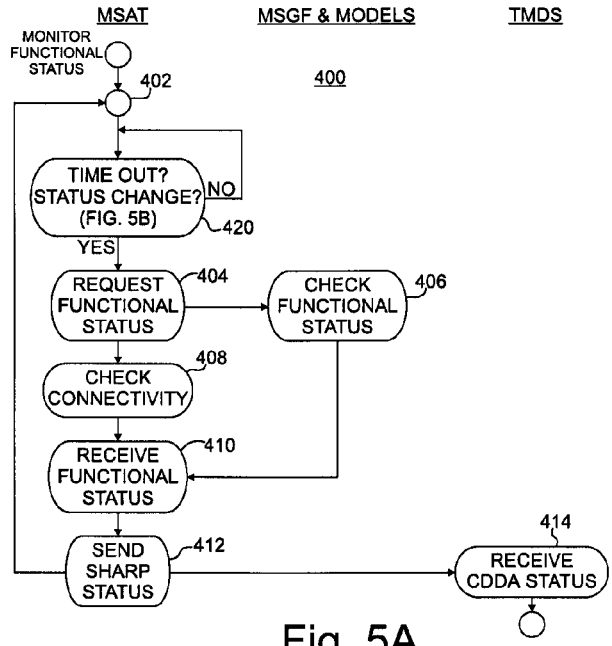
FIG. 5 relates to operation of the example damage control arrangement of FIGS. 1-3 under normal conditions and comprises FIGS. 5A through 5D illustrating different example operating processes thereof.

FIG. 5 relates to operation of the example damage control arrangement 300 of FIGS. 1-3 under normal conditions and comprises FIGS. 5A through 5D illustrating different example operating processes 400-480 thereof. FIG. 5A illustrates an example monitoring process 400 for monitoring the functional status of SHARP system 300 on a regular and repetitive basis so that the operability of SHARP system 300 is confirmed periodically to the human operator even when no hazard or damage exists. While any convenient period of time may be selected, by way of example a three-minute time is described. MSAT 310 performs 420 functional status monitoring process 400 every three minutes 420 or if any change in the operational status of an external ensemble occurs 420. External ensembles may include, for example, any of the software in vessel 100 including any of the example systems illustrated in relation to FIGS. 1-3, such as TMDS 210, ENSYS controller 220, PLMS 230, AMDS 240, CCIN 250 and OCI 260.

Figure 5B:
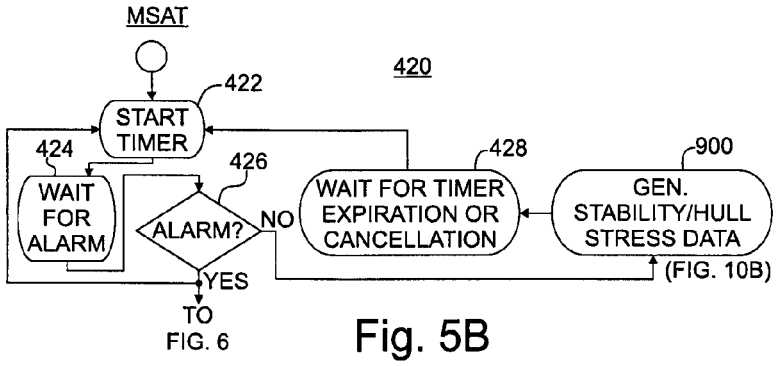

Timing process 420 is described in FIG. 5B and comprises starting 422 a time for the selected time period, e.g., three minutes in the present example. During the three minute timing period, MSAT 310 waits 424 for an alarm indicating that a hazard and/or damage condition has occurred. If 426 an alarm condition (e.g., hazard or damage) occurs, decision 426 is YES and timer 422 is restarted while MSAT 310 immediately commences process 500 illustrated in FIG. 6. Any time any hazard or damage condition exists, MSAT 310 operates to perform the hazard assessment processes described below in relation to FIGS. 6-14.

If 426 no alarm occurs within the three minute timer 422 period, then decision 426 remains NO and MSAT 310 waits 428 for expiration of timer 422 whereupon process 900 shown in FIG. 10 generates stability and hull stress data which is reported to the human operator via CCIN 250 and OCI 260 and timer is restarted 422. Vessel stability and hull stress process 900 is performed regularly and repeatedly under normal conditions under process 400 and as part of the hazard assessment process of MSAT 310 whenever any hazard and/or damage is detected.

Returning to self diagnostic process 400 of FIG. 5A, MSAT 310 requests 404 the functional status of each of MSGF 320 and of each of models 330-370, and each of MSGF 320 and models 330-370 checks 406 its functional status and reports same to MSAT 310. Meanwhile, MSAT 310 checks 408 for connectivity with each of the external ensembles, e.g., the sources from which it receives sensor and other data inputs upon which it depends for assessing a hazard and/or damage situation. Thus, MSAT 310 repeatedly evaluates the functionality of SHARP system 300 including its own ability to function to provide a situation assessment of a hazard and/or damage condition and the ability of MSGF 320 to formulate a strategy to respond thereto. Connectivity of MSAT 310 with external ensembles and sensors is through the vessel communication infrastructure such as a LAN provided by CCIN 250 and by each of the systems in which a sensor, database and/or other data source resides.

After checking its connectivity 408 and receiving the functional status 410 of MSGF 320 and models 330-370, MSAT 310 sends 412 a complete report of SHARP system 300 status to TMDS 210 which monitors the status of all of the systems and software of vessel system 200, and returns to junction 402 to repeat self-monitoring process 400.

Figure 5C:
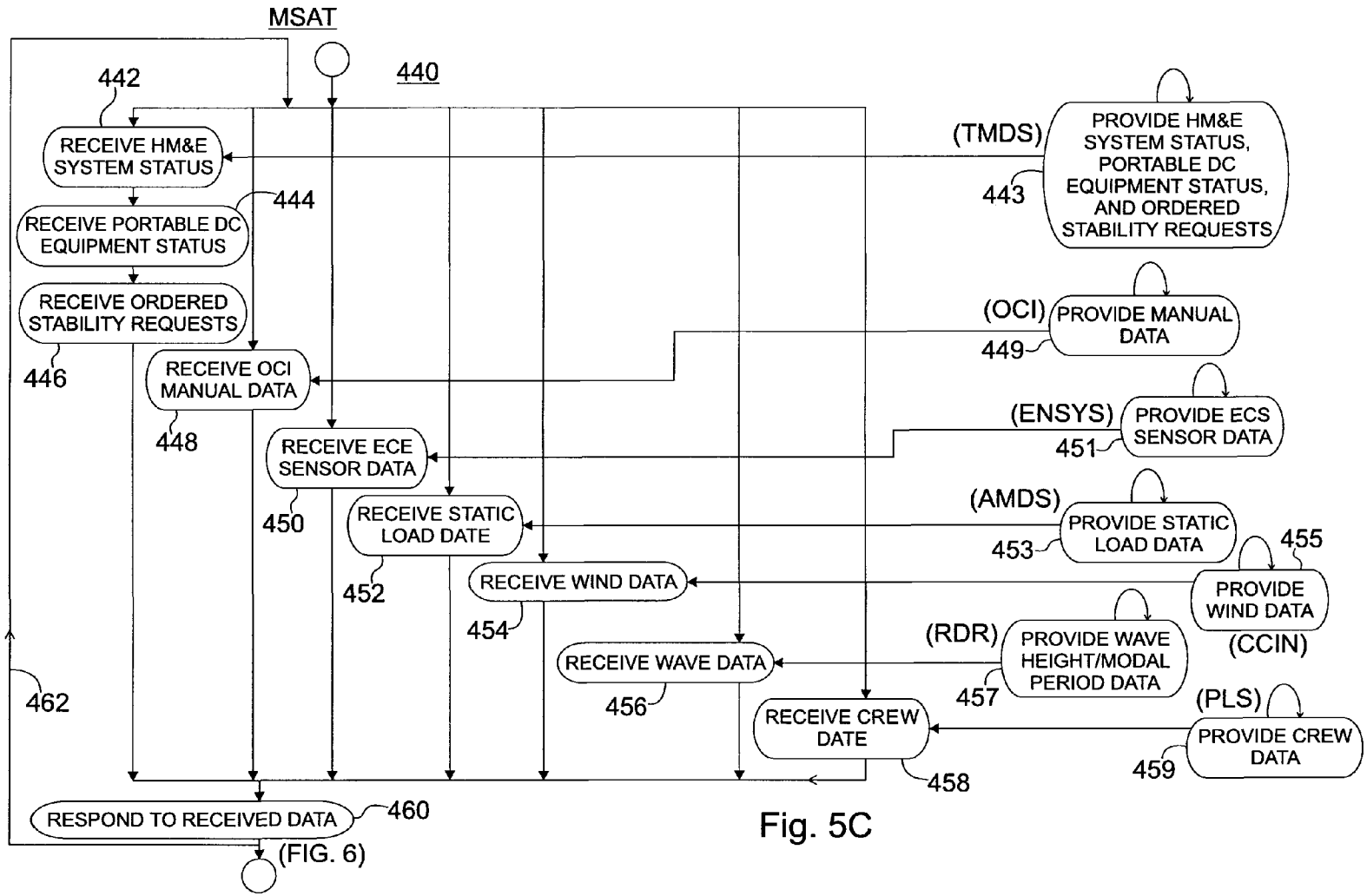

FIG. 5C illustrates an example data collection process 440 performed by MSAT 310 under normal operation as well as under a hazard and/or damage condition. Preferably operations 442-458 are performed in parallel so as to reduce the overall time needed to collect data from the various sources thereof, however, a serial data collection or a series/parallel data collection scheme could be utilized. In the particular example illustrated, TMDS 210 provides HM&E system status, portable damage control equipment status and any ordered stability requests, if any, and same are received 442, 444, 446 by MSAT 310. Manual inputs, if any, e.g., including sea state index information and crew casualty data such as confirmation of casualties, are provided 449 by OCI 260 responsive to manual inputs from human operators and are received 448 by MSAT 310. ENSYS controller 220 sensor data, if any, are provided 451 by OCI 260 responsive to ENSYS controller 220 sensor outputs and are received 450 by MSAT 310. Static load (dry load) data is provided 453 from the database of AMDS 240 and are received 452 by MSAT 310. Wind data is provided 455 by CCIN 250 and are received 454 by MSAT 310. Wave height and period data, if available, are provided 457, e.g., by an appropriate radar RDR, and are received 456 by MSAT 310. Crew data is provided 459 by PLMS 230, e.g., responsive to data from a personnel locator system and/or manual inputs from human operators, and are received 458 by MSAT 310.

MSAT 310 responds 460 to the received data by assembling and storing it in appropriate memory locations of SHARP system 300 from which it can later be retrieved for use, noting, however, that HM&E system status data is stored in and by ENSYS controller 220. Data that is more recent and/or accurate than the data previously stored will replace the previously stored data and data that is not new will be discarded. Data collection 400 continues 462 for as long as SHARP system 300 is operating and is terminated upon SHARP system 300 shut down.

Figure 5D:
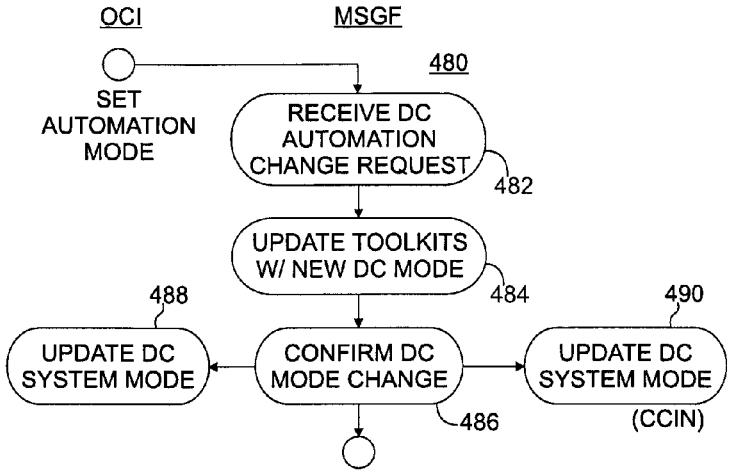

FIG. 5D illustrates a process 480 for selecting or setting the automation mode of SHARP system 300, e.g., among an autonomous mode, an operator override mode and an operator support mode, all as described above, in response to an automation mode change request received 482 from an operator. The one or ones of toolkits, i.e. models 330-370, to which the mode change request pertains are updated 484 with the new mode that applies to them. It is noted that updating 484 the toolkits/models 330-370 is an action that takes effect immediately in the toolkits 330-370 which cooperate with MSGF 320 to formulate damage control strategies and to act thereon in accordance with the selected automation mode(s). The changed automation mode is confirmed 486 by displaying 488 the changed automation mode to the operator via OCI 260 and is also stored 490 in the database of CCIN 250 so as to be available for initializing and/or re-starting SHARP system 300 when required.

Preferably, but at least optionally, the operator has the ability to select via OCI 260 an automation mode for each model 330-370 and/or damage control system so that only one or more of models 330-370 and their respective damage control systems may be affected by any particular change request 482. This allows the operator to select different automation modes for different ones of the possible hazard and/or damage conditions, thereby to allow the operator to focus on certain selected hazard and/or damage condition(s) while SHARP system 300 automatically attends to other hazard and/or damage conditions.

It is noted that because SHARP system 300 monitors the vessel's condition regularly and periodically, and not just when a hazard and/or damage event has occurred, the resources and capabilities of SHARP system 300 also serve to address conditions arising in normal operation that could be improved and/or alleviated by certain changes and/or adjustments to the operation and/or arrangement of vessel 100. Among such conditions are fuel tank level changes, ballast changes, movement of dry load and/or stores, and the like. SHARP system 300 assesses and formulates strategies to respond to such normal conditions in the same manner as described below in relation to hazard and/or damage conditions. It is also noted that assessments (including "safe" and no hazard reports) made by SHARP system 300 are available at all times to all operators of vessel 100, e.g., via display OCI 260, and not just to damage control operators and personnel.

Figure 6:
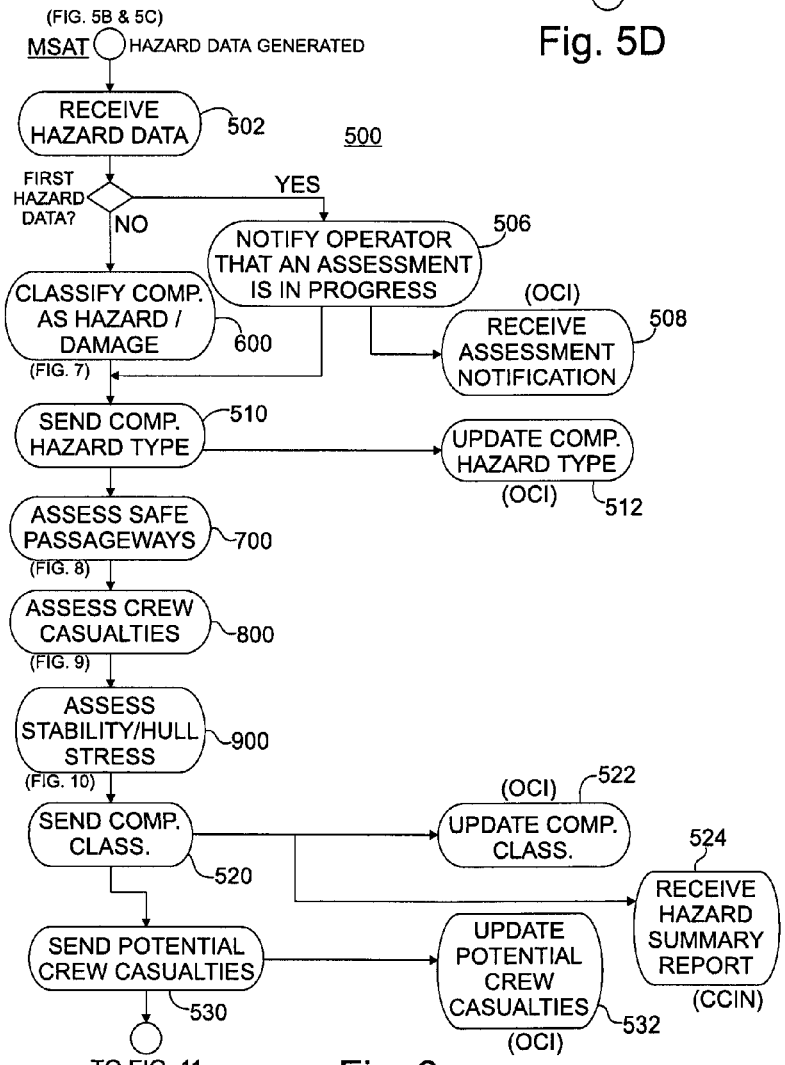
FIG. 6 illustrates an example operating process of an example situation assessment element for the example damage control arrangement of FIGS. 1-3.

FIG. 6 illustrates an example operating process 500 of an example situation assessment element MSAT 310 for the example damage control arrangement SHARP system 300 of FIGS. 1-3. Process 500 commences with receiving 502 hazard and/or damage data, e.g., from the processes illustrated in FIGS. 5C and 5D, and determines 504 whether the hazard and/or damage data received 502 is the first report of that hazard/damage. If the hazard/damage data is a first report thereof, then an operator is notified 506 that a hazard/damage assessment is in progress, and such notification is received 508 and displayed to the operator by OCI 260. SHARP system 300 typically performs the damage assessment, formulates a response strategy, sends damage control response tasks to TMDS 210, and reports the assessment, response strategy and tasks to the human operator via the display of OCI 260 within one minute of receiving hazard/damage data from the sensors.

Figure 7:
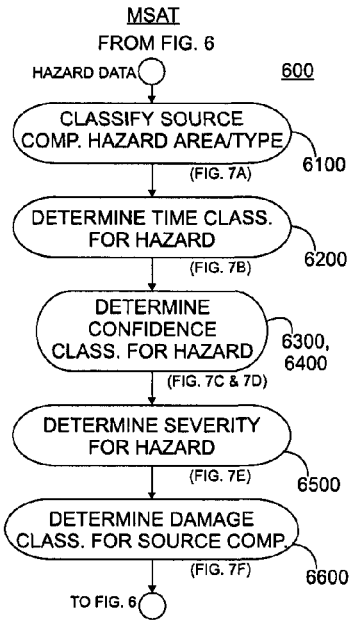
FIG. 7 illustrates an example classification process useful in the example situation assessment process shown in FIG. 6 and includes FIGS. 7A through 7F illustrating example processes useful in the process of FIG. 7.

If decision 504 is NO, and after notification if decision 504 is YES, the data is classified 600, e.g., according to the process 600 illustrated in FIG. 7, to classify the for the compartment about which the hazard/damage data pertains as a defined type of hazard/damage, e.g., fire, smoke, hazardous gas, flooding, CBR and other types of conditions, or that there is not a hazard/damage condition. Process 600 includes classifying each compartment about which the hazard/damage data pertains as a defined class of hazard/damage area, e.g., a primary damage area (PDA), a secondary damage area (SDA) or as an adjacent damage area (ADA), a confidence classification (e.g., potential or confirmed) for each type of hazard, a confidence classification (e.g., potential or confirmed) for each compartment that is damaged, or that it is not a hazard/damage area. When the compartment hazard/damage type classification is completed, both in a first assessment and in an updated assessment, the hazard/damage type classification is sent 510 to OCI 260 to update the compartment hazard/damage type displayed to the operator. Hazard type classification updates are sent 510, for example, to the OCI 260 display at a rate of about once per second.

Figure 8A:
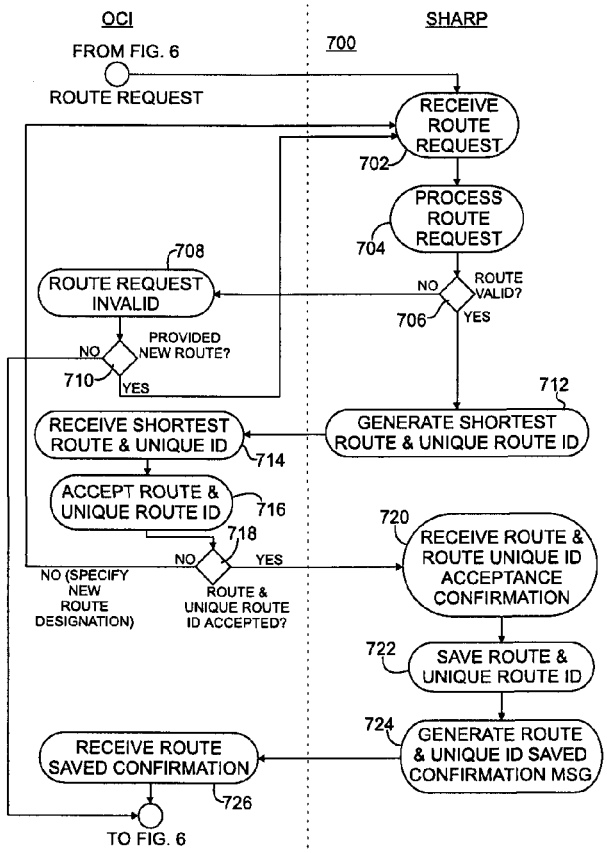
FIGS. 8A-8C illustrate a passage routing process useful in example situation assessment process shown in FIG. 6
Figure 8B:
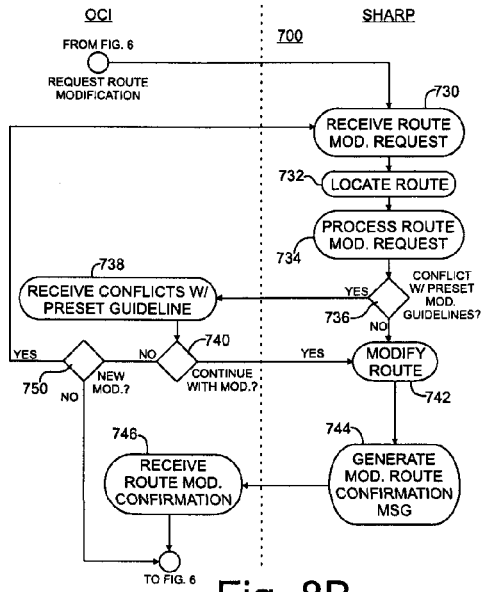
Figure 8C:
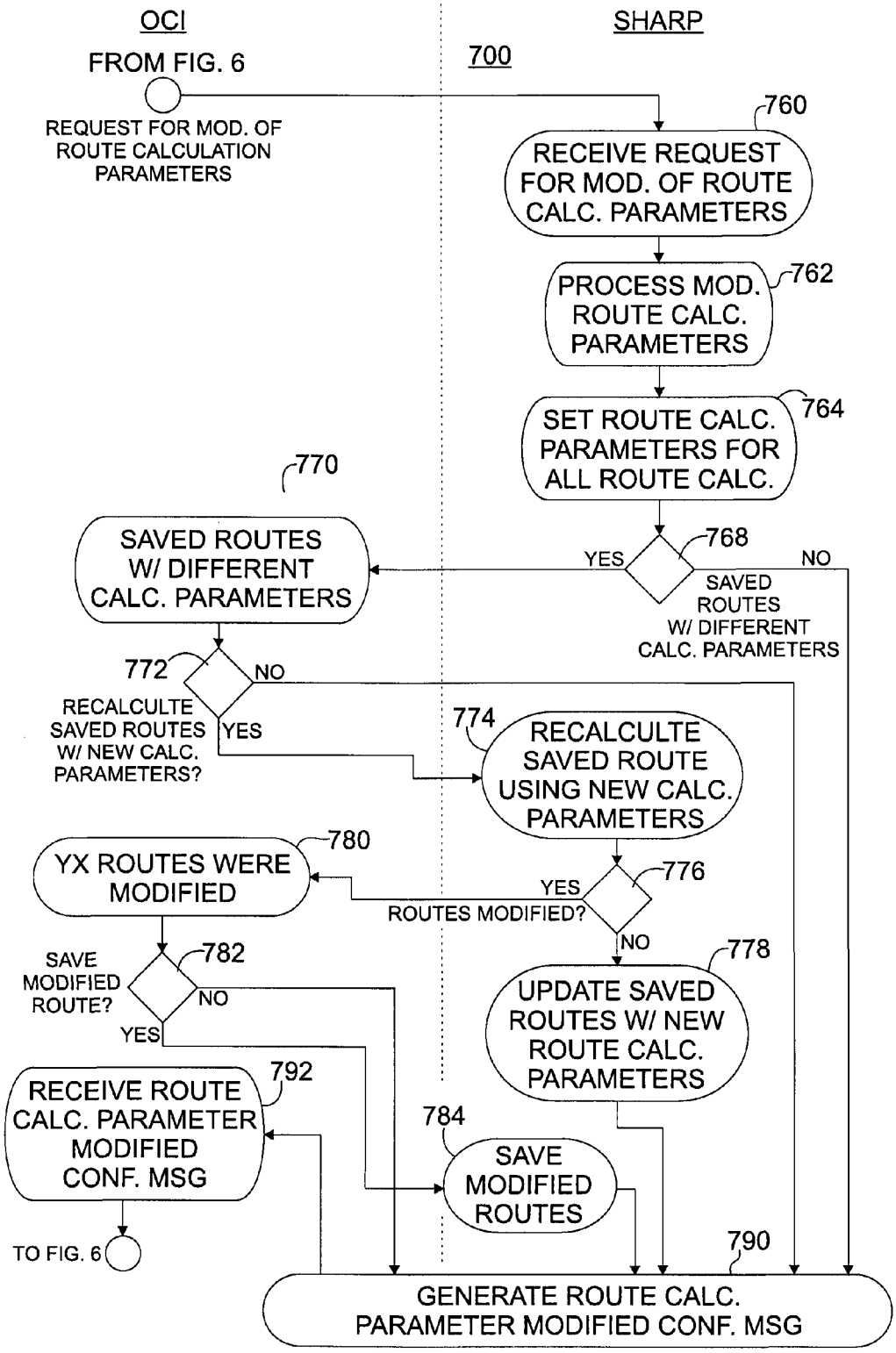
Figure 8D:
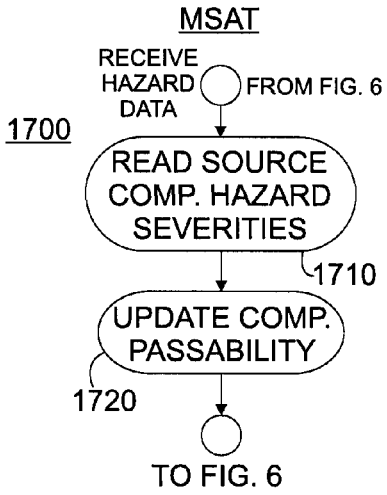
FIG. 8D illustrates an example passage assessment process useful in the example situation assessment process shown in FIG. 6.

Process 500 assesses 700, 1700 the routings and/or passageways of vessel 100, e.g., according to the process illustrated in FIGS. 8A-8C or in FIG. 8D, to determine which routings/passageways of vessel 100 are safe for passage of damage control personnel and equipment to the hazard/damage compartment, which enables MSGF 320 and/or an operator to identify transit route for responding damage control personnel to be defined, if appropriate.

Process 500 assesses 800 casualties to the crew of vessel 100, e.g., according to the process illustrated in FIG. 9, to determine crew status. Optionally, process 500, 800 could determine the availability of damage control personnel to respond to a hazard/damage condition and/or could keep track of available personnel for use by a commander or operator in assigning personnel to various tasks and duties.

Process 500 assesses 900 the stability and hull stress condition of vessel 100, e.g., according to the process illustrated in FIG. 10, to determine what the present state of vessel 100 is as a consequence of the reported hazard/damage data.

Compartment classifications and hazard/damage types are sent 520 to OCI 260 to update 522 the compartment classifications and hazard/damage types displayed to the operator and are sent to TMDS 210 which receives 524 same as a hazard report summary for use in, e.g., determining situational awareness, and/or performing root cause analysis and/or event reconstruction. Potential crew casualty data is sent 530 to OCI 260 to update 532 the display to the operator. Compartment classification updates and crew casualty updates are sent 520, 530, for example, to the OCI 260 display at a rate of about once per ten seconds. These display features may be selectable by an operator so that the operator can customize the displayed information according to his perceived needs at the time.

In addition, an operator may select an automation mode appropriate to his or her preference and confidence level with SHARP system 300. E.g., an operator may select different automation modes with respect to different types of hazards and damage, with respect to different classifications of damage, and/or with respect to different severities of hazard and damage. E.g., If an operator is confident to allow SHARP system 300 to respond to fire conditions, but wants to be involved in responding with regard to flooding conditions, then he may select the autonomous mode for fire and the operator override or operator support mode for flooding.

Figure 10A:
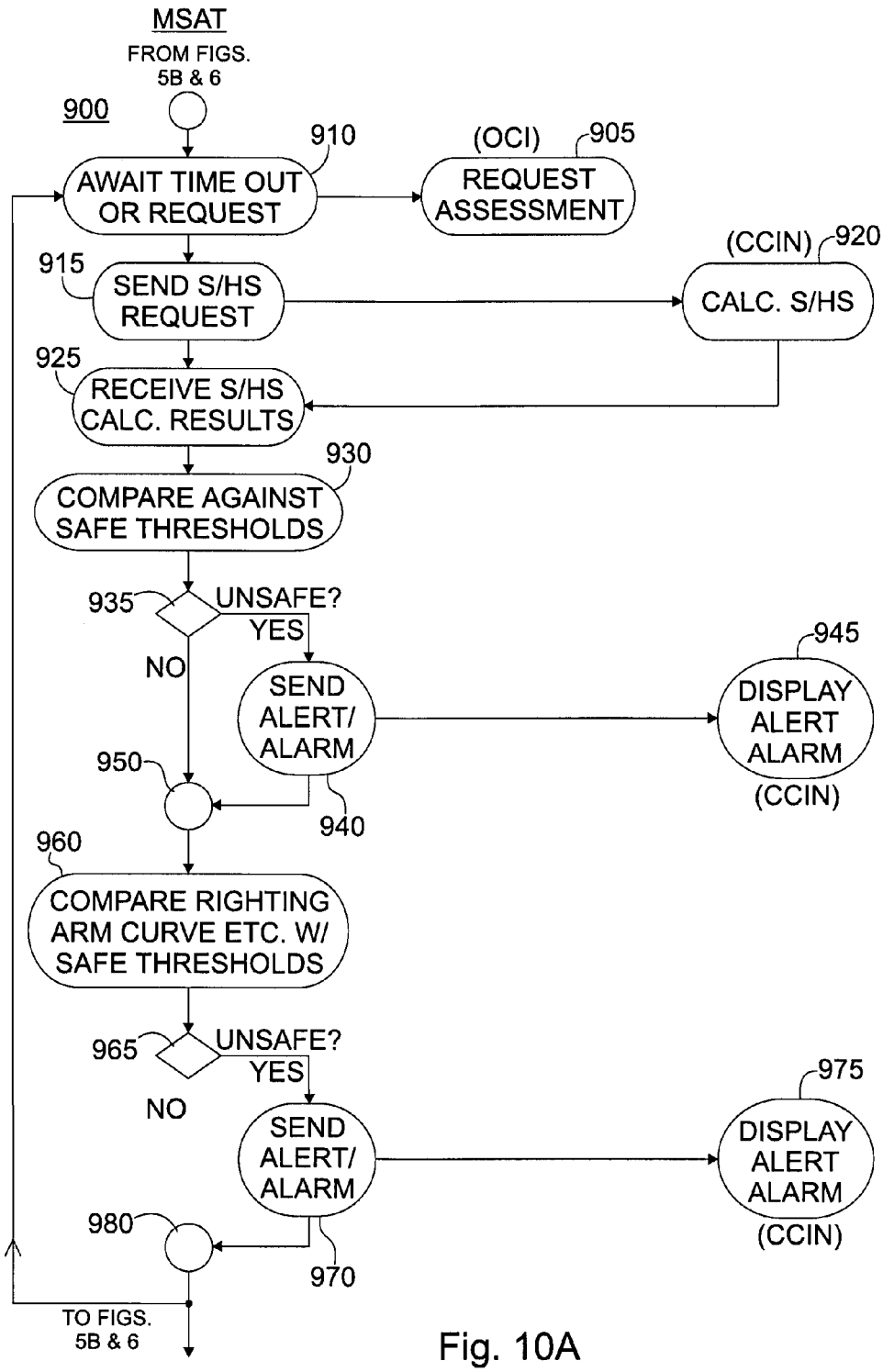
FIG. 10 includes FIGS. 10A and 10B which illustrate an example hull stress and stability assessment process useful in the example situation assessment process shown in FIG. 6.
Figure 10B:
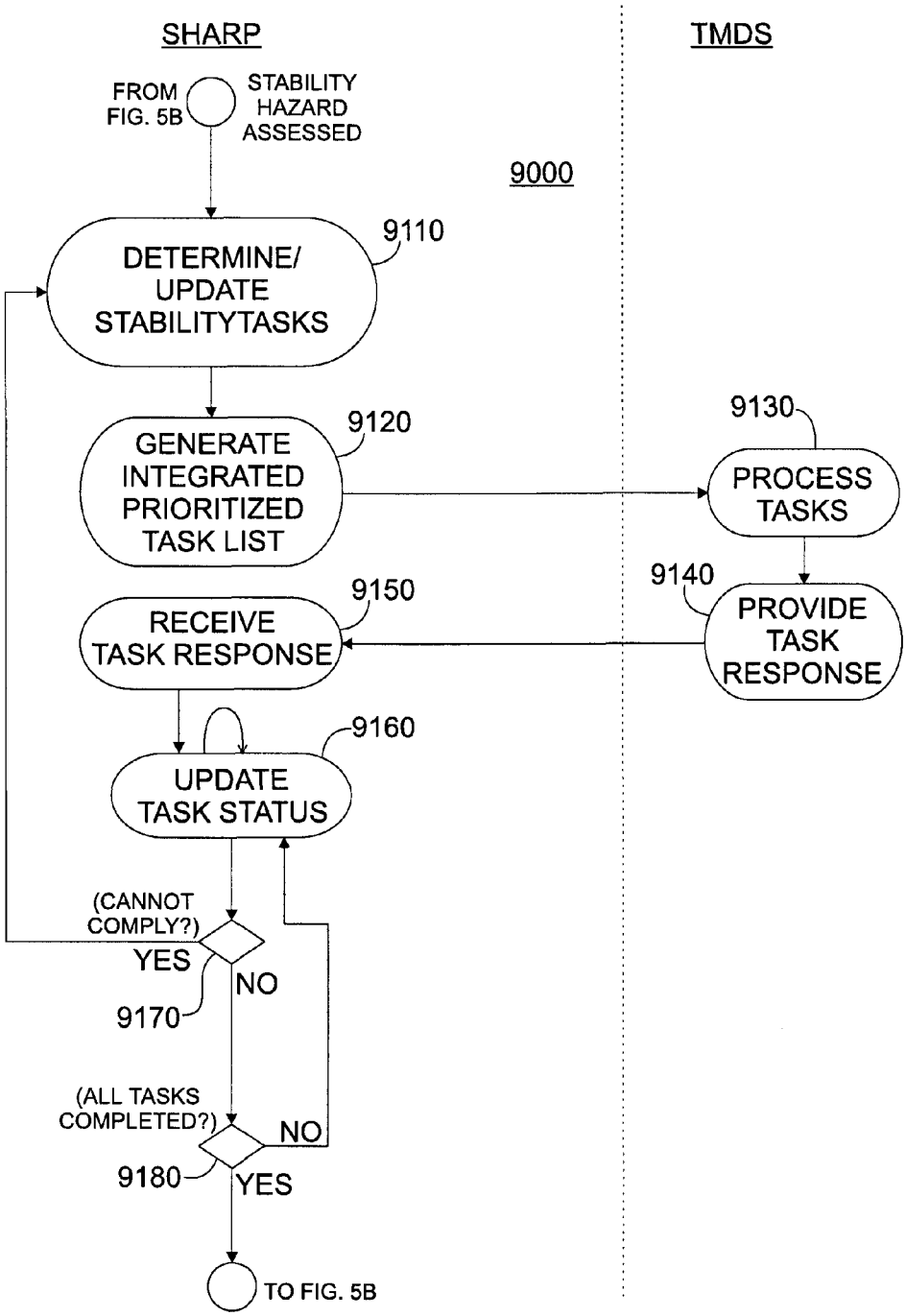
Figure 11:
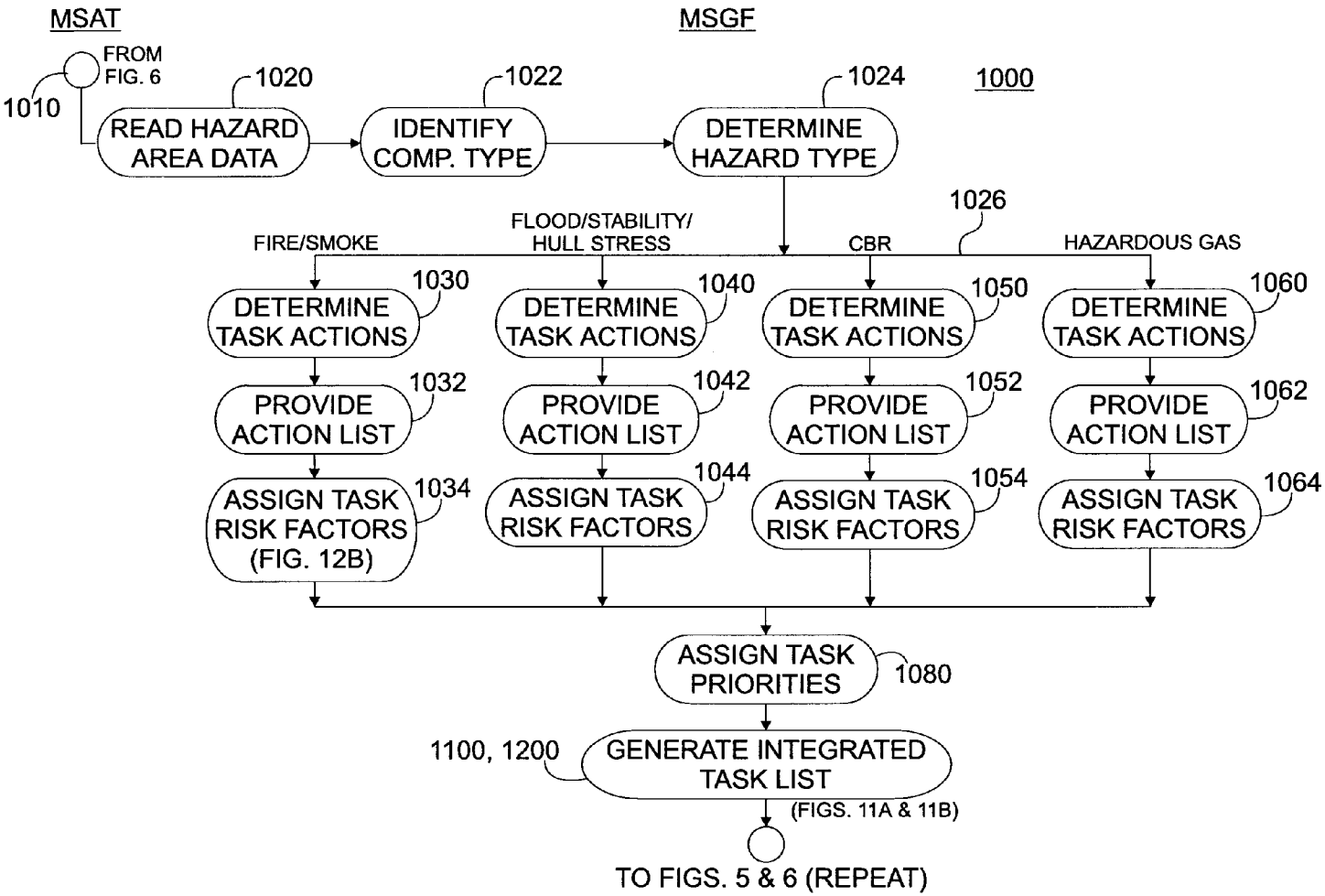
FIG. 11 illustrates an example strategy formulation process useful in the example damage control arrangement of FIGS. 1-3 and includes FIGS. 11A through 11B illustrating example task generation processes useful therein.

Finally, process 500 proceeds to FIG. 11 for formulation of a strategy or strategies to respond to the assessed hazard and/or damage condition. It is noted that process 500 is performed for each compartment for which hazard and/or damage data is reported 502, and that hazard/damage types and classifications for adjacent and nearby compartments are integrated in determining the compartment hazard/damage classification. It is noted that the processes 600-900 comprising process 500 may be performed in parallel or may be performed serially in any convenient order. Details of example processes 600-900 comprising process 500 are described below in relation to FIGS. 7-10.

FIG. 7 illustrates an example classification process 600 useful in the example situation assessment process 500 shown in FIG. 6 and includes FIGS. 7A through 7F illustrating example processes 6100-6600 that are useful in the process of FIG. 7. Process 700 proceeds through a number of sub-processes (assessments) including classifying (assessing) 6100 the source compartment hazard area and type, determining (assessing) 6200 a time classification for the source compartment hazard, determining (assessing) 6300, 6400, a confidence level for the classification assessed for the source compartment, determining (assessing) 6500 a severity for the source compartment hazard/damage, and determining 6600 a damage classification for the source compartment. Processes 6100-6600 assess different aspects of the hazard classification of process 700 and may be performed in parallel or may be performed serially in any convenient order. The compartment referred to as the source compartment generally is the compartment to which the hazard and/or damage data being processed 600, 700 pertains, and is typically the compartment where the hazard and damage sensors providing the data are located. It should be understood that the hazard/damage data from each compartment providing such data is processed 600, 6100-6600 separately as described.

Figure 7A:
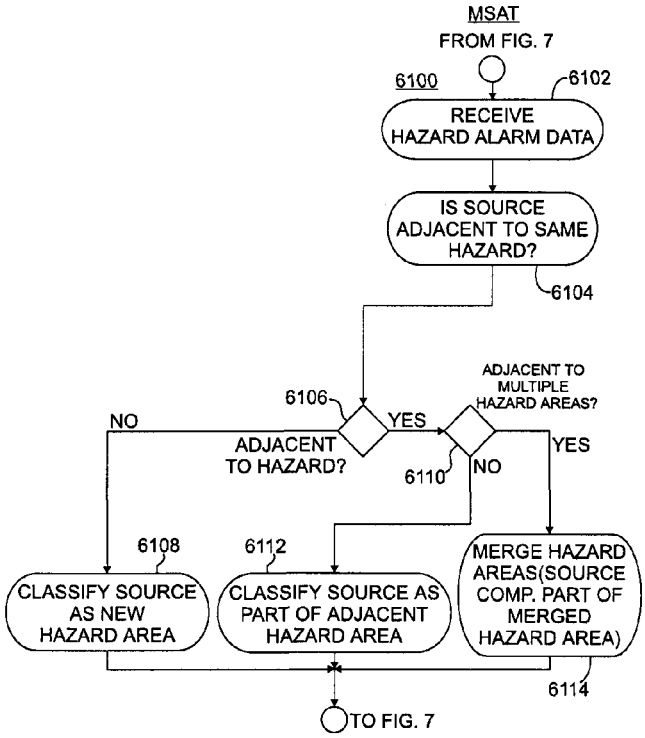

In process 6100 shown in FIG. 7A, MSAT 310 classifies (assesses) 6100 the type of hazard/damage for the source compartment as to whether the hazard damage relates to, e.g., fire, smoke, flooding, hazardous gas, CO, chemical, biological, radiological, and/or another type of hazard/damage. After receiving 6102 the hazard/damage data, e.g., a sensed level and/or alarm level, MSAT 310 determines 6104 whether the source compartment is or is not adjacent to another compartment that has been classified 6100 as having the same type of hazard. If 6106 the source compartment is not adjacent to a hazard area, e.g., a compartment, already classified as having a similar type hazard/damage (NO), then the source compartment is classified 6108 as a new hazard area and processing returns to process 600 of FIG. 7. If 6106 the source compartment is adjacent to a hazard area already classified as having a similar type hazard/damage (YES), then the process 6100 determines 6110 whether the source compartment is adjacent to multiple hazard areas classified 6108 as having a similar type hazard/damage. If 6110 the source compartment is not adjacent to multiple hazard areas already classified as having a similar type of hazard (NO), then the source compartment is classified 6112 as part of the adjacent hazard area and processing returns to process 600 of FIG. 7. If 6110 the source compartment is adjacent to multiple hazard areas already classified as having a similar type of hazard (YES), then the adjacent hazard areas are merged into a single hazard area and the source compartment is classified 6114 as part of the merged hazard area, and processing returns to process 600 of FIG. 7.

Figure 7B:
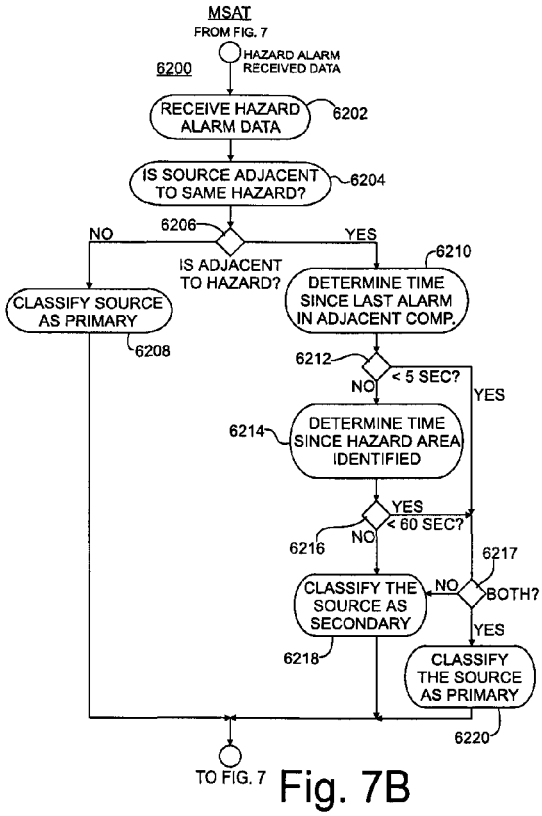

In process 6200 shown in FIG. 7B, MSAT 310 determines (assesses) 6200 a time classification for the hazard of the source compartment to determine whether the source compartment is part of a larger single hazard area, e.g., whether it is a primary, secondary or adjacent hazard area. After receiving 6202 the hazard/damage data, e.g., a sensed level and/or alarm level, MSAT 310 determines 6204 whether the source compartment is or is not adjacent to another compartment that has already been classified 6100 as having the same type of hazard. If 6206 the source compartment is not adjacent to a hazard area already classified as having a similar type hazard (NO), then the source compartment is classified 6208 as a primary hazard area and processing 6200 returns to process 600 of FIG. 7. If 6206 the source compartment is adjacent to a hazard area already classified 6100 as having a similar type hazard (YES), then the process 6200 determines 6210 the time since the last (i.e. most recent) received alarm relating to such adjacent compartment having a similar type hazard. If 6212 the time since the last report is not less than five seconds (NO), then process 6200 determines 6214 the time that has elapsed since the hazard area was identified as having hazard condition. If 6216 the elapsed time determined 6214 is not less than 60 seconds (NO), then the source compartment is classified 6218 as a secondary hazard area and processing 6200 returns to process 600 of FIG. 7. If 6212 the time determined 6210 is less than five seconds (YES) and if 6216 the elapsed time determined 6214 is less than 60 seconds (YES), i.e. both 6217 are true, then the source compartment is classified 6220 as a primary hazard area and processing 6200 returns to process 600 of FIG. 7.

Figure 7C:
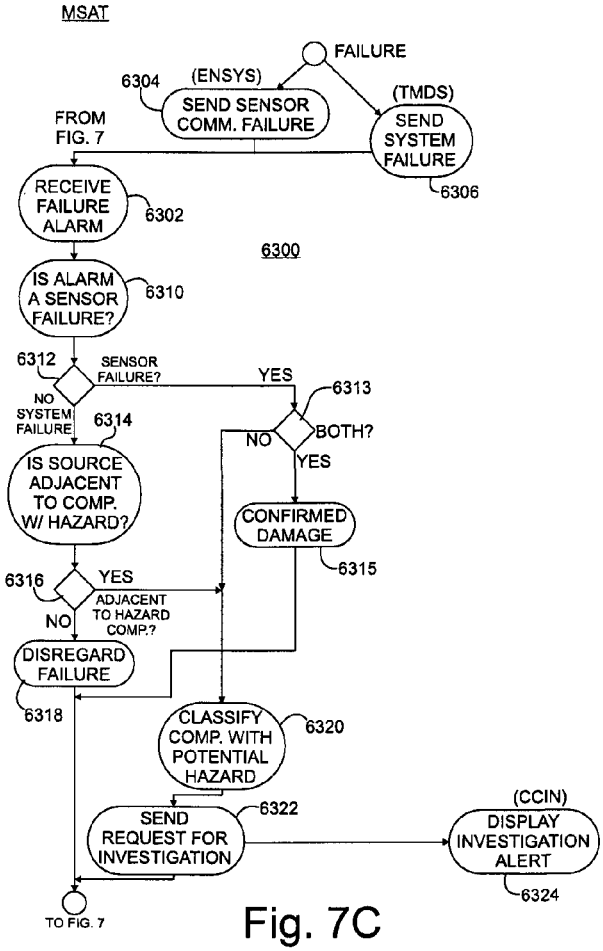
Figure 7D:
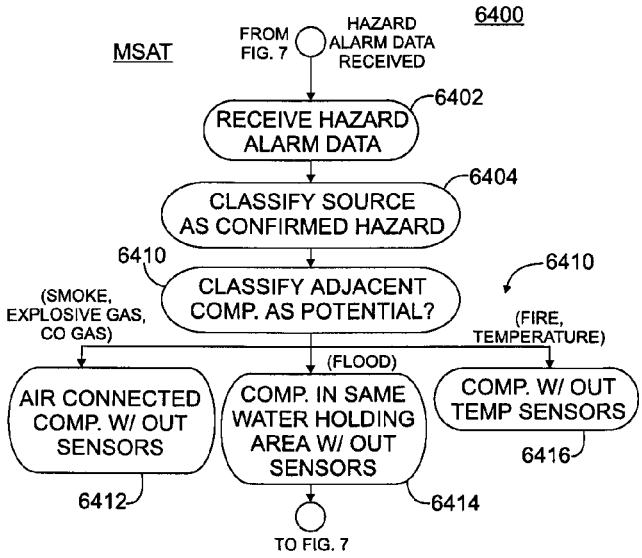

In process 6300, 6400 shown in FIGS. 7C and 7D, MSAT 310 determines (assesses) 6300, 6400 the level of confidence that may be given to the reported hazard and/or damage data and the classifications thereof for each source compartment, e.g., whether the hazard/damage is a potential hazard or is a confirmed hazard/damage condition. This assessment 6300 comprises two distinct parts: One part relates to classifying failures and possible failures of sensors and data therefrom as indicating a true hazard/damage condition or a false alarm. The other part relates to classifying adjacent compartments as likely potential damage areas in view of common characteristics of such compartments and confirmation of a hazard/damage condition in a source compartment.

In process 6300 shown in FIG. 7C, MSAT 310 receives 6302 failure alarms sent 6304 from ENSYS controller 220 relating to failure of a physical sensor, to failure of an HM&E system and/or to failure of communication with a sensor, any one of which could indicate that the sensor is failing to send data, is failing to send data representing a hazard and/or damage event or is sending false or incorrect data. MSAT 310 also receives 6302 failure alarms sent 6306 from TMDS 210 relating to failure of a system that could indicate that a system generated alarm is unreliable, is false or that the system is not sending alarms, e.g., due to some failure or other condition. From the failure alarm data received 6302, process 6300 determines 6310 whether the alarm is due to a sensor failure, e.g., by comparing data from the sensor in question to other data from other sources and/or from previous data from the sensor in question, e.g., for consistency and inconsistency among such data. For example, if a smoke sensor sends an alarm or data indicating that smoke is present, but video images from the same area show that no smoke is present, it is likely that the sensor or its communication path is not functioning properly. If 6312 there are both 6313 a sensor failure and a non-operational HM&E system in the same compartment, then the condition is classified 6315 as confirmed damage, however, if only one of the foregoing is true, then the compartment is classified as being a potential damage condition.

If 6312 a given sensor is determined 6310 to not have failed (NO), then process 6300 determines 6314 if the source compartment that has the given sensor is adjacent to a compartment that has already been determined 6100, 6200 to have a hazard/damage condition. If 6316 the source compartment is not adjacent to a hazard compartment (NO), then MSAT 310 disregards 6318 the failed sensor and its data. If 6312 the given sensor is determined 6310 to have failed (YES) and if 6316 the source compartment is adjacent to a hazard compartment (YES), then process 6300 classifies 6320 the source compartment as a potential hazard/damage area and sends 6322 a request for an investigation of the actual condition of that source compartment. Optionally, a request may be sent 6322 by SHARP system 300 or another element to OCI 260 via CCIN 250 to display 6324 an alert requesting investigation, e.g., by damage control personnel or other crew, or by a robotic or remote device.

In process 6400 shown in FIG. 7D, MSAT 310 receives 6402 hazard data, including alarms, and classifies 6404 whether the hazard/damage for the source compartment has been confirmed, e.g., by further data and/or by crew investigation or other manual input, as the hazard/damage that has been assessed by MSAT 310. If the source compartment is confirmed 6404 as a confirmed hazard area, process 6400 then classifies 6410 whether compartments adjacent the source compartment are potential hazard areas based upon certain characteristics of those compartments, the type of hazard confirmed for the source compartment, and whether the adjacent compartment contains installed operational sensors for that hazard. It is noted that if an adjacent compartment contains an installed operational sensor for a particular hazard, then there would be sensor data if that hazard exists in that adjacent compartment.

Classification 6410 comprises: If the confirmed 6404 hazard includes one of or a combination of smoke, hazardous gas, and CO gas, and if 6412 the source compartment and the adjacent compartment are connected by an air passage or a duct or are other wise connected whereby air or other gas may pass from one to the other and the adjacent compartment does not contain installed operational sensors for that hazard, then the adjacent compartment is classified 6412 as a potential hazard area, e.g., for the same type of hazard/damage (smoke, hazardous gas, and CO gas) as confirmed 6404 for the source compartment, and processing returns to process 600 of FIG. 7.

If the confirmed 6404 hazard includes flooding and if 6414 the source compartment and the adjacent compartment are both in the same water holding area of hull 100 or are other wise connected whereby water or other liquid may pass from one to the other and the adjacent compartment does not contain installed operational sensors for that hazard, then the adjacent compartment is classified 6414 as a potential hazard area, e.g., for the same type of hazard/damage (flooding) as confirmed 6404 for the source compartment, and processing returns to process 600 of FIG. 7.

If the confirmed 6404 hazard includes one of or a combination of fire and temperature (e.g., a high temperature above a normal or safe limit for that compartment) and if 6416 the adjacent compartment does not have a temperature sensor or does not contain other installed operational sensors for the hazard (and so fire therein would not be detected by a temperature sensor), then the adjacent compartment is classified 6416 as a potential hazard area, e.g., for the same type of hazard/damage (fire and temperature) as confirmed 6404 for the source compartment, and processing returns to process 600 of FIG. 7. It is noted that a temperature classified as excessive may or may not be related to a fire, e.g., it could result from a lack or failure of air conditioning, refrigerating and/or ventilating equipment, an overheating of equipment, or another non-fire-related condition.

It is noted that in each of steps 6412-6416 above, if an adjacent compartment does contain sensors responsive to the hazard under consideration, then sensor data from the adjacent compartment should be available and so the analysis of steps 6412-6416 is typically replaced by actual data indicative of the conditions in the adjacent compartments, although the connectedness between the source compartment and the adjacent compartment may still be taken into consideration in the analysis of the hazard and its potential to spread. Structural connections between adjacent compartments that are relevant to evaluation of the spreading of any particular hazard condition, whether it be fire, smoke, flooding, gas, or another hazard type, are thus taken into consideration either through the steps 6412-6416 or by actual data from sensors located in the involved compartments.

Figure 7E:
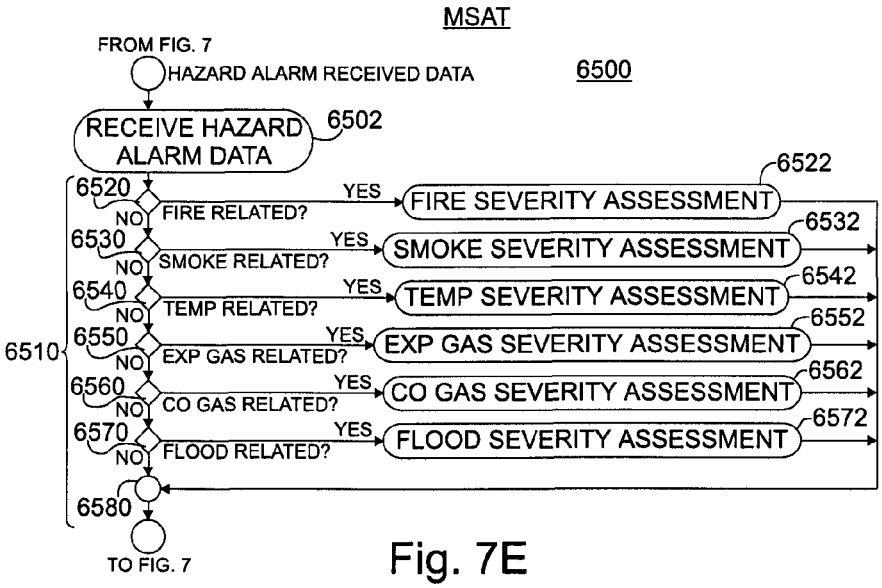

In process 6500 shown in FIG. 7E, MSAT 310 assesses 6500 the severity of the hazard/damage condition assessed for the source compartment, e.g., determines whether it is a low, medium or high severity (L/M/H) hazard/damage, based upon the type of hazard/damage that has been determined 6100 to be present in the source compartment. Process 6500 receives 6502 hazard and/or damage data, including alarms, and proceeds for assessing 6510 the severity thereof in relation to the type of hazard/damage condition present in an ordered sequence, e.g., based upon a predetermined hierarchy of hazards typically proceeding from a more severe hazard to a less severe hazard. Each alarm is processed 6510 via the applicable path 6520-6570 for severity classification and, because each alarm is for one hazard type, process 6510 need only complete the severity classification for that hazard type.

Each of assessments 6520-6580, 6522-6572 is performed for each compartment and hazard and/or damage condition has been sensed and/or reported, and is performed on a compartment by compartment basis until all of the compartments have been assessed 6510 for severity. Typically, because a single hazard has been assessed, only one of paths 6522-6572 is followed for any hazard indication. Each severity assessment 6520-6580 sorts the compartments by component identification and then applies predetermined rules for each hazard/damage type to determine (assess) whether the hazard/damage is of low, medium or high severity. Among the predetermined rules that may be considered for each hazard type are, e.g., the number of alarms received for each compartment and/or damage area, the value or level of the sensor data in relation to the known characteristics of each compartment and its contents, and its proximity to a PDA where the sensor data includes only smoke sensor data and not direct fire sensor data. Relating hazard data value to severity may be accomplished, e.g., by lookup tables for the various types of sensor data and value ranges, or by numeric or algebraic calculation, by predetermined scenarios, by comparison to predetermined and/or historical levels, or by other suitable algorithms, and typically such comparison is performed for each hazard type that appears to be present.

Assessing 6510 includes, if 6520 the hazard/damage is related to fire (YES), performing a fire severity assessment 6522 and returning 6580 to FIG. 7. If in a fire condition, e.g., the temperature is high or the fire is near to a compartment containing flammable or explosive material, then the severity would be high, whereas if temperature is moderate to low or if the fire is remote from hazardous materials, then the severity should be low.

Assessing 6510 includes, if 6530 the hazard/damage is related to smoke (YES), performing a smoke severity assessment 6532 and returning 6580 to FIG. 7. Smoke density and/or visibility data may, e.g., provide indications of the severity of a smoke condition. Although data may be related to severity in several ways, one common way is to compare the density of the smoke and/or the visibility in the face of the smoke as indicative of the severity of a smoke hazard.

Assessing 6510 includes, if 6540 the hazard/damage is related to temperature (YES), performing a temperature severity assessment 6542 and returning 6580 to FIG. 7. The severity of a high temperature condition may be related to severity on the basis of temperature, e.g., a higher temperature is indicative of a greater severity, and/or on the basis of where the high temperature condition is, e.g., nearby to flammable and/or explosive materials.

Assessing 6510 includes, if 6550 the hazard/damage is related to explosive gas (YES), performing an explosive gas severity assessment 6552 and returning 6580 to FIG. 7. Explosive gas severity may be assessed on the basis of the concentration or density of the explosive/hazardous gas, e.g., wherein a higher concentration or density represents a higher hazard condition.

Assessing 6510 includes, if 6560 the hazard/damage is related CO gas (YES), performing a CO gas severity assessment 6562 and returning 6580 to FIG. 7. A higher concentration of CO generally is indicative of a greater hazard risk. CO gas severity may be assessed on the basis of the concentration or density of the CO, e.g., wherein a higher concentration or density represents a higher hazard condition.

Assessing 6510 includes, if 6570 the hazard/damage is related to flooding (YES), performing a flooding severity assessment 6572 and returning 6580 to FIG. 7. Severity of flooding may be related to the extent of the flooding, e.g., whether compartments are partially or fully flooded, and where the flooded compartments are on the vessel, because both the extent of the flooding and the location of the flooded compartment relative to the vessel's centerline and waterline contribute to the resulting moment arm which affects the stability of the vessel.

Figure 7F:
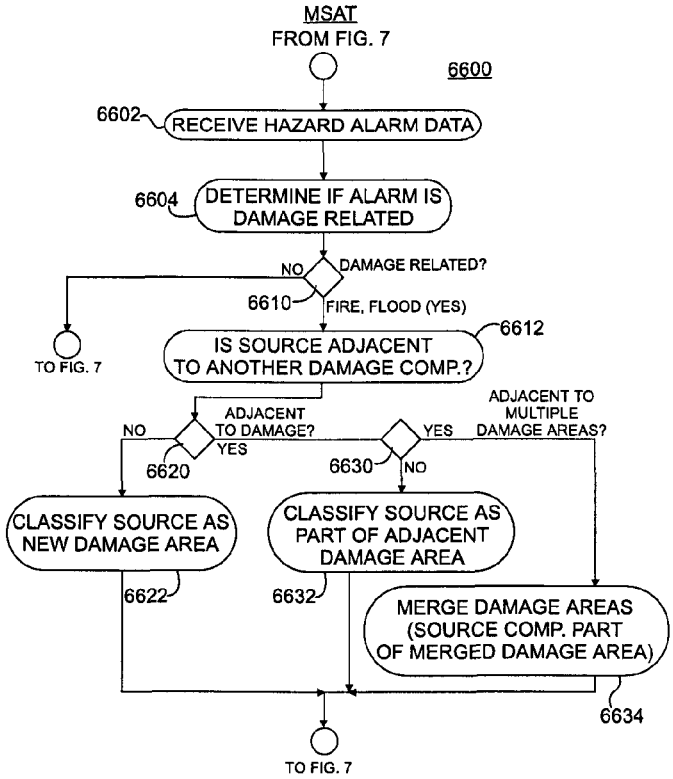

In process 6600 shown in FIG. 7F, MSAT 310 classifies (assesses) 6600 whether or not the hazard alarm/data indicates damage to the source compartment, and whether the source compartment is part of a larger damage area, for generating a table or listing of compartment by compartment identification for each primary damage area (PDA), secondary damage area (SDA) and adjacent damage area (ADA). This table/list includes the type of hazard/damage data for each compartment of the PDA, SDA and/or ADA (e.g., fire, smoke, flooding, hazardous gas, CO, chemical, biological, radiological, and/or another type of hazard/damage), and whether the hazard/damage data is confirmed or requires human (manual) investigation. After receiving 6602 the hazard data and/or alarm, e.g., a sensed level and/or alarm level, MSAT 310 determines 6604 whether the hazard alarm data for the source compartment does or does not indicate a damage related condition. For example, fire and flood hazards are considered to be damage related.

If 6610 the source compartment hazard is not damage related, then there is no damage condition (no PDA, SDA or ADA) and processing 6600 returns to process 600 of FIG. 7. If 6610 the source compartment hazard is damage related (YES), e.g., fire or flood, then process 6600 determines 6612 whether the source compartment is adjacent to another compartment that is classified as a damage area. If 6620 the source compartment is not adjacent to a compartment already classified as a damage area (NO), then the source compartment is classified 6622 as a new damage area and processing 6600 returns to process 600 of FIG. 7. If 6620 the source compartment is adjacent to a compartment already classified as a damage area (YES), then process 6600 determines 6630 whether the source compartment is adjacent to multiple damage areas classified 6108 as being a damage area. If 6630 the source compartment is not adjacent to multiple areas already classified as being damage areas (NO), then the source compartment is classified 6632 as part of an adjacent damage area and processing 6600 returns to process 600 of FIG. 7. If 6630 the source compartment is adjacent to multiple areas already classified as being damage areas (YES), then the adjacent hazard areas are merged into a single hazard area and the source compartment is classified 6634 as part of the merged hazard area, and processing 6600 returns to process 600 of FIG. 7.

It is noted that the foregoing assessing 6510 is performed from integrated (fused) data of present hazards and/or damage and produces an integrated (or fused) situation assessment because the results form all of the assessments is combined prior to being reported, e.g., by being displayed on OCI 260, to the crew or an operator. Preferably, the displayed assessment presents an overall situation assessment at a relatively high level, and may be color coded or flashing or otherwise made distinct to indicate various characteristics of the reported hazards and damage. For example, display OCI 260 display may provide tabs and/or other icons on which an operator may click to modify the display of the situation assessment. Such operator click-able modifications may include filtering the displayed data by the type of hazard/damage, by the severity of the hazard/damage, by damage areas, by damage area classification, by vessel system (e.g., operation, control, propulsion, hull, data processing, navigation, and the like.

FIGS. 8A-8C illustrate a passage routing process 700 useful in example situation assessment process 500 shown in FIG. 6, and FIG. 8D illustrates an alternative example passage assessment process 1700 useful in example situation assessment process 500. One effect of a hazard and/or damage condition may be to render certain routes and passageways dangerous or impassable to human crew while other routes and passageways remain open and safe for passage, and so it is desirable to know which routes are available for damage control personnel to safely and quickly reach a hazard area and for other crew to safely and expeditiously escape a hazard area. Further, routes may be needed for ventilation and/or evacuation of compartments and/or spaces to the outside environment. It is noted that passageways are "compartments" and so may be included in the vessel compartment database and in other aspects of hazard/damage assessment by MSAT 310 and of strategy formulation by MSGF 320.

It is noted that routing process 700 performs three different aspects of routing, specifically, a part for establishing a route, e.g., as shown in FIG. 8A, a part for modifying an established route, e.g., as shown in FIG. 8B, and a part for modifying the calculation parameters upon which routes are established and/or modified, e.g., as shown in FIG. 8C. Process 700 provides a function that is comparable to a navigation system used in modern cars and other vehicles in that it provides routings between starting an end points specified by an operator, and provides features for designating routes to particular purposes, e.g., as a personnel route, a personnel egress route, as a smoke or gas ejection route, and the like. This routing process may be utilized by the crew at any time, irrespective of whether hazard conditions are or are not present.

In the portion of routing process 700 shown in FIG. 8A is illustrated the processing 700 of an initial route request initiated by an operator, e.g., via OCI 260, to SHARP system 300 to provide a route in response thereto. The route request is received 702 and processed 704 by MSAT 310 to first determine whether the requested route is valid 706. A route request is invalid 706 if the starting point and ending point are the same, if the starting point, end point and/or any way points are not accessible according to predetermined criteria, e.g., the route would have to pass through a damage area (PDA, SDA) or through a watertight bulkhead that must remain sealed. If the route request is invalid [NO], then a notification thereof is provided 708 with explanation of the reasons that the route request was determined to be invalid. The operator may request 710 a new route [YES] that is received 702 by MSAT 310 and processed as described. If a new route is not requested 710 [NO], then process 700 ends and processing returns to FIG. 6.

If the route request is determined 706 to be valid [YES] then MSAT 310 generates 712 the shortest route from the requested start point to the requested end point that passes through all requested way points and generates 712 a unique route identifier (ID) for that route. The generated 712 route and ID is provided 714 to the requesting operator, e.g., via OCI 260, and the operator may use the unique route ID to designate the route as he or she chooses. E.g., a route may be designated as being of a particular type, e.g., being dedicated to smoke ejection (e.g., ventilation) only, or as a personnel evacuation route, or as a fire fighter ingress/egress route, or any combination of designations that are safe (e.g., a ventilation route might be safe for specially suited fire fighters, but may not be safe for other personnel lacking breathing or other special equipment).

The operator is given opportunity to accept/reject 716 the generated route and unique route ID. If the requester/operator does not accept 718 [NO] the route and route ID, he may specify 718 a new route request and/or designation which is then received 702 and processed 704 by MSAT 310 as described. If the requester/operator accepts 718 [YES] the route and route ID, the acceptance is received 720 as confirmation of the route and unique route ID and is saved 722, e.g., in a route database. A message confirming that the route has been saved 722 is generated 724 and is provided 726 to the requestor/operator, e.g., via OCI 260. Process 700 then ends and returns to process 500 of FIG. 6.

In the portion of routing process 700 shown in FIG. 8B is illustrated the processing 700 of a route modification request initiated by an operator, e.g., via OCI 260, to SHARP system 300 to provide a modified route in response thereto. A route modification may include, e.g., changing the route type, changing the start point and/or the end point, and/or changing one or more way points. When a route modification request is received 730, SHARP system 300 locates 732 the route that is to be modified, e.g., utilizing the unique identifier that was assigned to the route when it was created or previously modified or utilizing another characteristic of the route, and then proceeds to process 734 the route modification request. Route modifications may or may not be in accordance with preset or predetermined route modification classes or guidelines, e.g., that personnel evacuation routes be separate from smoke or gas ventilation routes, or that ventilation routes for flammable or explosive gasses be separate from fire venting routes, or may be set by operator preference.

Each route modification request is compared 736 with preset route modification guidelines to determine whether there is a conflict therewith. If 736 there is a conflict [YES], then such conflicting requests are processed 738 in relation to the conflict with that guideline to require a decision 740 as to whether to continue with that requested modification. If 740 not [NO], then a query is sent to the operator, e.g., via OCI 260, as to whether 750 a new modification is desired. If 750 so [YES], then process 700 returns to step 730 to receive the revised modification request. If 750 not [NO], then the process ends and returns to FIG. 6.

If 736 the request does not conflict with any preset modification guideline [NO] or if 740 the operator elects to continue with the original modification request [YES], then the route is modified 742 as requested and a route modification confirmation message is generated 744 and is communicated 746 to the operator, e.g., via the display of OCI 260.

In the portion of routing process 700 shown in FIG. 8C is illustrated the processing of a request for modification of the parameters upon which a routing request is calculated by process 700. Typically, such request is initiated by an operator, e.g., via OCI 260, to SHARP system 300 to provide modified routes in response to and in conformity to the requested parameter modification. Examples of route calculation parameters may include, for example, changes in compartments and other areas that are identified as PDAs or SDAs, changes in the closing/sealing of hatches and bulkheads for setting containment boundaries for smoke, gas or water, and the like. The request for modification of one or more route calculation parameters is received 760 and processed 762 to set 764 the route calculation parameters for all future route calculations in accordance with the requested modified route calculation parameters.

Next is determined 768 whether there are previously saved routes that have been generated using route calculating parameters that are different from the requested modified route calculation parameters. If 768 [NO] there are no saved routes calculated with different calculation parameters, then a message confirming that fact is generated 790 and is communicated 792 to an operator, e.g., via OCI 260, and process 700 returns to FIG. 6.

If 768 [YES] there are saved routes that were calculated with different parameters, then a message indicating that there are saved routes to be recalculated is generated and communicated 770 to the operator. If the operator rejects 772 [NO] recalculation of the saved routes in accordance with the requested modified calculation parameters, then the saved routes are not recalculated and a message confirming that fact and the operator's decision is generated 790 and is communicated 792 to the operator, e.g., via OCI 260, and process 700 returns to FIG. 6. In this case, SHARP system 300 does not recalculate the saved routes, but does apply the modified calculation parameters to future calculations for new routes.

If the operator elects 772 [YES] to recalculate the saved routes in accordance with the requested modified calculation parameters, and there are saved routes to be recalculated, then 772 [YES] the saved routes are recalculated 774 using the new (recalculated) route calculation parameters. If no routes were modified 776 [NO], the saved routes are updated 778 using the new route calculation parameters and a message confirming that fact is generated and communicated 790 to the operator, e.g., via OCI 260. If routes were modified 776 [YES], the modified routes, e.g., routes XY, are displayed 780 and the operator may elect 782 to save or not save the modified routes. If the operator requests to save the modified routes 782 [YES], then the modified routes are saved 784 and a message confirming that fact, identifying the modified (recalculated) routes and the operator's decision is generated 790 and communicated 792 to the operator, e.g., via OCI 260.

If the operator rejects 782 [NO] saving the modified routes, then the saved routes are not recalculated and a message confirming that fact and the operator's decision is generated 790 and is communicated 792 to the operator, e.g., via OCI 260, and process 700 returns to FIG. 6. In this case, SHARP system 300 does not recalculate the saved routes, but does apply the modified calculation parameters to future calculations for new routes.

If the operator elects 782 [YES] to save the modified routes, then the recalculated modified routes are saved 784 and a message confirming that fact and the operator's decision is generated 790 and is communicated 792 to the operator, e.g., via OCI 260, and process 700 returns to FIG. 6. In this case, SHARP system 300 recalculates the saved routes utilizing the modified calculation parameters and also applies the modified calculation parameters to future calculations for new routes.

Thus, the operator is provided a routing process 700 that generates specific routings that satisfy the criteria originally set by the operator or by a default condition, that generates modified routings when modified routes are requested, and that recalculates routes based on revised routing parameters, all subject to operator input and control.

In alternative process 1700 of FIG. 8D, MSAT 310 assesses the affects of the assessed and/or reported hazard and/or damage conditions upon the various passageways of vessel 100, e.g., the paths that crew could traverse in gaining access to a hazard/damage area and/or in exiting away from a hazard/damage area. Thus, passageway assessment serves a two-fold function: to identify available routes by which damage control crew and resources can be brought to a hazard/damage area so that the hazard/damage can be responded to thereby, and to identify the routes by which crew can move away from a source of danger due to a hazard and/or damage condition. Typically, process 1700 is performed 910 as part of each damage assessment that MSAT 310 performs in response to receiving 1705 data indicating that a hazard and/or damage condition has occurred and/or exists.

In alternative process 1700, MSAT 310 reads 1710 source compartment hazard severities, e.g., as identified by process 600, 6500, for each compartment identified as a hazard area and/or as a damage area, and, based upon the reported hazard/damage and the severity thereof, updates 1720 a compartment passability database listing so that compartments that are passageways and/or that are proximate passageways are identified as being or not being passable safely, e.g., based on existing hazard severities. Compartment passability 1720 may be represented by different values, e.g., values representing safe (no hazard) passage, passable with risk, passable with great risk, and impassable. Passability values may be indicated on the display provided to the crew and/or operator by CCIN 250 via OCI 260. Process 1700 then returns to process 500 of FIG. 6.

Figure 9A:
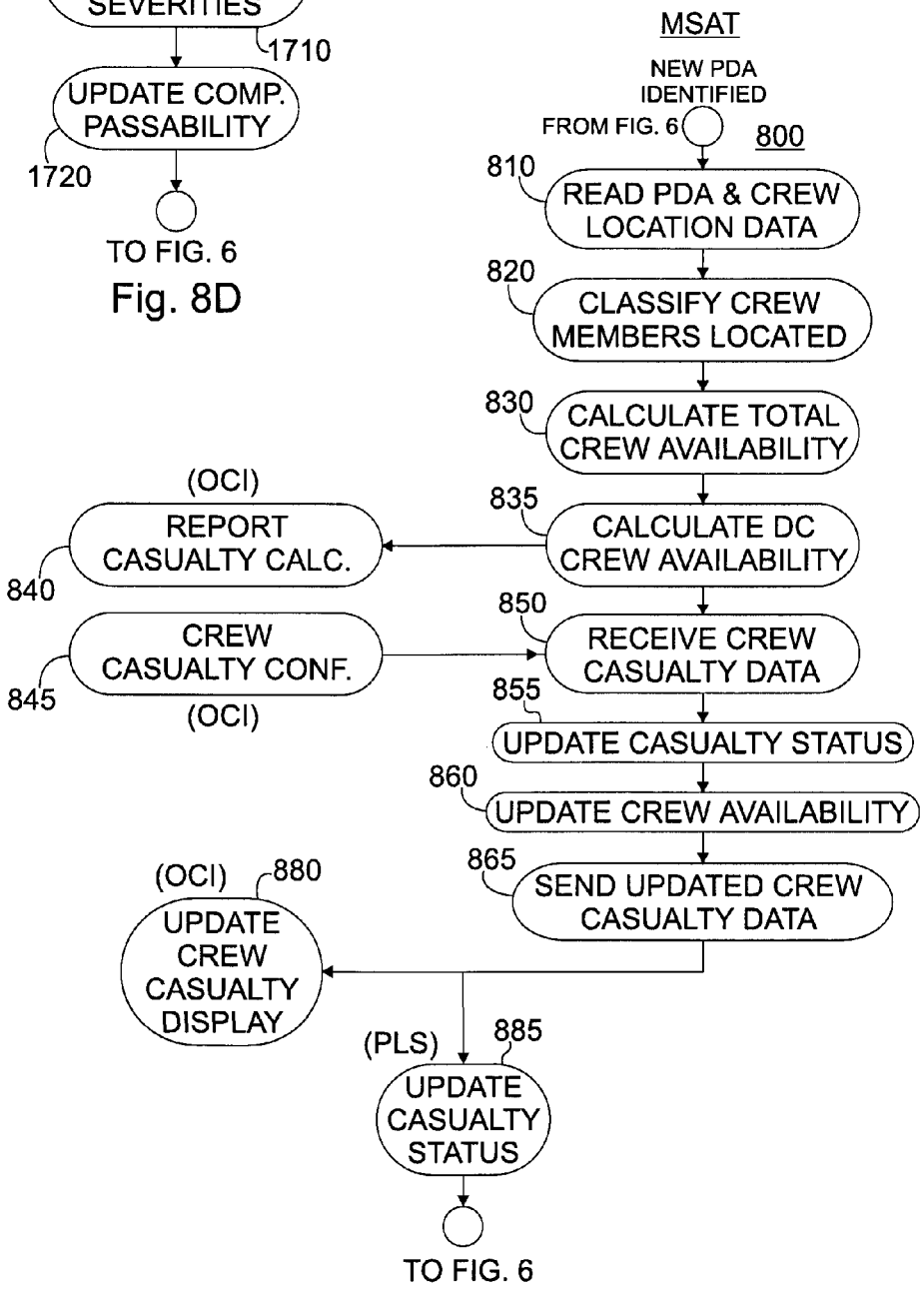
FIG. 9 includes FIGS. 9A and 9B which relate to casualty assessment and illustrate example casualty assessment and crew management processes useful in the example situation assessment process shown in FIG. 6.
Figure 9B:
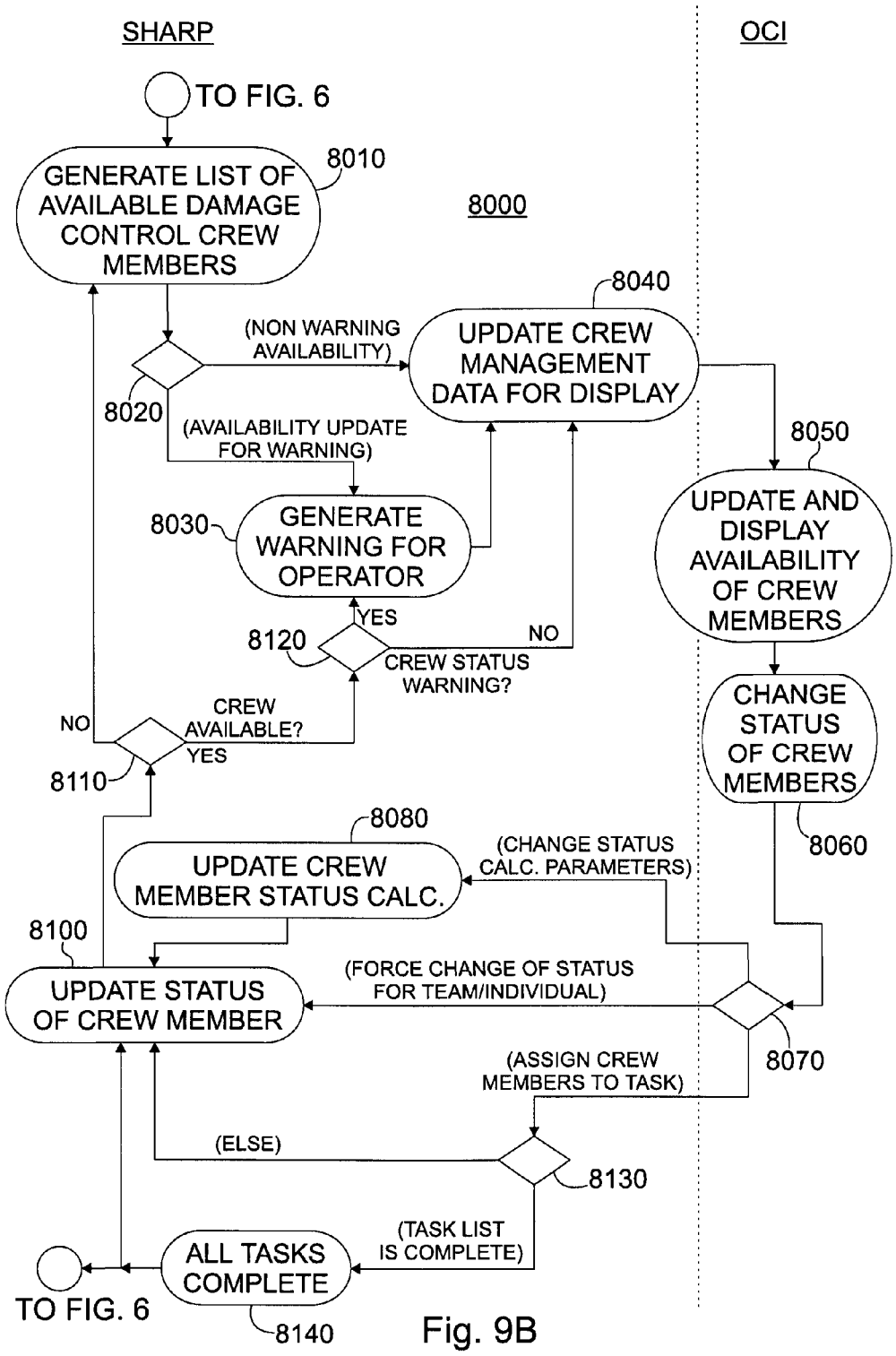

FIG. 9 includes FIGS. 9A and 9B which relate to casualty assessment and illustrate example casualty assessment and crew management processes. FIG. 9A illustrates an example crew casualty assessment process 800 useful in the example situation assessment process 500 shown in FIG. 6. In process 800, MSAT 310 determines (assesses) potential crew casualties based upon the locations of damage areas (e.g., PDA and SDA), the locations of crew members, and reports of confirmed casualties. Preferably, crew location data is provided in real time by a personnel locator system (PLS) wherein each crew member carries an identifying tag or badge and readers disposed at various locations on vessel 100 read the crew tag/badges when a crew member is present. While bar coded tags and bar code readers may be utilized, it is preferred that radio frequency identification (RFID) tags/badges and readers be employed in a PLS so that crew members do not have to go to the reader to have their presence read. It is also preferred that a reader be located in each compartment, rather than in a larger area or zone, so that crew locations will be more precisely known, although an area or zone system can provide the desired functionality in many instances. The PLS may be provided by and/or considered as part of PLMS 230, and various components thereof may communicate via wired and/or wireless communication paths, e.g., wireless access points (WAP), LAN, WAN, or other network.

In process 800, primary damage area and crew location data are read 810 to provide the data needed for crew casualty assessment. Crew members shown by the read data to be located within known PDA compartments are classified 820 as potential casualties without knowing their actual status, e.g., as a presumption until confirming data is received. Crew location data also includes data indicating crew that is on leave and/or unavailable due to health or injury. Classifying 820 includes comparing lists of PDA compartment identifications, crew status lists and crew location lists, and crew whose compartment location matches a PDA compartment location are classified as potential casualties and their names and/or identifications are placed on the potential casualty list. Process 800 may be, and preferably is, performed each time a new PDA is identified, e.g., by process 6600 described above, or each time a new hazard area is identified, e.g., by process 6100 above, or each time a new damage area or a new hazard are is confirmed, or any combination of the foregoing.

Optionally, total crew availability may be calculated 830 based upon potential crew casualties without considering whether the casualty list reports potential casualties or confirmed casualties, and further, damage control crew availability may be calculated 835 based upon the potential crew casualties without considering whether the casualty list reports potential casualties or confirmed casualties. Such calculated crew availability information may be presented 840 (e.g., displayed or otherwise reported to an operator via CCIN 250 and OCI 260) as numbers of crew available and not available, as percentage of crew available and not available, and may further be provided for crew based upon their assignments (e.g., damage control, engineering, operations or other function) and/or upon their skill or specialty (e.g., fire fighter, damage engineer, welder, and the like), or in any other manner deemed appropriate for an operator or crew monitor. Calculated 835 crew casualty data is also received 850 for further processing.

When a casualty is confirmed 845, typically by a report from a crew member at or near the PDA or other manual input, process 800 may update the crew casualty status by receiving 850 crew casualty confirmation data for identified crew, updating 855 the casualty status of the identified crew whose casualty has been confirmed to replace the potential casualty classification 830, updating 860 the crew availability status list previously calculated 835 and reported 840. Updated crew casualty data may be sent 865 to update 880 the crew casualty display presented to the operator via OCI 260 and/or to update 885 the casualty status of identified crew that may be maintained in PLMS 230. Such updated data 880, 885 may be presented in any of the ways identified previously.

Process 800 returns to process 600 of FIG. 7 until the next new PDA is identified or a crew casualty is confirmed, in which cases crew casualty assessment process 800 is again performed using the new and/or updated data.

FIG. 9B illustrates an example crew management process 8000 useful, e.g., in conjunction with the example situation assessment process 500 shown in FIG. 6, as well as at other times. Process 8000 allows the operator to manage the availability of the damage control crew and individual members thereof over the course of a damage control event, e.g., so as to assign available DC personnel to DC tasks that remain open, e.g., tasks that remain to be done or remain to be completed. Assignments need not be based only upon crew presence and casualty data, but may also be based upon the tasks to which each crew is and has been assigned and the rest periods for that crew member, so as to assist the operator to use DC crew efficiently and effectively, e.g., to provide for adequate rest as well as appropriate task assignment.

Process 8000 originates from FIG. 6 after at least one assessment 900 of stability and hull stress has been completed by MSAT 310 and a response task list has been created by MSGF 320, e.g., as in process 900 of FIG. 10, and returns to FIG. 6. Process 8000 generates a list of the available damage control crew based upon information from process 500 and the subsidiary processes 700-900 thereof. If 8020 there is a crew availability warning available for the operator, then a warning message is generated 8030 and the crew management data is updated 8040 and that updated display is displayed 8050 for the operator, e.g., by a display of OCI 260. If 8020 there is no crew availability warning available, then the crew management data need not be updated 8040 and the unchanged crew availability information remains displayed 8050 for the operator. The operator has the ability to manually input 8060 information relating to crew availability, e.g., by changing 8060 the status of individual crew members, such as from his observations or from reports of others.

The warning message generated 8030 includes the type of warning that is being sent to the operator, e.g., that a crew member has exceed a given work time and needs rest, and such warnings and work times can be different based upon the task or tasks that the crew member has been assigned. For example, a desirable work period for fighting a fire or operating a manual pump would likely be shorter than for monitoring a hatch for closure and/or leakage, and the desirable rest period after such different types of tasks might also be different, e.g., more strenuous or stressful task might indicate that a longer rest period is appropriate.

If the update is a warning, then operator input is needed, such as to force a change of status for an individual or for a damage control team, or to change the status calculation parameters that SHARP 300 employs for calculating crew status and availability. Examples of such calculation parameter changes might include, e.g., shortening times of rest or reducing team size in critical situations where the danger from a damage condition is high and crew availability is low, e.g., due to illness, casualties and/or exhaustion.

If 8070 the operator changes 8060 a status calculation parameter, then the crew status calculations for each crew member is updated 8080 for each crew member and the status of each crew member is updated 8100 accordingly. If 8070 the operator changes 8060 the status of a crew member, then the status of that crew member is updated 8100 accordingly. If 8070 the operator assigns a crew member to a task, then the status of that crew member is updated 8100 to reflect that assignment if 8130 the task remains to be completed, however, if all tasks on the task list have been completed 8140, then the status of the crew member is updated 8100 accordingly and the process returns to FIG. 6.

Updating 8080 the crew status calculations allows the operator to adjust the rest time for each crew member or team or to cancel a task and release the crew that was assigned to that task, e.g., to another task or to rest. Updating 8100 the status of a crew member typically includes calculating and/or monitoring the time that each crew member has been in each given status. This crew status data is interpreted if 8110 crew is available, 8110 YES, and if a warning situation exists 8120 YES to generate 8030 a warning for the operator and the crew management data is updated 8040, but if crew is not available, then 8110 NO follows to again generate 8010 the list of available damage control crew. If there is no crew status warning, 8120 NO, then the crew management data is updated 8040.

After process 8000 is completed and all of the damage control tasks of the task list that is generated by MSGF 320 (e.g., processes 1000-1200) have been accomplished, then the availability of damage control crew will be restored for non-damage control operations, at least over a period of time as normal work and rest times are resumed.

FIG. 10 includes FIGS. 10A and 10B which illustrate an example hull stress and stability assessment process 900 useful in the example situation assessment process 500 shown in FIG. 6. In process 900 of FIG. 10A, MSAT 310 assesses the stability of vessel 100, e.g., its seaworthiness and maneuverability, and the stress on hull 110 thereof, under the assessed and/or reported damage conditions. Typically, process 900 is performed repeatedly 910 on a regular basis, e.g., at the end of a time out period, such as every 180 seconds (three minutes), in the absence of a hazard and/or damage condition. In addition, process 900 is performed 910 as part of each damage assessment that MSAT 310 performs in response to data indicating a hazard and/or damage condition has occurred and/or exists, and in response to a request 905 from an operator, e.g., via OCI 260, for a stability and/or a hull stress assessment.

In process 900, MSAT 310 sends 915 a request for a calculation of stability and/or hull stress to flood, stability and hull stress ensemble 340 which ensemble calculates 920 the present stability and hull stress based upon the then existing data including hazard and/or damage data, e.g., based upon flooding data, manually reported physical damage to hull 110, and other data relevant to stability and hull stress. MSAT 310 receives 925 the results of the stability and hull stress calculation 920 performed by ensemble 340 and compares 930 the calculation results to the respective safe threshold values for list, trim and draft for vessel 100, although this comparison 930 may be performed by stability and hull stress ensemble 340. If 935 comparison 930 finds an unsafe condition (YES), then an alert and/or alarm thereof is sent 940 to the operator and displayed 945, e.g., via CCIN 250 and the display of OCI 260.

Thereafter, and if 935 comparison 930 does not find an unsafe condition, process 900 proceeds via junction 950 to compare 960 each point on the righting arm curve for vessel 100 and each point on the load, shear and bending moments diagrams for vessel 100 to the respective safe threshold values therefor. If 965 comparison 960 finds an unsafe condition (YES), then an alert and/or alarm thereof is sent 970 to the operator and displayed 975, e.g., via CCIN 250 and the display of OCI 260. Thereafter, and if 965 comparison 960 does not find an unsafe condition, process 900 proceeds via junction 980 to repeat 910 upon completion of the predetermined time or upon receipt of a new request or new hazard data, and process 900 also returns to process 500 of FIG. 6. Process 900 may be repeated until the system 100 is shut down.

It is noted that MSAT 310 performs process 900 under at least three different conditions. Specifically, process 900 is performed by MSAT 310 as part of the situation assessment process 500 shown in FIG. 6, e.g., in response to MSAT 310 receiving hazard and/or damage data, is performed by MSAT 310 periodically as part of process 420 shown in FIG. 5B under normal operation, and is performed by MSAT 310 at any time in response to a request made by an operator. It is also noted that process 900 may be performed in whole or in part by MSAT 310 or by stability and hull stress ensemble 340 or by another processing block.

In process 9000 of FIG. 10B, MSAT 310 assesses the stability of vessel 100, e.g., its seaworthiness and maneuverability, and the stress on hull 110 thereof, under a condition other than damage to vessel 100, such as an actual and/or a planned change in load condition resulting from, e.g., loading liquid or liquids, loading dry load material, unloading or consuming liquid or liquids, unloading or consuming dry load material, moving liquid load and/or dry load from one location on vessel 100 to another, flooding a compartment, pumping out a compartment, and the like. These day-to-day actions occur and/or are planned during normal operation of vessel 100, such as consuming fuel while cruising, consuming food and fresh water by crew and passengers, if any, adjusting list, trim and draft, moving luggage from a loading location to various compartments in connection with departure and moving luggage from various compartments to an unloading location in connection with arrival in port.

As these operations and conditions occur, stability is periodically checked by MSAT 310 of SHARP 300, e.g., under process 900 and so a stability and hull stress assessment has been generated for a present condition or for a planned condition. As data inputs for either planned load changes and/or actual load changes are received, the stability assessment is updated by MSAT 310. Process 9000 commences from process 420 of FIG. 5B, in particular process 900 of FIG. 10, if and when the stability assessment indicates that a stability hazard exists. A stability hazard may be deemed to exist under several different criteria. For example, a stability hazard exists when stability conditions exceed established vessel stability threshold levels, i.e. levels that are established based upon the design and operating dynamics of vessel 100. For example, a stability hazard may be deemed to exist when stability conditions come within a predetermined deviation from the established vessel stability threshold levels, e.g., within twenty percent (20%) of the levels that are established based upon the design and operating dynamics of vessel 100. For example, a stability hazard may be deemed to exist when stability conditions exceed a range of ordered stability conditions, i.e. levels that are established by order of the captain or other vessel personnel. Ordered stability conditions are more usually conservative than those established based upon the design and operating dynamics of vessel 100, and may be ordered for any of several reasons or for no particular reason. Among reasons for ordering stability conditions are, e.g., to reduce hull stress under a damage or flood condition, to increase seaworthiness under adverse sea conditions, to provide smoother sailing for comfort of passengers and/or crew.

Figure 11A:
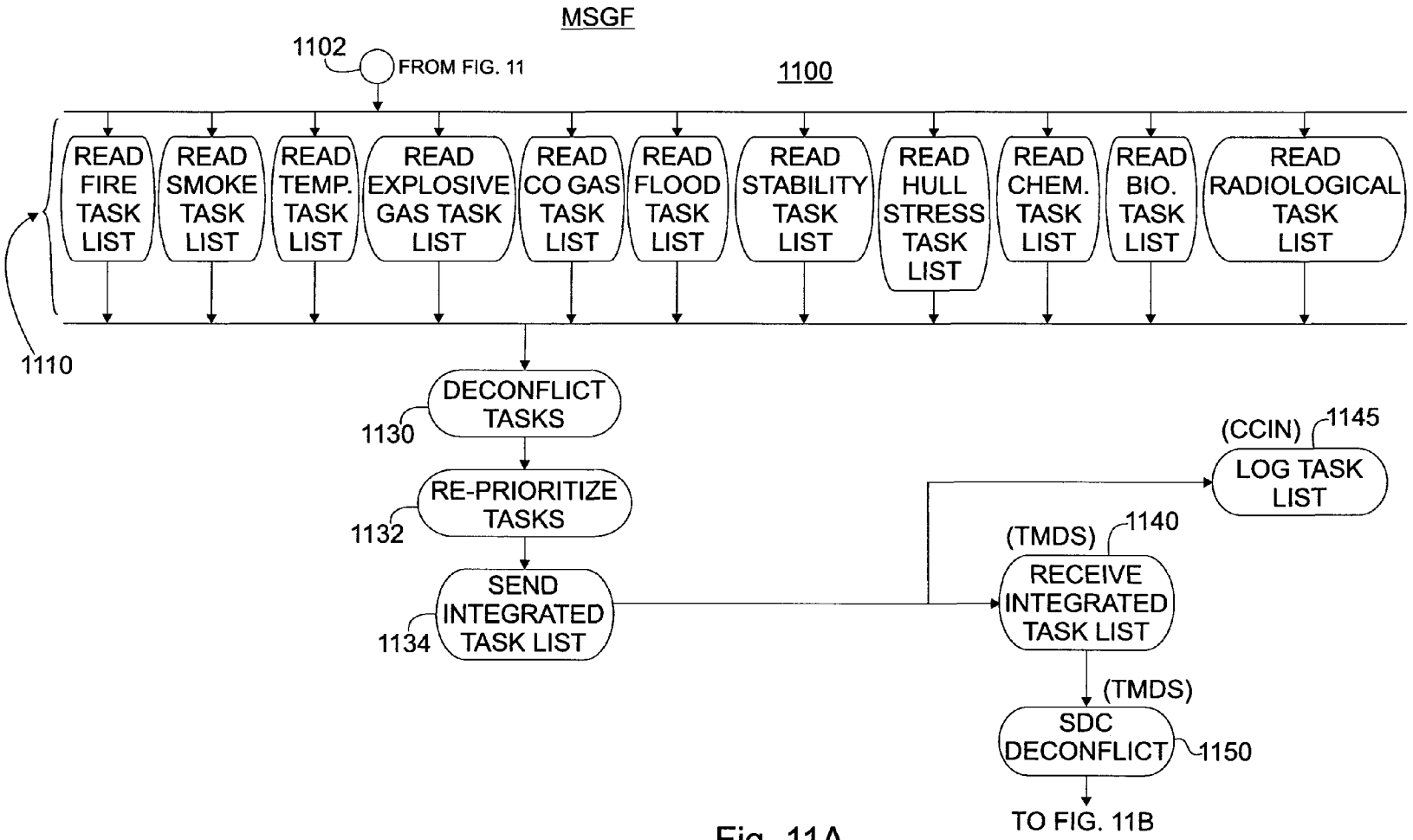
Figure 11B:
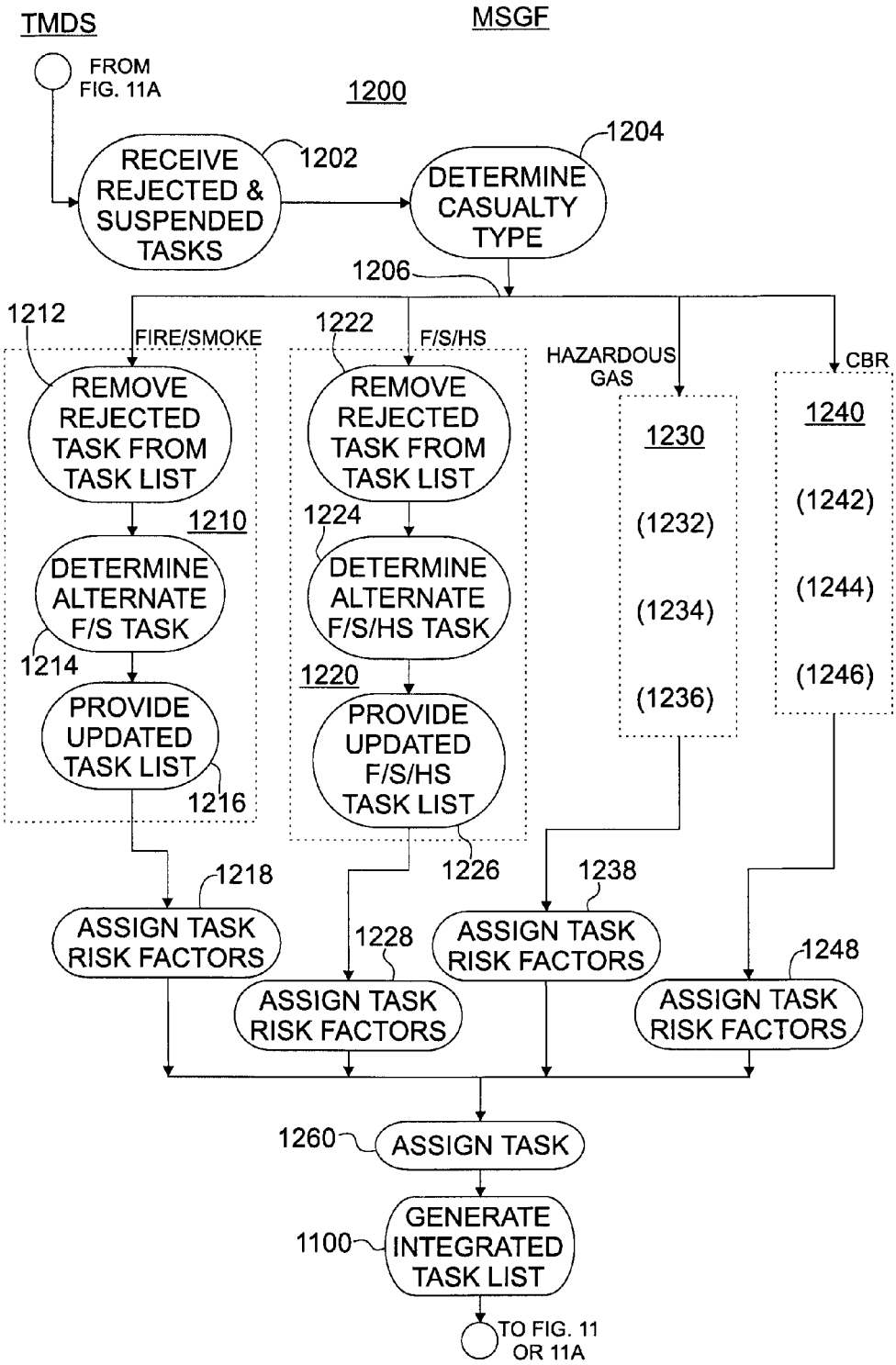

Once a stability hazard has been assessed or is anticipated 900, possible tasks for restoring stability are determined 9110 and/or updated 9110 based upon the doctrine for dealing with stability hazards, e.g., as contained in the vessel's database 252, and an integrated task list is generated 9120, e.g., as illustrated in processes 1000, 1100, 1200 of FIGS. 11-11B. In order to avoid ordering tasks that are in conflict with each other or with other vessel requirements, the integrated task list is processed 9130 by TMDS 210 which applies de-confliction rules to generate a task response for each task in the integrated list. TMDS 210 also configures tasks as directives that can be communicated/provided 9140 to the operator via OCI 260 and/or to ENSYS 220 for execution, e.g. in accordance with the selected system automation mode. SHARP 300 receives 9150 the communicated/provided 9140 task response and updates 9160 the task list maintained in SHARP 300 as the tasks are accomplished or completed.

However, if 9170 SHARP 300 cannot comply, 9170 YES, with a task provided by TMDS 210, e.g., because it conflicts with another task or would have an adverse effect upon stability, hull stress or any other vessel condition, then process 9000 returns to determining/updating stability tasks 9110 to search for alternative tasks until all tasks that cannot be complied with are either replaced by an alternative task that can be complied with or are identified to the operator via OCI 360 as being non-executable tasks. If the tasks can be complied with, 9170 NO, then they are monitored for completion 9180 in the loop 9160-9180 until all tasks are completed and process 9000 returns to process 420 of FIG. 5B.

As a result, process 9000 allows planning of operations that could affect stability and/or hull stress, and the generation and execution of tasks presented in an integrated task list from which conflicting tasks have been eliminated. Moreover, the tasks of the integrated list are executed and stability maintained in accordance with the selected automation mode.

FIG. 11 illustrates an example strategy formulation process 1000 useful in the example damage control arrangement 300 of FIGS. 1-3 and includes FIGS. 11A through 11B illustrating example task generation processes 1100-1200 useful therein. Process 1000 responds to damage control situation assessments generated by situation assessment element (MSAT 310) 310 to formulate a strategy for responding to the assessed hazard and/or damage condition. Strategies formulated by MSGF 320 are based upon, e.g., the types and classifications of hazard/damage represented in the assessment data, the availability of vessel systems including damage control systems, casualty and crew availability, and other assessment data. Strategy formulations generated by MSGF 320 are typically in the form of lists of tasks to be performed by vessel systems and crew, including damage control personnel.

It is noted that MSGF 320 includes a number of "toolkits" relating to various hazard conditions that contain various "tools" or possible responses that are useful in determining what responses may be advisable and which of those responses may be appropriate under the given circumstances. The toolkits contain lists of actions, e.g., containment actions such as closing doors and hatches, and setting boundaries, and extinguishing actions such as sprinkling, isolating, flooding and the like. The models, on the other hand, such as models 330-370, are analytical tools that are external to MSGF 320 and these models determine what effects the tools selected by MSGF 320 from its toolkits to address a particular hazard would have if they were to be used (implemented) in the present hazard circumstance. Each of models 330-370 may be a scenario-based model, a physics-based model, a real-time model, a decision-tree model, a doctrine-based model, a rules-based model, a cellular automation model, or any other type of model as may be appropriate to model a particular hazard.

Fire and smoke (CFS) model 330 prioritizes the fire/smoke boundary response actions proposed by MSGF 320 based on the hazard and risk to the survivability of vessel 100 associated with the particular hazard at hand. CFS model 330 receives casualty data, sensor information and proposed response tasks from MSGF 320. CFS model 330 the employs a methodology whereby a database containing records including rules for pre-determined fire/smoke spread scenarios is correlated with real-time sensor data to evaluate in the time domain the potential risk to vessel 100 associated with the currently sensed hazard(s) and to assign priorities to proposed doctrine-based response task(s). CFS model 330 then provides a prioritization of the proposed boundary task list for each fire/smoke hazard. Upon a change in hazard conditions, an updated manual data input, or rejection of a boundary task proposed by MSGF 320, CFS model 330 will be run again to generate a new prioritization of each new fire/smoke boundary task list. This prioritization of boundary tasking by CFS model 330 will occur for every task list that MSGF 320 proposes to address a fire/smoke related hazard.

Flooding, stability and hull stress (SSH) model 340 provides a dual function which includes providing MSAT 310 with the ability to quickly evaluate the vessel's stability and hull stress for intact, damaged, and grounded conditions, and prioritizing the flooding, stability and hull stress mitigation tasks proposed by MSGF 320 based on the associated risk to vessel 100. SSH model 340 receives stability related inputs (e.g., sensor data, manual data, wind data, and wave data) from MSAT 310 and proposed response tasks from MSGF 320. SSH model 340 then uses doctrine-based computer generated flooding, stability and hull stress analysis models to evaluate the risk to vessel 100 from the proposed task(s) in the time domain against the flooding, stability and/or hull stress hazard(s) at hand. With respect to stability, the stability analysis model is preferably made specific for the particular vessel in its then-present actual configuration, e.g., including the hull and structural configuration and the equipment/machinery installed. SSH model 340 then prioritizes the proposed response task list for each hazard or for multiple hazards, as the case may be. If there is a change in the hazard situation or rejection of proposed response task(s), SSH model 340 will be run again to generate a new prioritization of each subsequent task list. This prioritization of tasking by SSH model 340 will occur for every task list that MSGF 320 proposes as a response to a stability and/or hull stress related hazard. SSH model 340 has the capability to perform its dual functions simultaneously and independently.

CBR model 350 prioritizes CBR mitigation response actions proposed by MSGF 320 based on the hazard and risk to the vessel 100 survivability associated with the particular hazard at hand. The CBR model 350 receives hazard sensor data from MSAT 310 via MSGF 320 and also receives from MSGF 320 response tasks proposed for mitigating the detected/sensed CBR hazard. CBR model 350 then employs a methodology whereby a database containing records including rules for pre-determined CBR propagation and/or spreading patterns is correlated with real-time sensor data to evaluate in the time domain the potential risk to vessel 100 associated with the current hazard(s) and to assign priorities to proposed doctrine-based response task(s). CBR model 350 then provides a reordered version of the task list proposed by MSGF 320. This reordering of the proposed MSGF task list by CBR model 350 will be performed for every task list propose by MSGF 320 to address any CBR hazard.

Industrial and hazardous gas model 360 typically functions in a manner similar to that of fire and smoke model 330 in prioritizing responses to a smoke hazard because, e.g., both typically involve containment and/or ventilation responses. Optional model 370 will function in a manner appropriate to whatever other hazard it models.

Strategy formulation process 1000 is performed by strategy formulation element (MSGF 320) 320 in response to being triggered 1010 by situation assessment data sent by situation assessment process 500, e.g., from MSAT 310. MSGF 320 reads 1020 hazard area and damage area data, identifies 1022 the compartment types therein, and determines 1024 the hazard type for each damage area so that the situation assessment data is "filtered" by hazard type so that it can be communicated to the appropriate one of hazard models 330-370 for processing thereby. Models 330-370 may be physics-based models, scenario-based models, time integrating models and/or real time models, as may be available and desirable for cooperating with MSGF 320 for formulating a strategy for responding to hazards and damage conditions. MSGF 320 includes certain "toolkits" that contain tasks may be employed in the strategy formulated to address particular hazards.

If 1026 the determined 1024 hazard type includes a fire or smoke hazard, then process 1000 utilizes fire/smoke ensemble 330 to determine 1030 or generate 1030 task actions to respond to the fire and/or smoke situation based upon vessel system status and crew availability and to provide 1032 a list of tasks (e.g., an action list or task list) to be taken to respond to the fire/smoke hazard/damage situation. Preferably, at this point the tasks listed are considered proposed tasks that will be integrated with tasks generated for responding to other types of hazard/damage to generate a combined or integrated list of tasks from which conflicting tasks and unwise tasks are eliminated. Toward that end, fire/smoke model 330 assigns 1034 a risk factor to each of the tasks listed for responding to the fire and/or smoke hazard condition.

If 1026 the determined 1024 hazard type includes flooding, stability and/or hull stress hazards, then process 1000 utilizes flood, stability, hull stress ensemble 340 to determine 1040 or generate 1040 task actions to respond to the flooding, stability and/or hull stress situation based upon vessel system status and crew availability and to provide 1042 a task list for responding to the flooding, stability and/or hull stress hazard/damage situation. Preferably, at this point the tasks listed are considered proposed tasks that will be integrated with tasks generated for responding to other types of hazard/damage to generate a combined or integrated list of tasks from which conflicting tasks and unwise tasks are eliminated. Toward that end, flood, stability, hull stress model 340 assigns 1044 a risk factor to each of the tasks listed for responding to the flooding, stability and/or hull stress hazard condition.

If 1026 the determined 1024 hazard type includes a chemical, biological and/or radiological (CBR) hazard, then process 1000 utilizes CBR ensemble 350 to determine 1050 or generate 1050 task actions to respond to the CBR situation based upon vessel system status and crew availability and to provide 1062 a task list for responding to the hazardous gas hazard/damage situation. Preferably, at this point the tasks listed are considered proposed tasks that will be integrated with tasks generated for responding to other types of hazard/damage to generate a combined or integrated list of tasks from which conflicting tasks and unwise tasks are eliminated. Toward that end, model 350 assigns 1054 a risk factor to each of the tasks listed for responding to the CBR hazard condition.

If 1026 the determined 1024 hazard type includes a hazardous gas (industrial or hazardous gas) hazard, then process 1000 utilizes hazardous gas ensemble 360 to determine 1060 or generate 1060 task actions to respond to the hazardous gas situation based upon vessel system status and crew availability and to provide 1042 a task list for responding to the hazardous gas hazard/damage situation. Preferably, at this point the tasks listed are considered proposed tasks that will be integrated with tasks generated for responding to other types of hazard/damage to generate a combined or integrated list of tasks from which conflicting tasks and unwise tasks are eliminated. Toward that end, model 360 assigns 1064 a risk factor to each of the tasks listed for responding to the hazardous gas hazard condition.

If 1026 the determined 1024 hazard type includes another type of hazard, then process 1000 utilizes other hazard model 370 to generate task lists in similar manner to that described in relation to the preceding steps 1030-1064.

For each of the task lists and risk factors assigned 1034, 1044, 1054, 1064, process 1000 prioritizes and assigns 1080 a task priority to each of the tasks on each list based upon the respective risk factors, e.g., to favor those response tasks that are likely to effectively respond to the particular hazard/damage situation on each list without excessive risk to vessel 100 and its mission. Thereafter, the prioritized 1080 task lists for each type of hazard are integrated 1100, 1200 into a single task list, e.g., an integrated task list, as is now described.

Process 1100 shown in FIG. 11A generates 1100 an integrated (combined) task list from the separate prioritized task lists generated 1030-1080 for each type of hazard, wherein the integrated task list is prioritized according to the hazard severity and risk to vessel 100. When triggered 1102 by receipt of task lists from process 1000, process 1100 reads 1110 each available one of the respective prioritized task lists, including a fire task list, a smoke task list, a temperature task list, an explosive gas task list, a CO gas task list, a flood task list a stability task list, a hull stress task list, a chemical task list, a biological task list and a radiological task list.

Process 1100 "de-conflicts" 1130 the tasks contained in the combined tasks from all available task lists. "De-conflicting" means that where one task is in conflict with another task, one of those tasks is removed from the list of tasks by applying predetermined de-conflicting rules, and typically the task that would have a deleterious effect or that would counter what a higher priority task seeks to accomplish or would be contrary to a higher priority task is removed. The tasks remaining in the task lists after de-conflicting 1130 are re-prioritized 1132 according to the assessed integrated hazard situation for generating a combined (integrated) prioritized task list which is sent 1134 by MSGF 320 to CCIN 250 for logging 1145 in the appropriate databases thereof and to TMDS 210 which receives 1040 the integrated task list for further de-conflicting 1150 at the vessel level taking into account other tasks and mission operations, e.g., non-damage control tasks, that need to be implemented either on a higher priority or to avoid contrary or conflicting actions.

The last step in process 1100 includes TMDS 210 de-conflicting 1150 the prioritized identified damage control tasks on the integrated task list that are, e.g., in conflict with another vessel level task and/or of lesser priority than another vessel level task. Vessel level de-conflicting 1150 may include rejecting certain tasks, e.g., damage control tasks that are contrary to vessel-level tasks and/or actions that are necessary at the vessel level or that are of higher priority than damage control tasks, and may include suspending certain damage control tasks, e.g., damage control tasks that are of lower priority than vessel-level tasks and/or for which necessary resources are unavailable. A de-conflicted integrated task list is returned to MSGF 320 by TMDS 210 for performance of task list revision process 1200 thereon as shown in FIG. 11B.

Task list revision process 1200 removes from the integrated task list tasks that are rejected and/or suspended by TMDS 210 in de-conflicting step 1150 of process 1100 and generates a revised integrated damage control task list for action. Specifically, MSGF 320 receives 1202 rejected and suspended tasks from TMDS 210 and determines 1204 the hazard and/or casualty type to which such rejected and/or suspended tasks pertain. In general, MSGF 320 seeks tasks that are alternatives to rejected and suspended tasks, however, rejected and suspended tasks are marked as rejected and/or suspended and, if no alternative task is available, no other task is sent.

If 1206 a rejected task relates to a fire and/or smoke type hazard, then process 1210 removes 1212 that rejected fire/smoke task from the list of available fire/smoke tasks, determines 1214 alternative fire and/or smoke tasks, if any, and provides (generates) 1216 an updated fire/smoke task list which is communicated to model 330 which assigns 1218 risk factors to the fire/smoke tasks on the updated fire/smoke task list. If no alternative task is available, no other task is sent.

If 1206 a rejected task relates to a flood, stability and/or hull stress (F/S/HS) type hazard, then process 1220 removes 1222 that rejected flood, stability and/or hull stress task from the list of available flood, stability and/or hull stress tasks, determines 1224 alternative flood, stability and/or hull stress tasks, if any, and provides (generates) 1226 an updated flood, stability and/or hull stress task list which is communicated to model 340 which assigns 1228 risk factors to the flood, stability and/or hull stress tasks on the updated flood, stability and/or hull stress task list. If no alternative task is available, no other task is sent.

If 1206 a rejected task relates to a hazardous gas type hazard, then process 1230 removes 1232 that rejected hazardous gas task from the list of available hazardous gas tasks, determines 1234 alternative hazardous gas tasks, if any, and provides (generates) 1234 an updated hazardous gas task list which is communicated to model 360 which assigns 1238 risk factors to the hazardous gas tasks on the updated hazardous gas task list. If no alternative task is available, no other task is sent.

If 1206 a rejected task relates to a CBR type hazard, then process 1240 removes 1242 that rejected CBR task from the list of available CBR tasks, determines 1244 alternative CBR tasks, if any, and provides (generates) 1244 an updated CBR task list which is communicated to model 350 which assigns 1248 risk factors to the CBR tasks on the updated CBR task list. If any other models 370 are utilized, then the processing of the task list(s) relating thereto would be similar to that described in relation to the hazards to which models 330-360 pertain. If no alternative task is available, no other task is sent.

After all of the hazard-typed task lists are updated 1210, 1220, 1230, 1240 and assigned 1218, 1228, 1238, 1248 risk factors, risk factors are assigned 1260 to each task on each of the task lists, e.g., based upon the respective assigned risk factors, and an updated integrated damage control task list is generated, e.g., by repeating process 1100 described above or by another suitable process. Preferably, the updated integrated task list is generated utilizing process 1100 followed by de-conflicting 1150 at the vessel level and is again updated utilizing process 1200, e.g., in a loop, until no rejected tasks are received from TMDS 210 at which event the updated de-conflicted integrated damage control task list is available for implementation, and processing returns to process 1000 of FIG. 11 and to process 400 of FIG. 5 and/or process 500 of FIG. 6.

It is desirable that the processing described from the receipt of data indicating that a hazard and/or damage condition has occurred until an updated integrated damage control task list is available for implementation be completed in a relatively short time, e.g., within one minute, which is less than the periodic status check time, e.g., three minutes, of normal operation monitoring process 400. The task list is available for implementation when it is executed if SHARP system 300 is in the autonomous mode of operation, and when it is displayed by OCI 260 for an operator and/or crew member if SHARP system 300 is in the operator assist or operator support modes of operation.

Figure 12A:
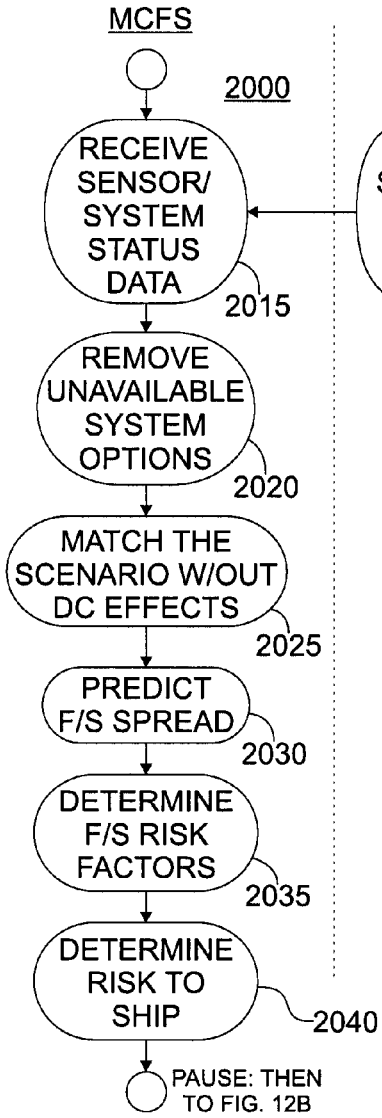
FIG. 12 illustrates an example fire and smoke hazard model feature for the example damage control arrangement of FIGS. 1-3 and comprises FIGS. 12A through 12B illustrating model processing features thereof.
Figure 12B:
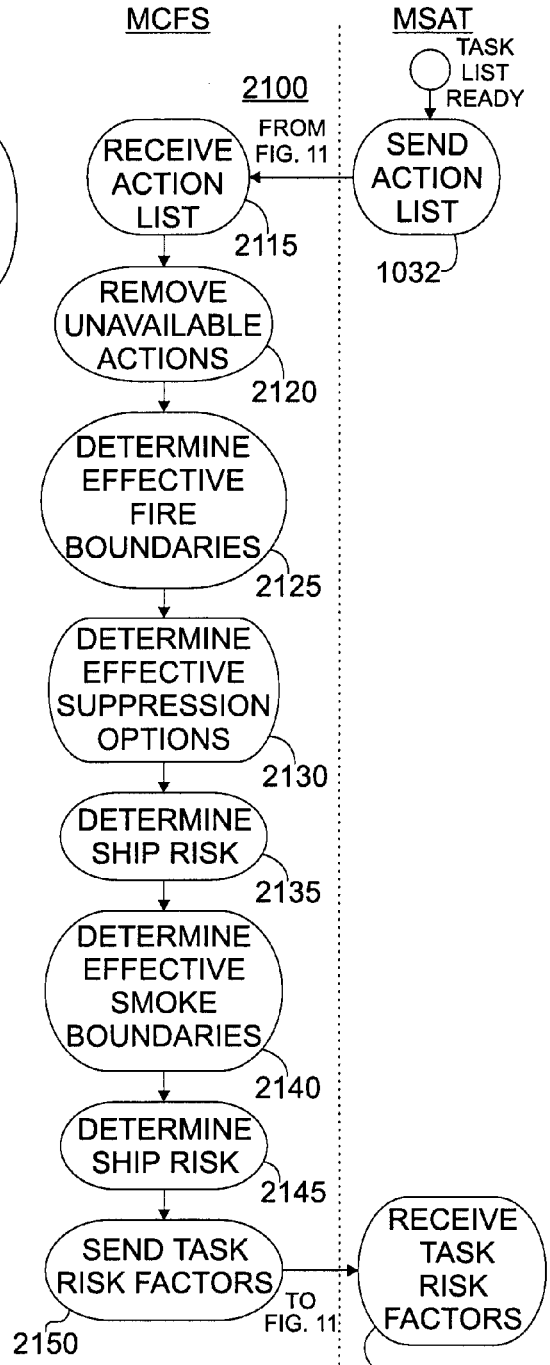

FIG. 12 illustrates an example fire and smoke hazard model 330 feature for the example damage control arrangement 300 of FIGS. 1-3 and comprises FIGS. 12A through 12B illustrating model processing features 2000, 2100 thereof. Conditions processed by model 330 may include, e.g., sensed fire indicators, fire alarms, sensed smoke and/or other products of combustion, smoke alarms, excessive temperature, high temperature, and any combination thereof. Model 330 operates in a modeling process 2100 for fire and/or smoke hazards in cooperation with MSGF 320 to formulate one or more strategies to respond to the sensed fire/smoke conditions. Optionally, and preferably, model 330 also operates in a preparation process 2000 in cooperation with MSAT 310 while MSAT 310 is generating a situation assessment, e.g., before MSGF 320 can issue a request to model 330, thereby to prepare model 330 for cooperation with MSGF 320 for reducing the processing time for formulating strategies responsive to that assessed fire/smoke situation.

Preparation process 2000 shown in FIG. 12A commences with MSAT 310 sending 2010 sensor and/or system status data while MSAT 310 is assessing the hazard and/or damage situation. This alerts model 330 that a strategy formulation will be performed. Sensor and/or system status data is received 2015 by fire/smoke model 330 whereby fire/smoke model "knows" which of the vessel's sensors and/or systems, including hardware HM&E equipment, computer resources and software resources, are available for use in responding to a hazard and/or damage condition and which are not available. Unavailable system function options are "removed" 2020 from the database of response options so that in cooperatively formulating strategies with MSGF 320, model 330 does not waste processing time and processing resources considering responses that cannot be implemented. It is noted that while unavailable options are said to be "removed," they may in fact remain in the database and be marked or flagged as being unavailable so that processes 2000, 2100 thereafter treat them as if they had been removed.

Process 2000 next matches 2025 the hazard and available response scenarios contained in its database with the thus far assessed hazard/damage, predicts 2030 therefrom the likely spread of fire and/or smoke based thereon, determines 2035 therefrom fire and/or smoke risk factors for each affected compartment, and determines 2040 therefrom the risk to the vessel, e.g., to its operability, mission and survival. The foregoing processing 2025-2040 is at this juncture understood to be "preliminary" or "tentative" because MSAT 310 may not have completed assessing the hazard and/or damage situation and because MSGF 320 has not yet processed the assessment data from MSAT 310 to formulate a response strategy.

At the end of process 2000, model 330 typically pauses and awaits a request from MSGF 320 to cooperate in formulating a response strategy, e.g., utilizing process 2100 shown in FIG. 12B. In process 2100, model 330 having paused after process 2000, receives 2115 an action list generated and sent 3010 by MSGF 320 "removes" 2120 from its database of response actions those actions that are not available as response options, based upon either or both of the previously received 2015 data or data included in the action list sent 1032 by MSGF 320. Removing may involve marking or flagging as described above.

Process 2100 determines 2125 based on the available actions the most effective fire boundaries, e.g., where and to which compartments the fire may be contained, and determines 2130 the effectiveness of various available fire suppression options. Utilizing risk factors determined 2040 in process 2000 for each compartment, the risk to vessel 100 from fire is determined 2135 for each of the tasks on the action list that was sent 1032 by MSGF 320. Similarly, process 2100 determines 2140 based on the available actions the most effective smoke boundaries, e.g., where and to which compartments smoke may be contained, e.g., considering various available smoke options such as containment and ventilation.

Utilizing risk factors determined 2040 in process 2000 for each compartment, the risk to vessel 100 from smoke is determined 2145 for each of the tasks on the action list that was sent 1032 by MSGF 320. Task by task risk factors, e.g., for fire and for smoke, for each compartment and/or for the vessel are sent 2150 to MSGF 320 which receives 1034 same for use in process 1000.

Figure 13:
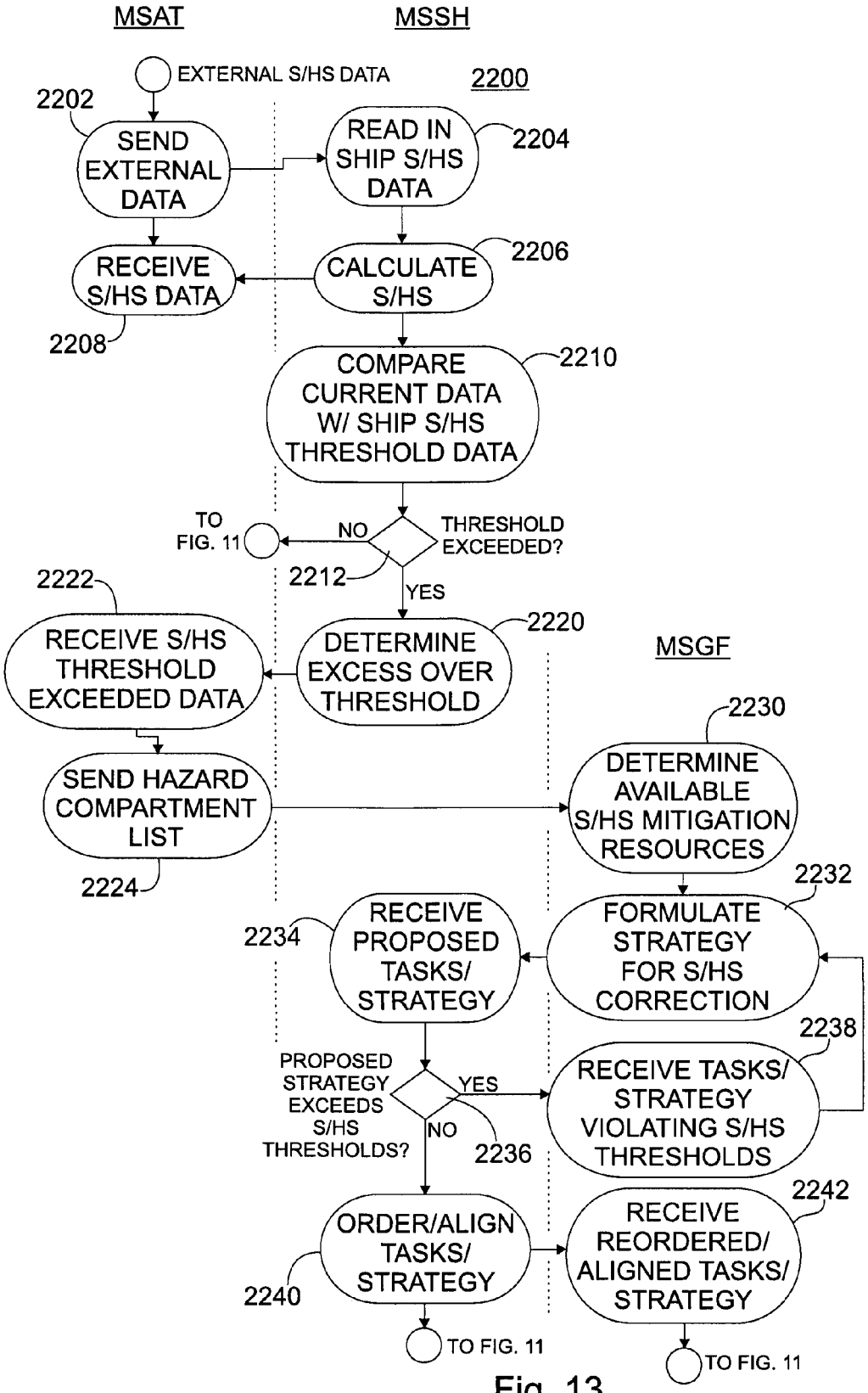
FIG. 13 illustrates an example flooding, stability, hull stress model feature for the example damage control arrangement of FIGS. 1-3.

FIG. 13 illustrates an example flooding, stability, hull stress SSH model 340 feature for the example damage control arrangement 300 of FIGS. 1-3 illustrating model processing features 2200 thereof. Model 340 operates in a modeling process 2200 for flooding, stability and/or hull stress hazards in cooperation with MSGF 320 to formulate one or more strategies to respond to the sensed flooding, stability, hull stress conditions. Optionally, and preferably, model 340 also operates in a preparation process in cooperation with MSAT 310 while MSAT 310 is generating a situation assessment, e.g., before MSGF 320 can issue a request to model 340, thereby to prepare model 340 for operation with MSGF 320 and reduce processing time for formulating strategies responsive to that assessed flooding, stability, hull stress situation.

Process 2200 commences with MSAT 310 sending 2202 stability and hull stress data, e.g., external data, to SSH model 340 which reads 2204 that data and calculates 2206 the present state of vessel stability and hull stress. The calculation 2206 may, e.g., be similar to process 900 described above. MSGF 320 communicates 2208 the calculated 2206 stability and hull stress state data to MSAT 310 where it may be utilized in other processes, e.g., process 420, 500, and/or 900. The external data communicated 2202, 2204 to SSH model 340 may typically include wind direction and speed information, wave direction and height information, vessel heading and speed, and the like, and may also account for spent fuel, liquid and dry stores, liquid transfer, ballast, and sea state conditions.

The calculated 2206 stability and hull stress data, e.g., the present stability/hull stress data, is compared 2210 with vessel stability and hull stress threshold data, e.g., as stored in a database maintained on CCIN 250. Such thresholds define the limits of acceptable and/or safe stability parameters and of acceptable and/or levels of stress that may be applied to the hull. Such limits are determined by the design of the vessel, and not by particular sensed hazards. Next is determined 2212 if the calculated 2206 value of any stability and/or hull stress parameter exceeds the established threshold therefor. If no calculated stability and hull stress parameter exceeds the threshold therefor 2212 [NO], then process 2200 ends and returns to FIG. 11.

If, however, the calculated 2206 value of any stability and/or hull stress parameter does exceed the threshold therefor 2212 [YES], then process 2200 determines 2220 the extent of such excess, e.g., as a percentage of the threshold or limit, and communicates 2222 the stability and hull stress data that exceeded the threshold, e.g., stability and hull stress alerts and alarms, to MSAT 310 and MSAT 310 communicates 2224 a list of hazard compartments and the stability and hull stress alerts and alarms to MSGF 320. It is noted that while stability and hull stress alerts and alarms are communicated with the list of hazard compartments, stability and hull stress, and any alerts or alarms pertaining thereto, are for the entire vessel and are not specific to any compartment or compartments.

MSGF 320 utilizes the hazard compartment list and the stability and hull stress alerts and alarms from 2224 MSAT 310 to determine 2230 those of the stability and hull stress mitigation resources in its toolkit that are available for safe utilization under the present hazard and stability/hull stress conditions. MSGF 320 formulates 2232 from the available stability/hull stress mitigation resources a proposed task and/or strategy (or tasks/strategies) for responding to the present stability/hull stress condition and communicates 2234 same to SSH model 340. SSH model 340 determines 2236 from the received 2234 proposed tasks/strategies for mitigating the stability/hull stress hazard and the acceptable thresholds/limits if the proposed strategy 2232 would cause vessel 100 to exceed any stability and/or hull stress threshold.

If any proposed strategy would cause vessel 100 to exceed any stability or hull stress threshold 2236 [YES], then SSH model 340 in effect rejects such proposed strategy and communicates 2238 to MSGF 320 the strategies that would cause vessel 100 to exceed (violate) a threshold and MSGF 320 utilizes same to again formulate 2232 tasks and/or strategies that do not include the rejected 2236 proposed tasks and/or strategies. MSGF 320 and SSH model 340 continue performing steps 2232, 2234, 2236 and 2238 of process 2200 until a set of proposed tasks and/or strategies results 2236 that do not include any task or strategy that would cause vessel 100 to exceed (violate) any stability and/or hull stress threshold 2236 [NO].

SSH model 340 then orders and aligns 2240 the tasks associated with the acceptable 2236 [NO] proposed strategy or strategies, and the acceptable strategy or strategies, in an order and/or priority to achieve maximum effectiveness in mitigating the stability and/or hull stress condition when those tasks and strategies are implemented, and communicates 2242 the ordered and aligned tasks/strategies to MSGF 320, and process 2200 (i.e. both MSGF 320 and SSH model 340) returns to FIG. 11.

Figure 14A:
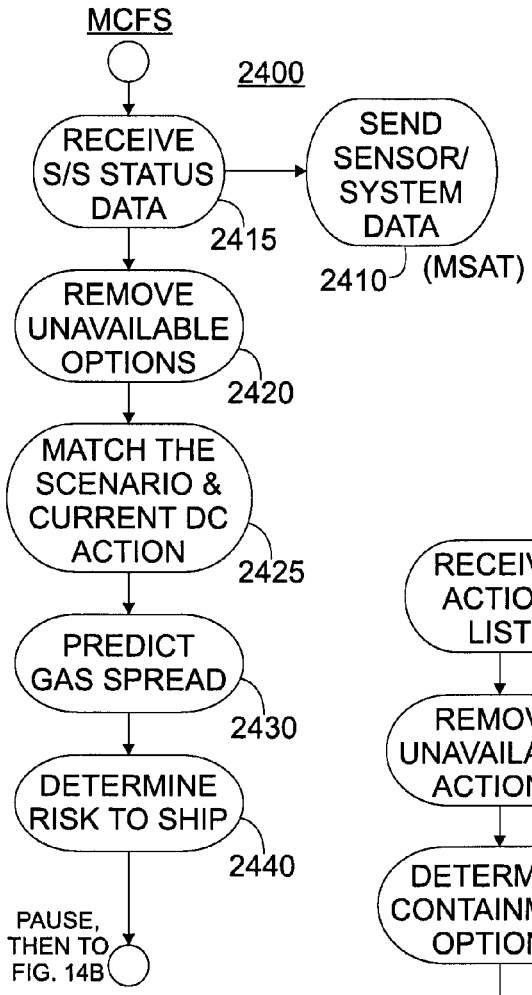
FIG. 14 illustrates an example hazardous gas hazard model feature for the example damage control arrangement of FIGS. 1-3 and comprises FIGS. 14A through 14B illustrating model processing features thereof.
Figure 14B:
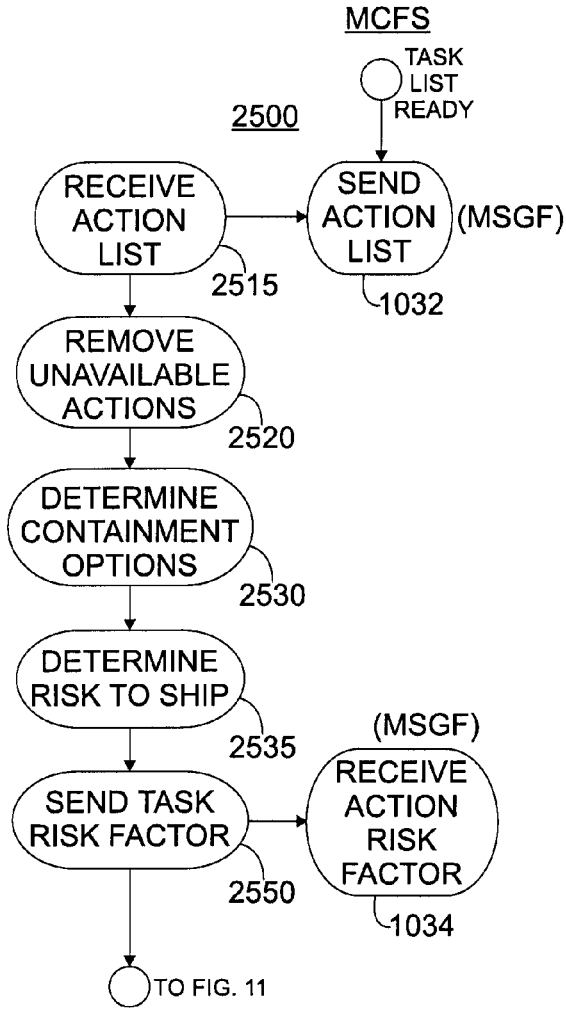

FIG. 14 illustrates an example hazardous gas hazard model 360 feature for the example damage control arrangement 300 of FIGS. 1-3 and comprises FIGS. 14A through 14B illustrating model processing features 2400, 2500 thereof. Hazardous gases may include, e.g., explosive gas, flammable gas, corrosive gas, carbon monoxide (CO), toxic gas, fumes that may be explosive, flammable, corrosive, toxic and the like, and any combination thereof. Model 360 operates in a modeling process 2500 for hazardous gas hazards in cooperation with MSGF 320 to formulate one or more strategies to respond to the sensed hazardous gas conditions. Optionally, and preferably, model 360 also operates in a preparation process 2400 in cooperation with MSAT 310 while MSAT 310 is generating a situation assessment, e.g., before MSGF 320 can issue a request to model 360, thereby to prepare model 360 for operation with MSGF 320 for reducing the processing time for formulating strategies responsive to that assessed hazardous gas situation.

Preparation process 2400 shown in FIG. 14A commences with MSAT 310 sending 2410 sensor and/or system status data while MSAT 310 is assessing the hazard and/or damage situation. This alerts model 360 that a strategy formulation will be performed. Sensor and/or system status data is received 2415 by hazardous gas model 360 whereby hazardous gas model "knows" which of the vessel's sensors and/or systems, including hardware HM&E equipment, computer resources and software resources, are available for use in responding to a hazard and/or damage condition and which are not available. Unavailable system function options are "removed" 2420 from the database of response options so that in cooperatively formulating strategies with MSGF 320, model 360 does not waste processing time and processing resources considering responses that cannot be implemented. It is noted that while unavailable options are said to be "removed," they may in fact remain in the database and be marked or flagged as being unavailable so that processes 2400, 2500 thereafter treat them as if they had been removed.

Process 2400 next matches 2425 the hazard and available response scenarios contained in its database with the thus far assessed hazard/damage, predicts 2430 therefrom the likely spread of hazardous gas based thereon, and determines 2440 therefrom the risk to the vessel, e.g., to its operability, mission and survival, from hazardous gas. The foregoing processing 2425-2040 is at this juncture understood to be "preliminary" or "tentative" because MSAT 310 may not have completed assessing the hazard and/or damage situation and because MSGF 320 has not yet processed the assessment data from MSAT 310 to formulate a response strategy.

At the end of process 2400, model 360 typically pauses and awaits a request from MSGF 320 to cooperate in formulating a response strategy, e.g., utilizing process 2500 shown in FIG. 14B. In process 2500, model 360 having paused after process 2400, receives 2515 an action list generated and sent 1032 by MSGF 320, and "removes" 2520 from its database of response actions those actions that are unavailable as response options, based upon either or both of the previously received 2415 data or data included in the action list sent 1032 by MSGF 320. Removing may involve marking or flagging as described above.

Process 2500 determines 2530 based on the available actions the most effective hazardous gas containment options, e.g., where and to which compartments the hazardous gas may be contained. Utilizing risk factors determined 2440 for each compartment in process 2400, the risk to vessel 100 from hazardous gas is determined 2535 for each of the tasks on the action list that was sent 1032 by MSGF 320. Thereby process 2500 determines where and to which compartments hazardous gas may be contained, e.g., considering various available hazardous gas options such as containment and ventilation.

Utilizing risk factors determined 2440 for each compartment in process 2400, the risk to vessel 100 from hazardous gas is determined 2535 and sent 2550 for each of the tasks/actions on the action list that was sent 1032 by MSGF 320. Thus, task by task risk factors for hazardous gas for each compartment are sent 2550 to MSGF 320 which receives 1034 same for use in process 1000.

Figure 15:
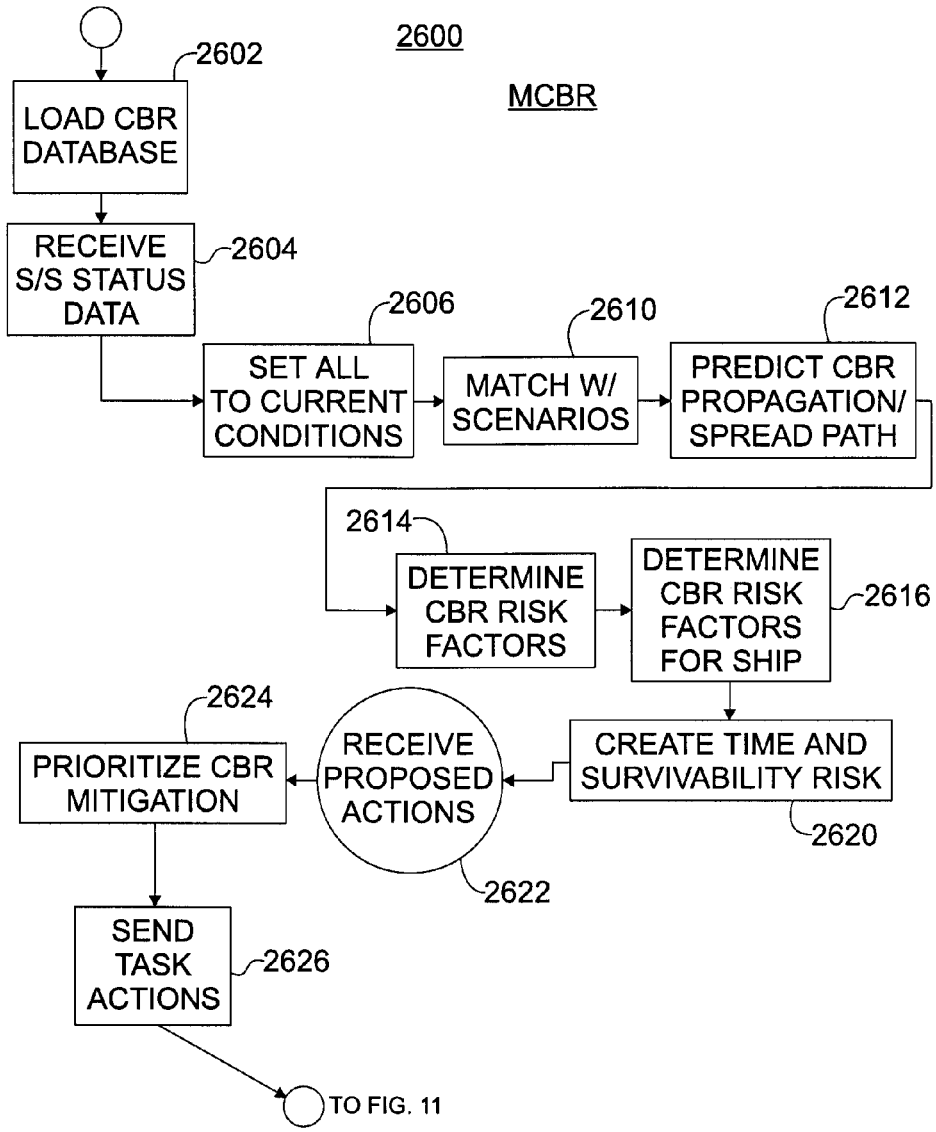
FIG. 15 illustrates an example chemical, biological, radiological hazard model feature for the example damage control arrangement of FIGS. 1-3.

FIG. 15 illustrates an example chemical, biological, radiological hazard model 350 feature for the example damage control arrangement 300 of FIGS. 1-3 illustrating model processing features 2600 thereof. CBR model 350 (MCBR) operates in a modeling process 2600 for CBR hazards in cooperation with MSGF 320 to formulate one or more strategies to respond to the sensed CBR conditions. Optionally, and preferably, CBR model 350 also operates in a preparation process in cooperation with MSAT 310 while MSAT 310 is generating a situation assessment, e.g., before MSGF 320 can issue a request to model 350, thereby to prepare model 350 for operation with MSGF 320 for reducing the processing time for formulating strategies responsive to that assessed CBR situation.

Process 2600 commences with the loading 2602 of a CBR database of chemical, biological and radiological agents, rule-based CBR mitigation actions and criteria, information (e.g., lessons learned) from previous CBR events an mitigation efforts, and the like, that is utilized by CBR model 350 to model CBR events. This loading 2602 is part of the initialization or start-up process for CBR model 350 after which it is in an operational state and ready to model CBR hazard data, and the CBR database may be loaded from CCIN 250.

CBR model 350 receives 2604 CBR hazard data from MSAT 310 via MSGF 320 that represents chemical, biological and/or radiological agents, the locations thereof, e.g., by compartment and/or area, and concentrations thereof. Such data may be from CBR sensors of vessel 100 and/or from reports of CBR conditions manually inputted by the crew or by an operator. CBR model 350 then matches 2606 the present condition of vessel 100 (e.g., at the then present time) by setting 2606 all of the conditions for CBR model 350 to the current conditions of vessel 100, including sensed and reported CBR hazard data. CBR model 350 then processes that data by comparing 2610 it against scenarios contained in the loaded CBR database to predict 2612 the propagation and/or spread path and timing of the CBR hazard vessel condition data 2606, e.g., taking into account the concentration of CBR agents and the size and location of each affected compartment and/or space, and the like. Processing 2610 may include comparison of the present conditions to the scenarios contained in the database.

CBR risk factors are then determined 2614 for each compartment and area based upon the CBR hazards sensed and/or reported therefor and the predicted 2612 propagation and spread thereof. The CBR risk factors for each compartment are utilized to determine 2616 the CBR risk factors for the crew compartments (e.g., risks to personnel by the CBR hazard) and for vessel 100 in its entirety (e.g., risk to the survivability and/or future operability of vessel 100 due to the CBR hazard per se and due to crew casualties). CBR model 350 then generates 2620 a time line from the time of the present assessment until a future time, e.g., 60 minutes, of the risk to crew and to the survivability of vessel 100. This time line preferably includes a time line for each compartment and/or space affected by the CBR hazard as well as considering the percentage of crew available, e.g., considering the effect of casualties from the CBR hazard and other hazards.

The foregoing serves to set up CBR model 350 to receive and model CBR conditions and proposed response strategies generated by MSGF 320. CBR model 350 receives 2622 proposed task actions (strategies) generated by MSGF 320 utilizing its toolkits for formulating response strategies, e.g., proposed tasks and/or actions for mitigating the CBR hazard and/or its propagation and/or spread. CBR model 350 then prioritizes 2624 the mitigation tasks and actions proposed by MSGF 320 based upon the determined risk factors (e.g., 2614, to the crew and/or to the vessel) and the mitigation criteria included in the database loaded 2602 from CCIN 250. The prioritized (re-ordered) mitigation tasks and actions are communicated 2626 to MSGF 320 for implementation and de-confliction, and process 2600 ends and returns to FIG. 11.

Figure 16A:
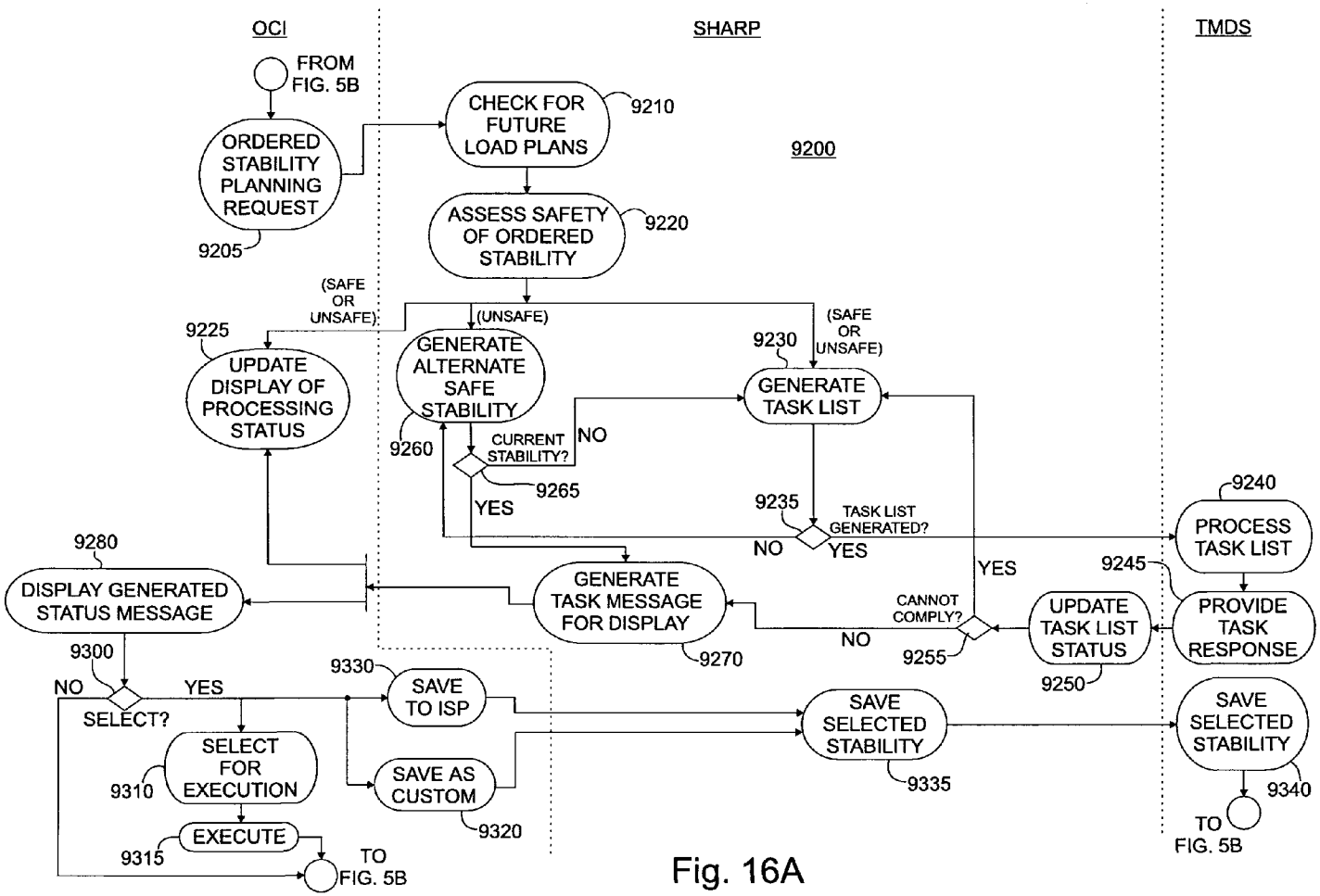
FIG. 16 illustrates example planning processes for the example damage control arrangement of FIGS. 1-3 and comprises FIGS. 16A through 16B illustrating example planning processes for different aspects thereof.
Figure 16B:
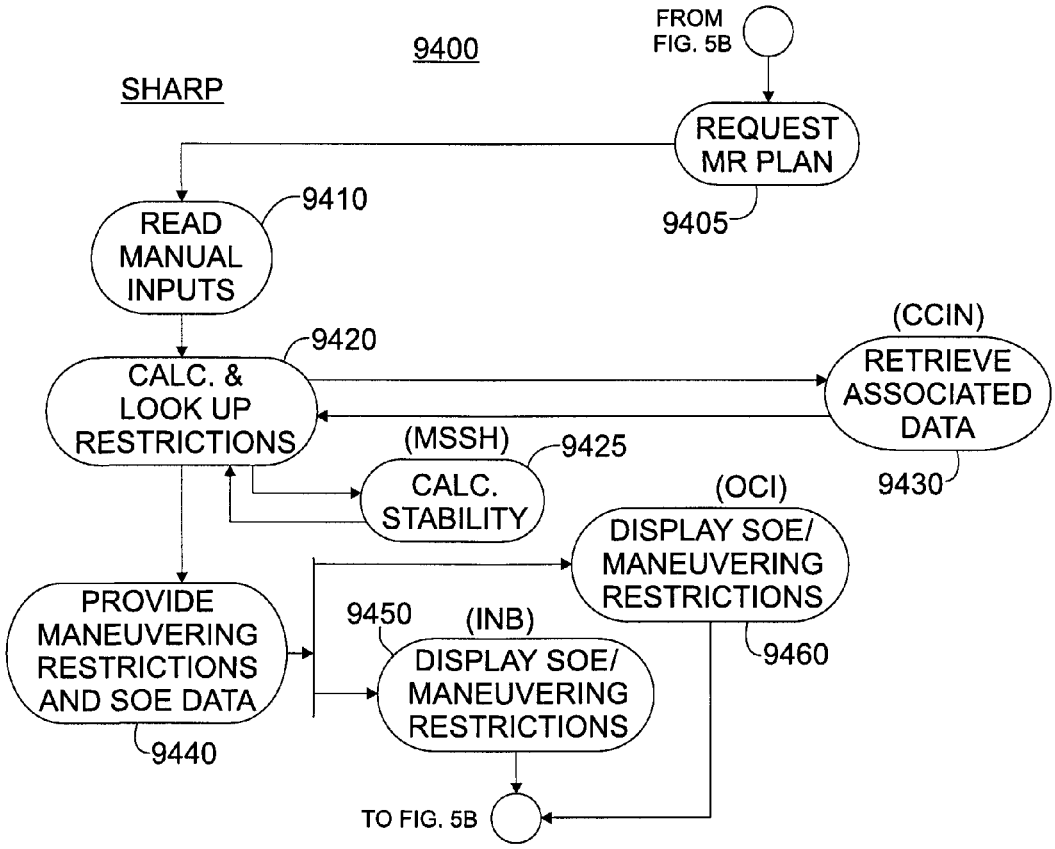

FIG. 16 illustrates example planning processes 9200, 9400 for the example damage control arrangement 300 of FIGS. 1-3 and comprises FIGS. 16A through 16B illustrating example planning processes 9200, 9400 for different aspects thereof. Processes 9200, 9400 allow the operator to plan for expected or hypothetical future conditions apart from a damage condition or other urgent situation. In FIG. 16A, process 9200 is for planning for vessel stability in response to an "ordered" stability request from the operator via OCI 260. An "ordered" request is a proposed or "what if?" type of request that could be commanded to change vessel 100 sailing parameters, e.g., trim, draft, list, center of gravity, and the like, by command of the operator, e.g., by the crew responsive to a command (order) by a commander, e.g., a captain, first mate, or the like. Process 9200 allows an operator to plan for a current or future ordered stability condition by SHARP 300 generating a list of potential tasks that would be necessary to complete in order to reach the ordered stability condition. If any stability hazard would occur if such ordered stability were to be implemented, then an alternative safe stability condition is provided to the operator by SHARP 300, and appropriate status reports, alerts and/or warnings are provided to the operator.

Upon the operator entering (requesting) 9205 an ordered stability planning request via OCI 260, SHARP system 300 checks 9210 the information of database 252, e.g., as stored in an integrated vessel's plan or other data, for the present loading condition, for future load plans and for planned changes to loading, so as to have as complete information as is available upon which to evaluate the stability of the condition that is planned. Using such information, the safety of the ordered stability condition is assessed 9220, e.g., using the same resources and parts of the processes that are used for assessing (evaluating) a hull stress and/or stability hazard, e.g., as illustrated by processes 900, 1000 and 2200 of FIGS. 10, 11 and 13. Irrespective of whether the ordered stability condition is assessed 9220 as being safe or unsafe, the status of the ordered stability processing 9200 is updated and displayed 9225 to the operator after the safety thereof is assessed 9220, e.g., via OCI 260. Process 9200 also proceeds to step 9230 and, if the ordered stability is unsafe, to step 9260.

Irrespective of whether the ordered stability condition is assessed 9220 as being safe or unsafe, SHARP 300 will generate 9230 a list of the tasks necessary to implement the ordered stability condition, if such list can be generated. If 9235 a task list is generated 9230, then 9235 [YES] the task list is processed 9240 by TMDS 210 for conflicts with other tasks and/or conditions, i.e. the tasks are de-conflicted 9240 by TMDS 210, and a task response list is provided 9245 by TMDS 210 to SHARP 300 where it updates 9250 the task list status as stored in SHARP 300. If the task list status reflects that a task list was generated 9230-9245 for an ordered stability and that the de-conflicted 9240 task list is not free of conflicts (i.e. the task response contains conflicting tasks and so is a cannot comply situation), then cannot comply 9255 is YES and the task list is again generated 9230 with conflicting tasks eliminated or modified, and process 9200 continues therefrom. If the task list status reflects a task list for a stability condition that is free of conflicts, then cannot comply 9255 is NO and a task message consistent therewith is generated 9270 for the operator, e.g., for display via OCI 260.

If the ordered stability condition is assessed 9220 as being an unsafe condition or if a task list cannot be generated 9230-9255 for a safe ordered stability, then an alternate safe stability condition is generated 9260 by SHARP 300. It is noted that several alternate stability conditions may be necessary to be generated 9260 before an alternate safe stability condition or the present stability condition results, and such iterative generation 9260 and evaluation 9230-9235 may follow loop 9260-9265-9230-9235-9240-9245-9250-9255 until an alternate safe stability condition can be provided. If 9265 the alternate stability condition that is generated 9260 is the present stability condition, then a task message is generated 9270 for the operator, e.g., for display via OCI 260.

It is also noted that while a particular stability condition, including an ordered stability condition, may be deemed unsafe, such stability condition is not necessarily a condition to be avoided in all instances. For example, where vessel 100 has sustained significant damage from whatever source, there may be no safe stability condition that can be obtained and so an unsafe stability condition may be the best available under the circumstances. By way of specific example, where vessel 100 has sustained significant flooding and so has increased draft and a degraded righting arm curve (a curve indicating the force tending to restore the vessel from a tilted or listing condition to an upright condition), it would be better to execute tasks to have an unsafe stability condition wherein there is a 20% probability of capsize under certain sea and weather conditions than to continue in a present stability condition wherein there is a 30% probability of capsize.

The task message generated 9270 for the operator will indicate if a task list could be generated for the ordered stability or if an alternate safe stability was generated if that is the case. The task message may also include the consequences that would follow if an unsafe ordered stability were to be implemented and the resources that would be needed to meet the unsafe ordered stability and the availability of such resources. In the case where an alternate ordered stability is provided, approval 9300 by the operator would be required before such alternate stability could be implemented or stored for possible future implementation. Generating 9270 a task message also results in updating 9225 the display of the status of the processing of the ordered stability request.

The ordered stability task message generated 9270 is displayed 9280 by OCI 260 to the operator for decision and direction 9300. If the operator elects 9300 to disregard or discard the ordered stability plan generated by SHARP 300, then 9300 [NO] is followed, process 9200 ends and SHARP 300 returns to FIG. 5B.

If the operator elects 9300 to act on the generated ordered stability plan, then 9300 [YES] is followed. If the selection 9300 [YES] is to execute the ordered stability plan generated by SHARP 300, then the ordered stability condition is selected 9310 for execution and is processed and executed 9315, process 9200 ends and SHARP 300 returns to FIG. 5B.

If the selection 9300 [YES] is to save 9320 the ordered stability plan generated by SHARP 300 as a custom ordered stability condition, then the present selected ordered stability plan is saved 9335 as a custom ordered stability by SHARP 300, is saved 9340 as a custom ordered stability by TMDS 210, and process 9200 ends and SHARP 300 returns to FIG. 5B. It is noted that the operator may cause more than one ordered stability plan to be generated and saved 9320-9340 as custom plans that will be available to the operator thereafter as a list of custom plans that have already been evaluated 9200.

If the selection 9300 [YES] is to save 9330 and incorporate the ordered stability plan generated by SHARP 300 into an integrated vessel (ship) plan (ISP), then the present ordered stability plan is so saved 9335 as an ISP ordered stability by SHARP 300, is saved 9340 as an ISP ordered stability by TMDS 210, planning process 9200 ends, and SHARP 300 returns to FIG. 5B. The ISP is an integrated plan typically including all known and all planned future events in the operation of vessel 100, and may include, e.g., sailing, course and speed, port calls, loadings and unloadings, relocations of load, fueling, ballasting and de-ballasting, engagements with other vessels and non-vessels, expected/predicted wind, weather and storms, expected/predicted sea state conditions, and the like, and the ISP is updated whenever there is an addition, deletion or other change to the vessel's planned operation.

In FIG. 16B, process 9400 is for planning for maneuvering restrictions and a vessel 100 safe operating envelope (SOE) in response to a request 9405 from the operator via OCI 260. The SOE is a set of boundary or limit conditions that define an envelope within which the vessel will be operated in a safe condition, particularly a safe stability condition. Included in the SOE are, e.g., various maneuvering restrictions defining respective limits and/or boundaries (an envelope) for safe operation. Typically, SHARP 300 is operating and has completed assessing the stability of vessel 100, e.g., as in process 420 of FIG. 5B including operation of MSSH 340 as described above. The operator's planning request might contain current conditions, e.g., of sea, wind, weather, vessel load and vessel stability, or might contain custom entered conditions originated by the operator, e.g., predicted or desired future conditions. Information may be entered via OCI 260 directly by the operator or may be entered as a planning table of conditions, for planning purposes.

Entered input data is read 9410 by SHARP 300 and is separated into data that relates to the SOE database and data that relates to evaluation by MSSH 340. Data elements relating to the limits and/or boundaries for safe operation initiate inquiry 9440 into the SOE data stored in the vessel's database 252, and information relating to factors that affect the stability and/or hull stress on vessel 100 are sent to MSSH 340 for evaluation/strategy formulation 9425 with respect thereto.

Restrictions on maneuvering are calculated 9425, e.g., by MSSH 340, and/or are looked up 9430 in a database, e.g, are retrieved 9430 from data in database 252 maintained in CCIN 250. Maneuvering restrictions may include all or some of the following: probability of capsize and/or broaching at various headings and speeds, minimum turning circle diameter, maximum rudder angle, heading restrictions (e.g., true heading), and probability of surf ride, e.g., to reduce the probability of capsize and/or broaching. The SOE may include all of the maneuvering restrictions as well as other restrictions, e.g., maximum loads, trim, draft and list limits, speed limits, and the like.

Maneuvering restrictions and SOE resulting from calculations 9425 and from look-up 9430 are combined 9420 and are provided 9440 to various locations and functions of vessel 100, e.g., to OCI 260 for display 9460 to the operator and to the integrated bridge INB for displayed 9450 to the commanding and sailing crew, and may be provided to navigation and automated sailing controls as well. Planning process 9400 then ends and SHARP 300 returns to FIG. 5B.

Figure 17A:
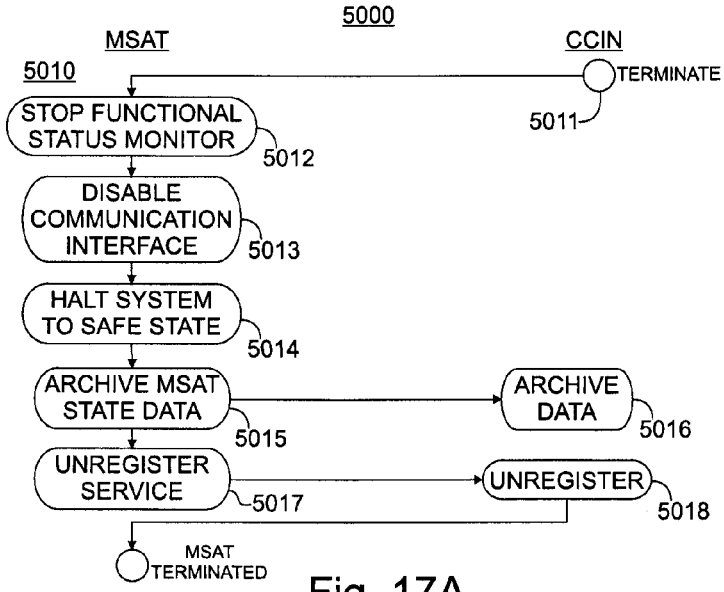
FIG. 17 illustrates an example termination process for the example damage control arrangement of FIGS. 1-3 and comprises FIGS. 17A through 17C illustrating example termination processes for different elements thereof.
Figure 17B:
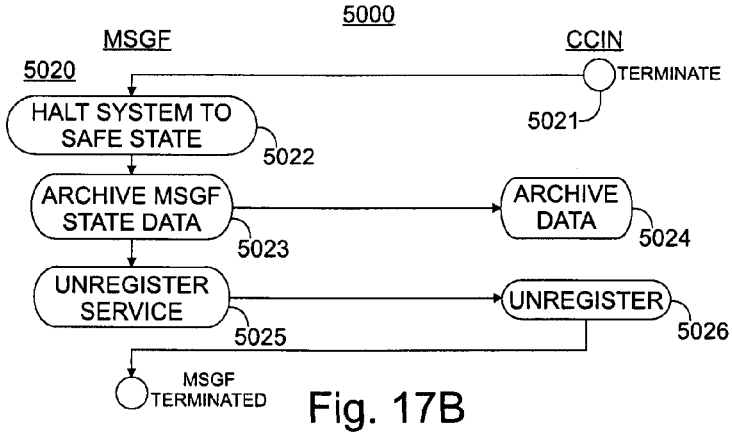
Figure 17C:
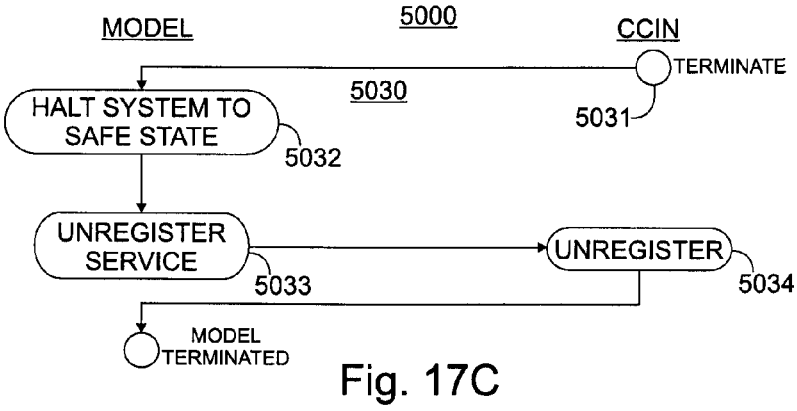

FIG. 17 illustrates an example termination process 5000 for the example damage control arrangement 300 of FIGS. 1-3 and comprises FIGS. 17A through 17C illustrating example termination processes 5010, 5020, 5030 for different elements thereof. It is noted that termination processes 5010, 5020, 5030 may be run one after the other (serially) or at the same time (in parallel; contemporaneously), as may be desired, however, SHARP system 300 will be unavailable after the first of processes 5010, 5020, 5030 runs.

In FIG. 17A, for example, termination process 5010 for MSAT 310 commences with a terminate command 5011 and comprises stopping 5012 the functional status monitoring of MSAT 310, disabling 5013 the data collection communication interfaces thereof, and halting 5014 the MSAT system 310 to a safe termination state, thereby to allow the assessment processes performed by MSAT 310 sufficient time to reach a state that is safe for being shut down. Then, the MSAT 310 state data then existing, e.g., hazard and/or damage classifications and compartment classifications, are archived 5015 to an archive database of CCIN 250 so that this data will be available upon the next start up of MSAT 310. Finally, MSAT 310 unregisters 5017, 5018 with CCIN 250 so that SHARP system 300 is unregistered with the vessel's computing and communication infrastructure 250 with which and through which it operates, so that its status can be reported as unavailable to the human operators by CCIN 250 via displays OCI 260 to complete termination (End) of operation of MSAT 310.

In FIG. 17B, for example, termination process 5020 for MSGF 320 commences with a terminate command 5021 and comprises halting 5022 the MSGF 320 system 320 to a safe termination state, thereby to allow the strategy formulation processes performed by MSGF 320 sufficient time to reach a state that is safe for being shut down. Then, the MSGF 320 state data then existing, e.g., damage strategies formulated and the hazard and/or damage classifications and compartment classifications to which they pertain, are archived 5024 to an archive database of CCIN 250 so that this data will be available upon the next start up of MSGF 320. Finally, MSGF 320 unregisters 5025, 5026 with CCIN 250 so that SHARP system 300 is unregistered with the vessel's computing and communication infrastructure 250 with which and through which it operates, so that its status can be reported as unavailable to the human operators by CCIN 250 via displays OCI 260 to complete termination (End) of operation of MSGF 320.

In FIG. 17C, for example, termination process 5030 for an example one of models 330-370 is illustrated, e.g., any one of models 330-370. Termination 5030 of the example one of models 330-370 commences with a terminate command 5031 and comprises halting 5032 the model system 330-370 to a safe termination state, thereby to allow the modeling processes performed by model 330-370 sufficient time to reach a state that is safe for being shut down. Typically, models 330-370 have no data that need be archived because MSAT 310 and MSGF 320 archive the data that they generate using models 330-370 as tools (toolkits). Then, model 330-370 unregisters 5033, 5034 with CCIN 250 so that SHARP system 300 is unregistered with the vessel's computing and communication infrastructure 250 with which and through which it operates, so that its status can be reported as unavailable to the human operators by CCIN 250 via displays OCI 260 to complete termination (End) of operation of MSGF 320.

At the completion of termination processes 5010, 5020, 5030 of process 5000, SHARP system 300 is in an OFF or non-operational condition, and is ready to receive a start up command to resume operation, e.g., at an initial turn on or in a recovery from an unplanned termination such as might result from a damage condition or other cause that interrupts a service that SHARP system 300 depends upon, e.g. the vessel's electrical power, CCIN 250 and the like. Because the various databases maintained by CCIN 250 are updated regularly during operation of SHARP system 300, e.g., at each data report and mode change, as well as at the termination of its operation, SHARP system 300 is able to resume operation, even after an unexpected and/or unplanned termination, and to have available the same data as it had immediately before, or at least shortly before, the termination and/or interruption of its operation, e.g., SHARP system 300 resumes where it left off.

A vessel hazard and damage assessment and strategy formulation system 200, 300 may comprise a hazard assessment element 310 receiving alarms and/or data from sensors S for assessing the type and severity of a hazard represented by the alarms and/or data; a plurality of models 330-370 for modeling different hazards selected from the group including fire, smoke, temperature, flooding, hull damage, structural damage, hazardous gas, explosive gas, carbon monoxide, chemical agents, biological agents and radiological agents; a strategy formulation element 320 receiving a hazard assessment from the hazard assessment element 310 for formulating a strategy of tasks for responding to the type and severity of hazard represented by the hazard assessment, wherein the strategy formulation element 320 communicates the hazard assessment to one or ones of the plurality of models 330-370 and the one or ones of the plurality of models 330-370 communicate hazard modeled response information to the strategy formulation element 320, and means 200, 250, 260 communicating the tasks for implementation, for display or for implementation and display. Hazard assessment element 310 may communicate hazard type and severity information to one or ones of the plurality of models 330-370 in advance of the strategy formulation element 320 communicating the hazard assessment to the one or ones of the plurality of models 330-370. The system 200, 300 may have an autonomous operating mode, an operator override operating mode and an operator support operating mode.

The present arrangement can be embodied as a computer implemented process or processes and/or apparatus for performing such computer-implemented process or processes, and can also be embodied in the form of a tangible storage medium containing a computer program or other machine-readable (e.g., computer readable) instructions (herein "computer program"), wherein when the computer program is loaded into a computer or other processor (herein "computer") and/or is executed by the computer, the computer becomes an apparatus for practicing the process or processes. Storage media for containing such computer program include, for example, floppy disks and diskettes, compact disk (CD)-ROMs (whether or not writeable), DVD digital disks, RAM and ROM memories, computer hard drives and back-up drives, external hard drives, "thumb" drives, and any other storage medium readable by a computer. The process or processes can also be embodied in the form of a computer program, for example, whether stored in a storage medium or transmitted over a transmission medium such as electrical conductors, fiber optics or other light conductors, or by electromagnetic radiation, wherein when the computer program is loaded into a computer and/or is executed by the computer, the computer becomes an apparatus for practicing the process or processes. The process or processes may be implemented on a general purpose microprocessor or on a digital processor specifically configured to practice the process or processes. When a general-purpose microprocessor is employed, the computer program code configures the circuitry of the microprocessor to create specific logic circuit arrangements. Storage medium readable by a computer includes medium being readable by a computer per se or by another machine that reads the computer instructions for providing those instructions to the computer to control its operation. Such machines may include, for example, a punched card reader, a magnetic tape reader, a magnetic card reader, as well as the storage media mentioned above.

SHARP system 300 may be implemented, e.g., entirely in hardware, in a combination of hardware and computer software, or in software that runs on computers and networks that are a part of a vessel and that utilizes sensors that are part of the vessel. Because many modern vessels have computers, communication networks and related sensors, it is thought that a SHARP system that runs on a vessel's computer and that utilizes a vessel's sensors may be a common, if not a typical, embodiment.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements. As used herein, the terms "ship" and "vessel" are considered equivalent, and encompass vessels of any type and kind, e.g., seagoing vessels, airborne vessels, space vessels, and land vessels.

Further, what is stated as being "optimum" or "deemed optimum" may or not be a true optimum condition, but is the condition deemed to be "optimum" by virtue of its being selected in accordance with the decision rules and/or criteria defined by the applicable controlling function, e.g., a proposed response to a sensed fire and smoke situation may include the initiation of water misting and/or the dispensing inert fire suppressing gas in a certain timing sequence and/or in certain locations based upon a less than complete set of sensor and/or human inputs.

Information may be described as displayed or as displayed on a display or display device, which is intended to encompass any and all of the wide variety of displays that a user may desire, including, but not limited to, visual images and pictures, whether still or moving, whether generated by a camera, computer or any other source, whether true, representative or abstract or arbitrary, whether or not including symbols or characters such as alphanumeric characters or mathematical notations, whether displayed in black and white, monochrome, polychrome or full color. The terms information and data are used interchangeably and as equivalent.

While the present invention has been described in terms of the foregoing example embodiments, variations within the scope and spirit of the present invention as defined by the claims following will be apparent to those skilled in the art. For example, the damage assessment and control arrangement may be implemented in hardware, e.g., hardware dedicated to damage control functions, or in software, e.g., utilizing sensors, computer resources and the like provided by other systems, and/or in a combination of damage assessment and control hardware and software, as may be convenient in a particular ship, vessel, or other environment.

The described damage assessment and control arrangement of SHARP system 300 is arranged to have two primary modules or functions, MSAT 310 and MSGF 320 that provide most of the functionality of SHARP system 300 in a manner that is suitable for use on a variety of different types and kinds of vessels, e.g., larger and smaller vessels, merchant marine and passenger vessels, commercial and military vessels, and the like. Data and information pertaining to the particular vessel in which SHARP system 300 is provided is maintained in various databases stored in the vessel's computer system, e.g., CCIN 250, to avoid the need to customize or otherwise change MSAT 310 and MSGF 320 from vessel to vessel. This arrangement also facilitates updating and/or adding features to SHARP system 300 which is thought to provide flexibility and a cost advantage.

Further, and similarly, the modeling resources for SHARP system 300 are provided in various independent ensembles or models 330-370 each of which interfaces with MSAT 310 and MSGF 320 via a model interface, thereby standardizing the interface for facilitating the easy replacement and/or substitution of upgraded, updated and/or computationally different models, or additional and/or new functionality, without having to modify MSAT 310 or MSGF 320 which is thought to also provide flexibility and a cost advantage.

Additionally, any given embodiment of the present damage assessment and control system may employ different numbers of models and/or different allocations of hazards among the models provided. Preferably, e.g., fire and smoke hazards are provided in a combined model, but they may be provided in separate models, and further, it may be convenient or desirable to provide a hazardous/explosive gas model as part of a combined fire and smoke model because fire could cause release of hazardous gas and because the spread of smoke and gas and the responses thereto will be similar, e.g., ventilating and/or sealing compartments. E.g., separate models may be provided for chemical, biological and radiological hazards or the modeling thereof may be combined in a single model because the responses to such hazards may be similar.

While three modes of operation are described in the example embodiment described, a manual mode of operation is also available wherein a human operator monitors reports from sensors and other data inputs, analyzes the damage condition and situation, determines possible corrective actions, and decides upon the corrective action to be taken. Further, SHARP system 300 could have more or less than three modes of automation, e.g., SHARP system 300 could be provided with an automated mode and an operator support mode.

The damage assessment and control system may include some or all of the various sensors, operator-computer interfaces and other resources described and/or utilized in providing its function, or may utilize sensors, interfaces and/or resources that are considered to be a part of other systems or elements of a vessel. For example, a vessel computing and/or computing and communication infrastructure may provide the computers on which the damage assessment and control system operates and the networks through which it communicates, and a operator-computer interface infrastructure may provide various displays on which damage assessment and control responses are presented to human operators for monitoring, overriding and/or authorization.

Optionally, MSGF 320 could include other factors, e.g., crew availability, in formulating a response strategy and/or in indicating the feasibility of a response strategy. SHARP system 300 could include a process for crew management, e.g., scheduling work and leave times, assigning crew tasks, locating crew, and the like.

Because the present damage assessment and control system receives and stores reports of sensor and system failures and outages, e.g., in process 6300, SHARP system 300 may optionally provide notifications and/or requests relating to the need for investigation and/or repair of damaged/ruptured pipes and machinery, although such might more commonly be provided by the engineering system of which such pipes and machinery are a part.

Finally, numerical values stated are typical or example values, are not limiting values, and do not preclude substantially larger and/or substantially smaller values. Values in any given embodiment may be substantially larger and/or may be substantially smaller than the example or typical values stated.

APPENDIX A

| LIST OF SELECTED TERMS AND ACRONYMS | |
|---|---|
| ADA | Adjacent Damage Area |
| AFFF | Aqueous Film Forming Foam |
| AMDS | Asset Management and Distribution Service |
| Calc. | Calculate or calculation |
| CBR | Chemical, Biological and Radiological |
| CCI | Command, Control and Intelligence |
| CCIN | Computing and Communication Infrastructure |
| Class. | Classification(s) |
| CMWD | Counter Measure Wash Down |
| Comm. | Communication |
| Comp. | Compartment or Compartments |
| Config. | Configuration or Configurations |
| Conf. | Confirm or Confirmation |
| DC | Damage Control |
| ENSYS | Engineering System Controller |
| F/S | Fire/Smoke; Fire and/or Smoke |
| F/S/HS | Flood/Stability/Hull Stress; Flooding and/or Stability and/or Hull Stress |
| Gen. | Generate, generation |
| HM&E | Hull, Mechanical and Electrical |
| ICP | Integrated Casualty Plot or Integrated Casualty Picture |
| INB | INtegrated Bridge (also CINB) |
| Intel. | Intelligence |
| ISP | Integrated Ship's Plan |
| Mgmt. | Management |
| Mod. | Modification or Modifications |
| MSAT | Situation Assessment Module |
| Msg. | Message |
| MSGF | Strategy Formulation Module |
| NAV | Navigation System |
| OCI | Operator-Computer Interface |

APPENDIX A-continued

| LIST OF SELECTED TERMS AND ACRONYMS | |
|---|---|
| PDA | Primary Damage Area |
| PLMS | Personnel Locator and Management System |
| PLS | Personnel Locator Service or System |
| RFID | Radio Frequency Identification |
| SDA | Secondary Damage Area |
| SHARP | Smart Hazard Assessment and Response Planning |
| S/HS | Stability/Hull Stress; Stability and/or Hull Stress |
| SOE | Safe Operating Envelope |
| S/S | Sensor/System; Sensor and/or System |
| Temp. | Temperature |
| TMDS | Task Management and Deconflicting System |
| W/ & W/out | With & Without |

What is claimed is:

1. A hazard assessment and strategy formulation system for a vessel comprising:

a hazard assessment element receiving alarms, or data, or alarms and data, representing damage or a hazard or damage and a hazard, for assessing the type and severity of a hazard represented by the alarms, the data, or both the alarms and the data, to provide an integrated assessment of hazard, damage and condition;

a plurality of models for modeling at least two different hazards, the plurality of models including at least one model for modeling at least one hazard selected from the group including fire, smoke and fire and smoke, and at least one model for modeling at least one hazard selected from the group including temperature, flooding, hull damage, structural damage, hull stress, stability, hazardous gas, explosive gas, carbon monoxide, chemical agents, biological agents and radiological agents;

whereby at least two models model at least two different hazards that are not related to each other, wherein the data from the plurality of models relating to the at least two different hazards is fused for providing the integrated assessment of hazard, damage and condition;

a strategy formulation element receiving the integrated assessment of hazard, damage and condition from the hazard assessment element for formulating an integrated strategy of tasks for responding to the type and severity of hazard represented by the integrated assessment of hazard, damage and condition, wherein said strategy formulation element communicates the strategy of tasks to one or ones of the plurality of models and the one or ones of the plurality of models communicate modeled integrated hazard response information back to the strategy formulation element, and means communicating the modeled integrated hazard response information for implementation, or for display, or for report, or for any combination of implementation, display and report, whereby the integrated strategy of tasks and the integrated hazard response information integrate responses to at least two different hazards that are not related to each other.

2. The system of claim 1 wherein the hazard assessment element communicates hazard type and severity information to one or ones of the plurality of models in advance of the strategy formulation element communicating the strategy of tasks to the one or ones of the plurality of models.

3. The system of claim 1 wherein said system has selectable modes including an autonomous operating mode, an operator override operating mode, an operator support operating mode, and any combination of the foregoing.

4. The system of claim 1 wherein the hazard assessment element regularly and periodically assesses stability at times when no hazard alarm and no hazard data is received.

5. The system of claim 1 wherein the means communicating the modeled hazard response information includes an operator interface for displaying the modeled hazard response information for an operator, and for receiving information input by the operator, wherein the display includes information on a computer monitor, or printed information, or information on a computer monitor and printed information.

6. The system of claim 5 wherein information input by the operator includes hazard information, or damage information, or task information, or personnel information, or crew information, or route information, or load information, or loading information, or unloading information, or status information, or planning information, or request information, or sailing information, or ordered stability information, or maneuvering restriction information, or mode selection information, or any combination of the foregoing.

7. The system of claim 1 wherein the plurality of models for modeling different hazards include a modular model for fire and smoke, or a modular model for flooding, hull stress and stability, or a modular model for chemical, biological and radiological agents, or a combination of the foregoing.

8. The system of claim 1 wherein the hazard assessment element assesses hazards by classifying a compartment for which an alarm or data is received, including classifying the compartment by type of hazard, of alarm or of both hazard and alarm, by severity of hazard, of alarm or of both hazard and alarm, by time of hazard, of alarm or of both hazard and alarm, and by a hazard of an adjacent compartment.

9. A hazard assessment and strategy formulation method for a vessel comprising:

receiving alarms, or data, or alarms and data, representing damage or a hazard or damage and a hazard;

assessing the type and severity of a hazard or hazards represented by the received alarms, the received data, or both the received alarms and the received data, to provide an integrated assessment of hazard, damage and condition;

modeling different hazards using a plurality of models for modeling at least two different hazards, the plurality of models including at least one model for modeling at least one hazard selected from the group including fire, smoke and fire and smoke, and at least one model for modeling at least one hazard selected from the group including temperature, flooding, hull damage, structural damage, hull stress, stability, hazardous gas, explosive gas, carbon monoxide, chemical agents, biological agents and radiological agents;

whereby at least two models model at least two different hazards that are not related to each other, fusing data from the plurality of models relating to the at least two different hazards for providing the integrated assessment of hazard, damage and condition;

receiving the integrated assessment of hazard, damage and condition including the type and severity of the assessed hazard or hazards;

formulating from the received integrated assessment of hazard, damage and condition an integrated strategy of tasks for responding to the type and severity of hazard or hazards represented by the integrated assessment of hazard, damage and condition, including communicating the integrated strategy of tasks to one or ones of the plurality of models and receiving from the one or ones of the plurality of models modeled integrated hazard response information; and communicating the modeled integrated hazard response information for implementation, or for display, or for report, or for any combination of implementation, display and report, whereby the integrated strategy of tasks and the integrated hazard response information integrate responses to at least two different hazards that are not related to each other.

10. The method of claim 9 wherein hazard type and severity information is communicated to one or ones of the plurality of models in advance of the formulating a strategy of tasks and communicating the strategy of tasks to the one or ones of the plurality of models.

11. The method of claim 9 further comprising selecting an autonomous operating mode, an operator override operating mode, an operator support operating mode or any combination of the foregoing.

12. The method of claim 9 further comprising regularly and periodically assessing stability even at times when no hazard alarm and no hazard data is received.

13. The method of claim 9 wherein the communicating the modeled hazard response information includes displaying the modeled hazard response information on an operator interface, and further includes receiving information input by an operator, wherein the displaying includes displaying information on a computer monitor, or printing information, or displaying information on a computer monitor and printing information.

14. The system of claim 13 wherein information input by the operator includes hazard information, or damage information, or task information, or personnel information, or crew information, or route information, or load information, or loading information, or unloading information, or status information, or planning information, or request information, or sailing information, or ordered stability information, or maneuvering restriction information, or mode selection information, or any combination of the foregoing.

15. The method of claim 9 wherein the plurality of models for modeling different hazards include a modular model for fire and smoke, or a modular model for flooding, hull stress and stability, or a modular model for chemical, biological and radiological agents, or a combination of the foregoing.

16. The method of claim 9 wherein the assessing includes classifying a compartment for which an alarm or data is received, including classifying the compartment by type of hazard, of alarm or of both hazard and alarm, by severity of hazard, of alarm or of both hazard and alarm, by time of hazard, of alarm or of both hazard and alarm, and by a hazard of an adjacent compartment.

17. A computer-readable storage medium encoded with computer instructions for assessing hazards and damage to a vessel and formulating a strategy therefor comprising:

means for causing a computer to receive alarms, or data, or alarms and data, representing damage or a hazard or damage and a hazard;

means for causing the computer to assess the type and severity of a hazard or hazards represented by the received alarms, the received data, or both the received alarms and the received data, to provide an integrated assessment of hazard, damage and condition;

means for causing the computer to model different hazards using a plurality of models for modeling at least two different hazards, the plurality of models including at least one model for modeling at least one hazard selected from the group including fire, smoke, and fire and smoke, and at least one model for modeling at least one hazard selected from the group including temperature, flooding, hull damage, structural damage, hull stress, stability, hazardous gas, explosive gas, carbon monoxide, chemical agents, biological agents and radiological agents;

whereby at least two models model at least two different hazards that are not related to each other, means for causing the computer to fuse data from the plurality of models relating to the at least two different hazards for providing the integrated assessment of hazard, damage and condition;

means for causing the computer to receive a the integrated assessment of hazard, damage and condition including the type and severity of the assessed hazard or hazards;

means for causing the computer to formulate from the received integrated assessment of hazard, damage and condition an integrated strategy of tasks for responding to the type and severity of hazard or hazards represented by the integrated assessment of hazard, damage and condition, including means for causing the computer to communicate the integrated assessment of hazard, damage and condition to one or ones of the plurality of models and means for causing the computer to receive from the one or ones of the plurality of models modeled integrated hazard response information; and means for causing the computer to communicate the modeled integrated hazard response information for implementation, for display, or for report, or for any combination of implementation, display and report, whereby the integrated strategy of tasks and the integrated hazard response information integrate responses to at least two different hazards that are not related to each other.

18. The storage medium of claim 17 further comprising means for causing the computer to communicate hazard type and severity information to one or ones of the plurality of models in advance of the computer formulating a strategy of tasks and communicating the strategy of tasks to the one or ones of the plurality of models.

19. The storage medium of claim 17 further comprising means for causing the computer to select an autonomous operating mode, an operator override operating mode, an operator support operating mode or a combination of the foregoing.

20. The storage medium of claim 17 further comprising means for causing the computer to regularly and periodically assess stability even at times when no hazard alarm and no hazard data is received.

21. The storage medium of claim 17 wherein the means for causing the computer to communicate the modeled hazard response information includes means for causing the computer to display the modeled hazard response information on an operator interface, and further includes means for causing the computer to receive input information from an operator, wherein the means for causing the computer to display includes means for causing the computer to display information on a computer monitor, or means for causing the computer to print information, or means for causing the computer to display information on a computer monitor and to print information.

22. The storage medium of claim 21 wherein information input by the operator includes hazard information, or damage information, or task information, or personnel information, or crew information, or route information, or load information, or loading information, or unloading information, or status information, or planning information, or request information, or sailing information, or ordered stability information, or maneuvering restriction information, or mode selection information, or any combination of the foregoing.

23. The storage medium of claim 17 wherein the plurality of models for modeling different hazards include a modular computer model for fire and smoke, or a modular computer model for flooding, hull stress and stability, or a modular computer model for chemical, biological and radiological agents, or a combination of the foregoing.

24. The storage medium of claim 17 wherein the means for causing the computer to assess includes means for causing the computer to classify a compartment for which a hazard alarm or data is received, including means for causing the computer to classify the compartment by type of hazard, of alarm or of both hazard and alarm, by severity of hazard, of alarm or of both hazard and alarm, by time of hazard, of alarm or of both hazard and alarm, and by a hazard of an adjacent compartment.

25. The system of claim 1 wherein said strategy formulation element includes a de-confliction element to detect and remove conflicts between tasks included in the modeled hazard response information.

26. The method of claim 9 wherein said formulating a strategy of tasks includes de-conflicting tasks to detect and remove conflicts between tasks included in the modeled hazard response information.

27. The storage medium of claim 17 wherein said means for causing the computer to formulate a strategy of tasks includes means for causing the computer to de-conflict tasks to detect and remove conflicts between tasks included in the modeled hazard response information.

* * * * *